US012024810B2

(12) United States Patent
Kim et al.

(10) Patent No.: US 12,024,810 B2
(45) Date of Patent: Jul. 2, 2024

(54) WASHING MACHINE

(71) Applicant: Samsung Electronics Co., Ltd., Suwon-si (KR)

(72) Inventors: Dong Won Kim, Suwon-si (KR); Jin Doo Kim, Suwon-si (KR); Yeong Man Kim, Suwon-si (KR); Seung Youp Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 44 days.

(21) Appl. No.: 17/523,676

(22) Filed: Nov. 10, 2021

(65) Prior Publication Data

US 2022/0106726 A1 Apr. 7, 2022

Related U.S. Application Data

(62) Division of application No. 15/118,471, filed as application No. PCT/KR2015/001392 on Feb. 11, 2015, now Pat. No. 11,186,940.

(30) Foreign Application Priority Data

Feb. 11, 2014 (KR) ..... 10-2014-0015607
Feb. 13, 2014 (KR) ..... 10-2014-0016853
(Continued)

(51) Int. Cl.
*D06F 39/12* (2006.01)
*D06F 23/02* (2006.01)
*D06F 37/26* (2006.01)

(52) U.S. Cl.
CPC ..... *D06F 39/12* (2013.01); *D06F 23/02* (2013.01); *D06F 37/26* (2013.01)

(58) Field of Classification Search
CPC ..... D06F 39/12; D06F 37/26
See application file for complete search history.

(56) References Cited

U.S. PATENT DOCUMENTS 4,242,546 A 12/1980 Alonso
5,881,576 A 3/1999 Davies, Jr.
(Continued)

FOREIGN PATENT DOCUMENTS

CN 1504601 A 6/2004
CN 202913245 U 5/2013
(Continued)

OTHER PUBLICATIONS

Communication of notices of opposition (R. 79(1) EPC) dated Mar. 17, 2020 in connection with European Patent Application No. 15749093.9, 1 page.
(Continued)

*Primary Examiner* — Spencer E. Bell

(57) ABSTRACT

Provided is a washing machine including: a cabinet including a plurality of side frames, a back frame, a top frame and a bottom frame; a front frame that is disposed in front of the cabinet and includes an internal laundry port through which laundry is put into a rotating tub, and a front cover that is disposed in front of the front frame, extends from the top frame to the bottom frame, includes an external laundry port corresponding to the internal laundry port and is integrally formed. Thus, no line is formed in a front side of the washing machine so that the exterior of the washing machine can be enhanced.

9 Claims, 41 Drawing Sheets

(30) Foreign Application Priority Data

Mar. 21, 2014 (KR) ..... 10-2014-0033574
Mar. 21, 2014 (KR) ..... 10-2014-0033677
Dec. 22, 2014 (KR) ..... 10-2014-0186393

(56) References Cited

U.S. PATENT DOCUMENTS

| | | | | |
|---|---|---|---|---|
| 10,156,038 | B2 | 12/2018 | Bohm et al. | |
| 2004/0150303 | A1 | 8/2004 | Park et al. | |
| 2004/0168484 | A1 | 9/2004 | Kim et al. | |
| 2004/0244438 | A1 | 12/2004 | North | |
| 2006/0225466 | A1 | 10/2006 | Lee et al. | |
| 2007/0056329 | A1* | 3/2007 | Song | D06F 39/02 68/17 R |
| 2007/0159034 | A1 | 7/2007 | Funcken et al. | |
| 2007/0209403 | A1 | 9/2007 | Byun et al. | |
| 2008/0265721 | A1* | 10/2008 | Kang | D06F 39/12 312/211 |
| 2009/0033185 | A1 | 2/2009 | Park et al. | |
| 2009/0066205 | A1* | 3/2009 | Park | D06F 34/28 312/228 |
| 2009/0091222 | A1* | 4/2009 | Jang | D06F 39/12 312/228 |
| 2009/0223256 | A1* | 9/2009 | Kim | D06F 34/28 68/12.27 |
| 2010/0005839 | A1 | 1/2010 | Kim et al. | |
| 2011/0154865 | A1* | 6/2011 | Lee | D06F 39/02 68/17 R |
| 2011/0234073 | A1 | 9/2011 | Thompson Salinas et al. | |
| 2014/0068873 | A1 | 3/2014 | Lee et al. | |
| 2016/0194805 | A1* | 7/2016 | De Pellegrin | D06F 34/34 312/237 |

FOREIGN PATENT DOCUMENTS

| | | | |
|---|---|---|---|
| EP | 0104497 | B1 | 4/1984 |
| EP | 0588100 | A1 | 3/1994 |
| EP | 1424429 | A1 | 6/2004 |
| EP | 1710 341 | A1 | 10/2006 |
| EP | 2444541 | A1 | 4/2012 |
| GB | 2022621 | A | 12/1979 |
| JP | 06-035560 | A | 2/1994 |
| JP | H08299684 | A | 11/1996 |
| JP | 2013-70832 | A | 4/2013 |
| KR | 10-0379426 | B1 | 4/2003 |
| KR | 10-0463546 | B1 | 12/2004 |
| KR | 20-0395270 | Y1 | 9/2005 |
| KR | 10-0595181 | B1 | 7/2006 |
| KR | 10-2008-0081808 | A | 9/2008 |
| KR | 10-1036468 | B1 | 5/2011 |
| KR | 10-2012-0041428 | A | 5/2012 |
| KR | 10-2013-0112665 | A | 10/2013 |
| KR | 10-2013-0112666 | A | 10/2013 |
| KR | 10-2013-0112667 | A | 10/2013 |
| KR | 10-2013-0112668 | A | 10/2013 |
| KR | 10-2013-0112669 | A | 10/2013 |
| KR | 10-2013-0112670 | A | 10/2013 |
| KR | 10-2013-0112671 | A | 10/2013 |
| KR | 10-2013-0112672 | A | 10/2013 |
| WO | 02/22937 | A1 | 3/2002 |
| WO | 2006/072904 | A1 | 7/2006 |
| WO | 2006/110006 | A1 | 10/2006 |
| WO | 2007/000645 | A1 | 1/2007 |
| WO | 2009/134072 | A2 | 11/2009 |
| WO | 2010/066653 | A1 | 6/2010 |

OTHER PUBLICATIONS

Communication of a notice of opposition dated Mar. 4, 2020 in connection with European Patent Application No. 15749093.9, 5 pages.

Opposition Writ-Notice of opposition against European patent EP3098342B1 granted to Samsung Electronics Co., Ltd. on May 29, 2019, dated Feb. 27, 2020, 26 pages.

Extended European Search Report dated Nov. 5, 2020 in connection with European Patent Application No. 20 19 9294, 8 pages.

European Patent Office, "Summons to attend oral proceedings pursuant to Rule 115(1) EPC," in connection with European Application No. 15749093.9 dated Mar. 4, 2021, 13 pages.

Korean Intellectual Property Office, "Notice Requesting Submisson of Opinion," Results of Examination in connection with Korean Patent Application No. 10-2014-0186393 dated Jan. 19, 2021, 24 pages.

Notice of Patent Allowance dated Jul. 21, 2021 in connection with Korean Patent Application No. 10-2014-0186393, 4 pages.

Invitation pursuant to Rule 137(4) EPC and Article 94(3) EPC dated Sep. 7, 2021 in connection with European Patent Application No. 20 199 294.8, 3 pages.

Letter from the opponent dated Oct. 8, 2021 in connection with European Patent Application No. 15749093.9, 16 pages.

Notice of Allowance dated Nov. 5, 2018 in connection with Chinese Patent Application No. 201580017658.6, 5 pages.

Communication under Rule 71(3) EPC dated Dec. 4, 2018 in connection with European Patent Application No. 15 749 093.9, 134 pages.

Communication from a foreign patent office in a counterpart foreign application, European Patent Office, "Communication pursuant to Article 94(3) EPC," Application No. EP 15749093.9, dated May 3, 2018, 5 pages.

The First Office Action regarding Chinese Patent Application No. 201580017658.6, dated Feb. 2, 2018, 15 pages.

European Patent Office, "Supplementary European Search Report," Application No. EP 15 74 9093, dated Jul. 19, 2017, 8 pages.

International Search Report dated Jun. 4, 2015 in connection with International Application No. PCT/KR2015/001392, 8 pages.

Written Option of the International Searching Authority dated Jun. 5, 2015 in connection with International Application No. PCT/KR2015/001392, 20 pages.

Korean Intellectual Property Office, "Notice of Preliminary Rejection" dated Feb. 11, 2022, in connection with Korean Patent Application No. 10-2021-0140889, 7 pages.

European Patent Office, "Communication under Rule 71(3) EPC" dated Mar. 2, 2022, in connection with European Patent Application No. 20199294.8, 94 pages.

* cited by examiner

[Fig. 4]
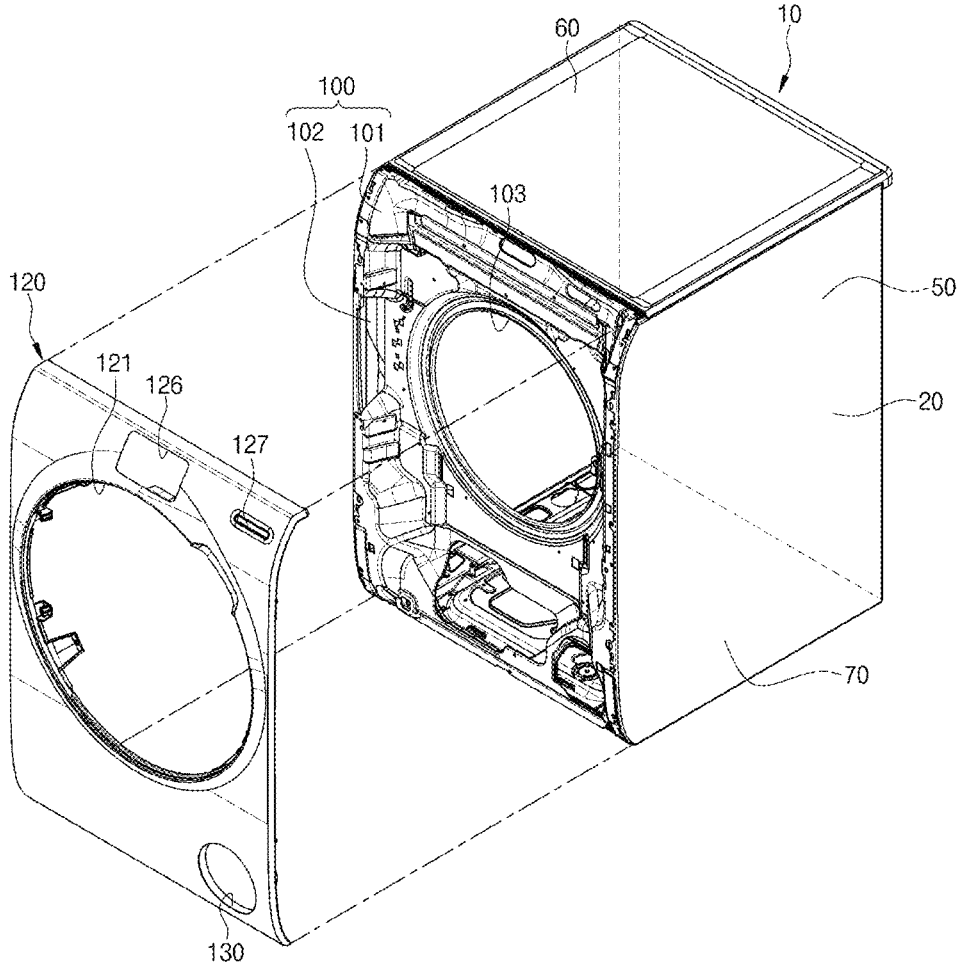

[Fig. 5]
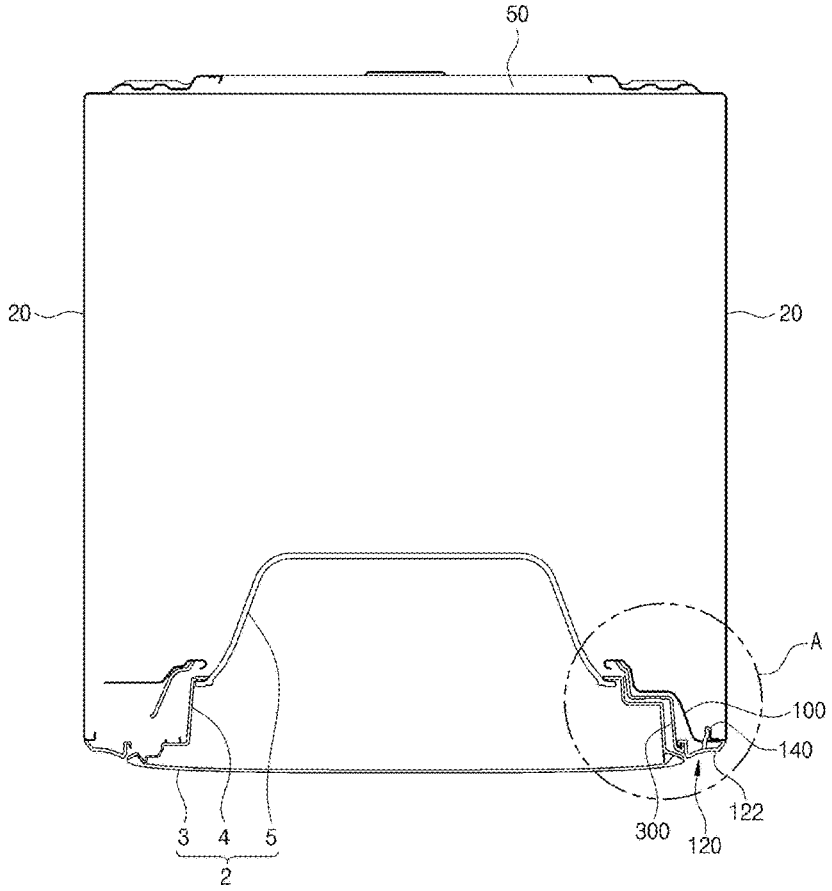
[Fig. 6]
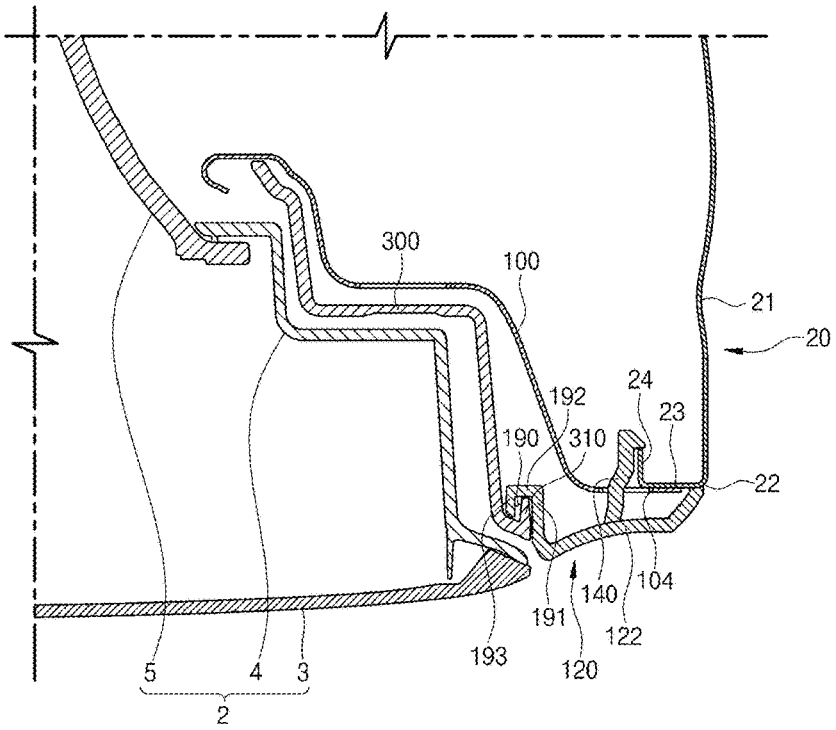

[Fig. 7]
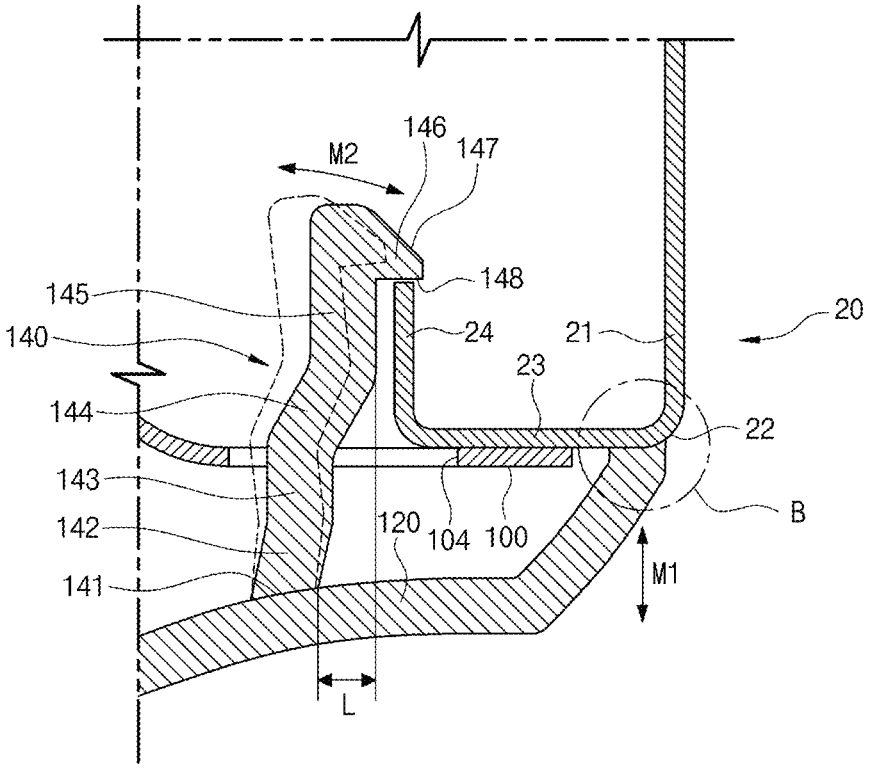
[Fig. 8]
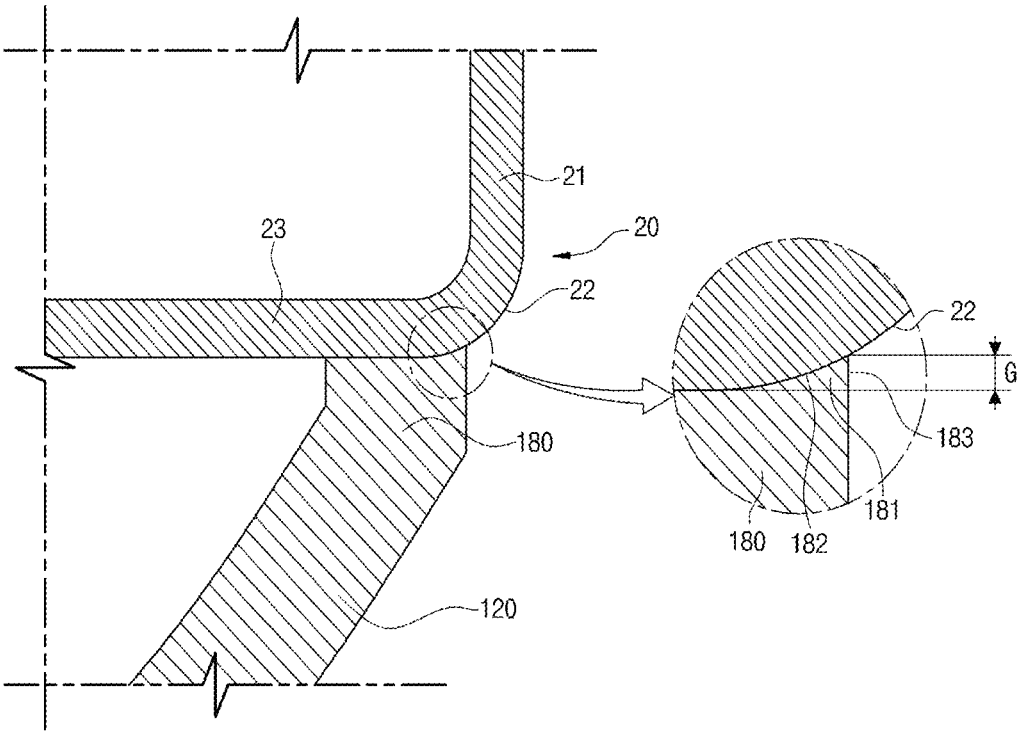

[Fig. 9]
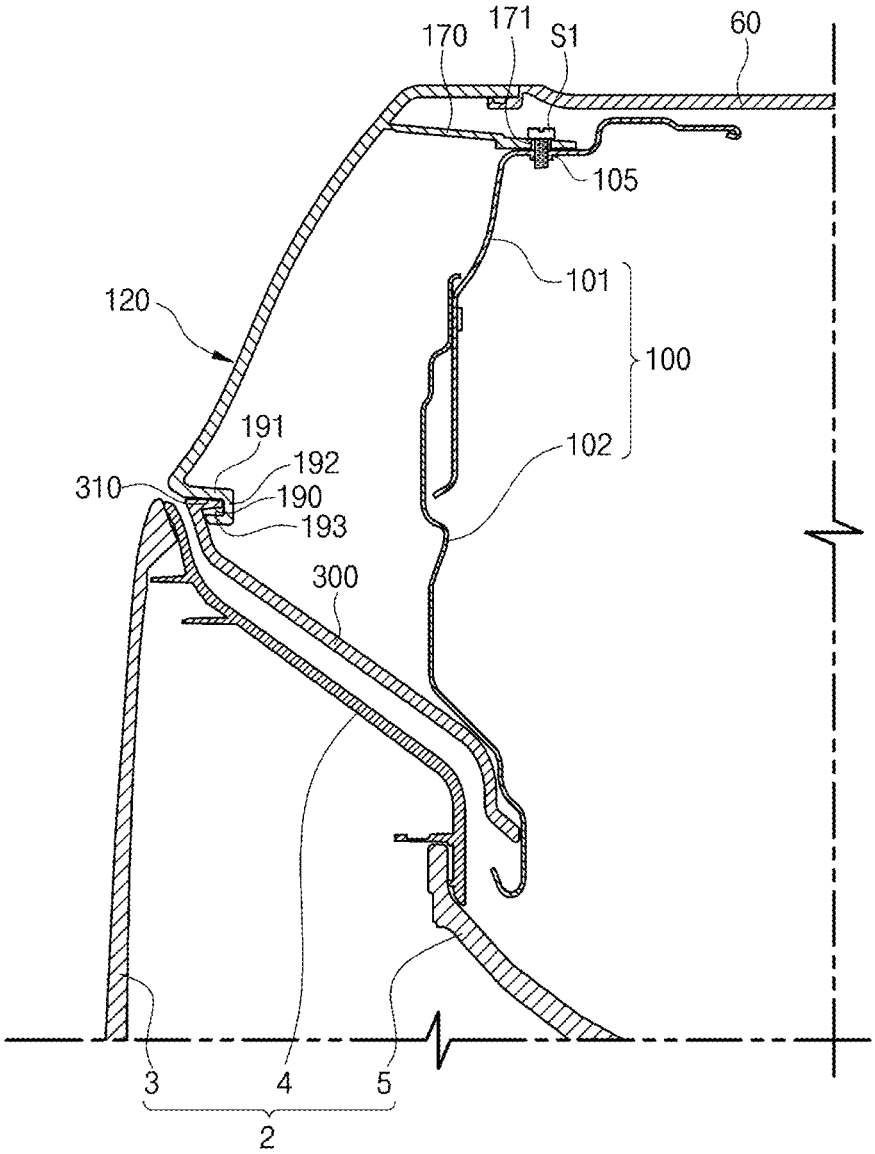

[Fig. 10]
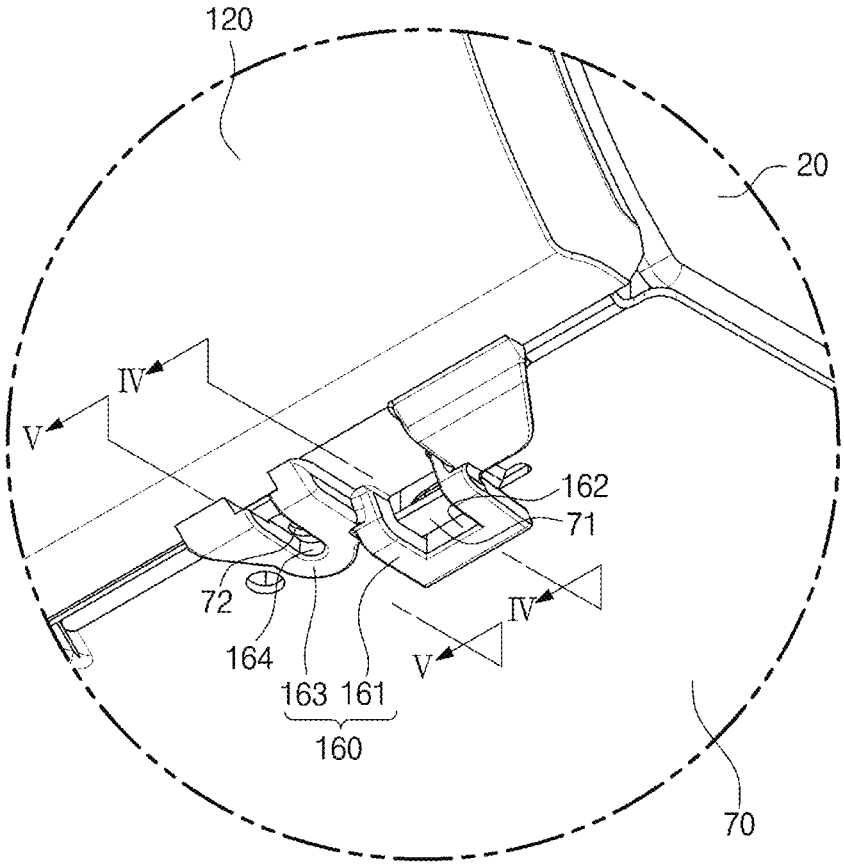
[Fig. 11]
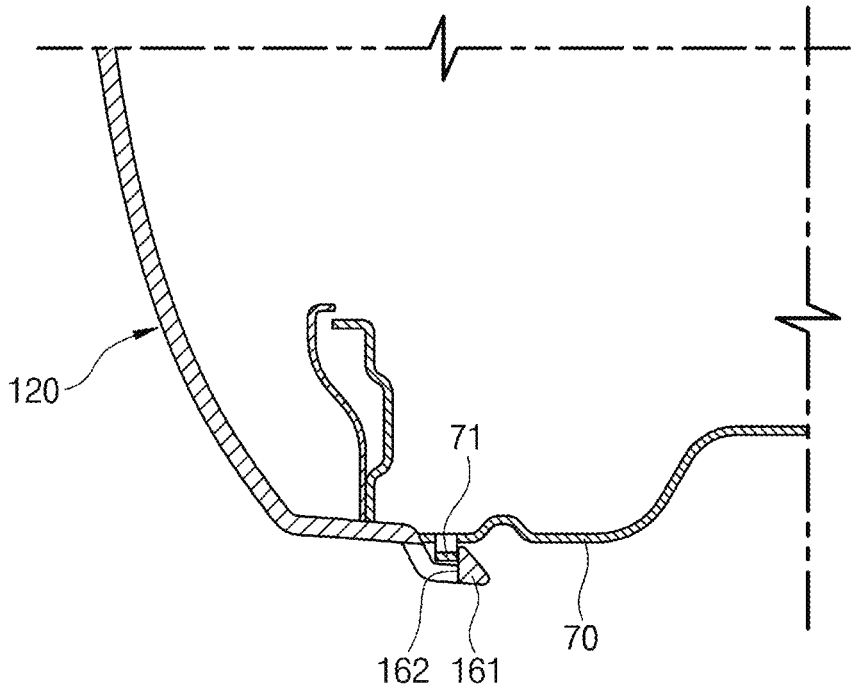

[Fig. 12]
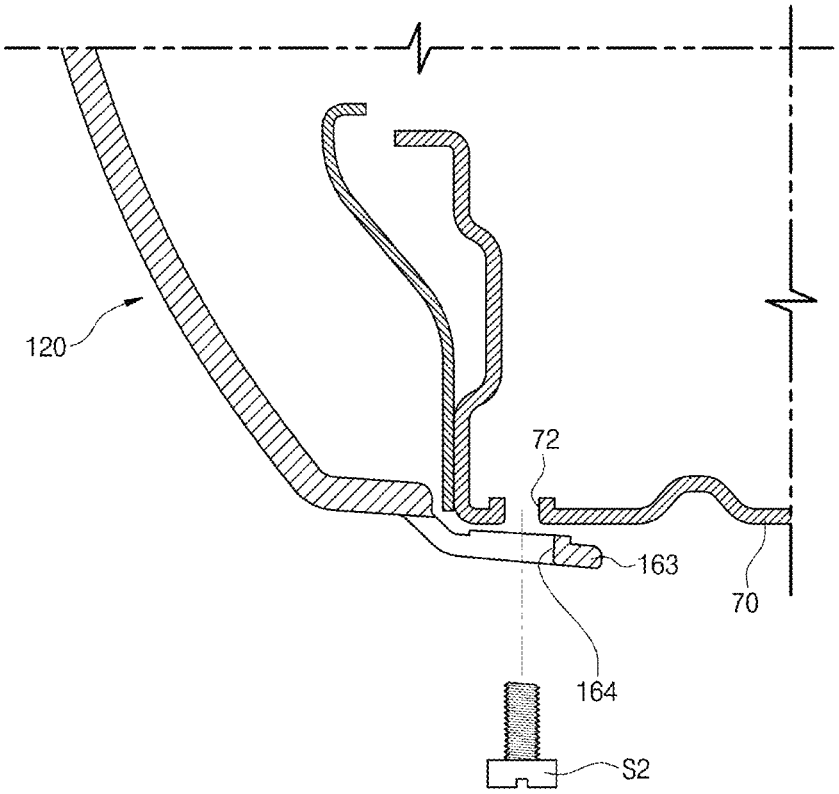

[Fig. 13]
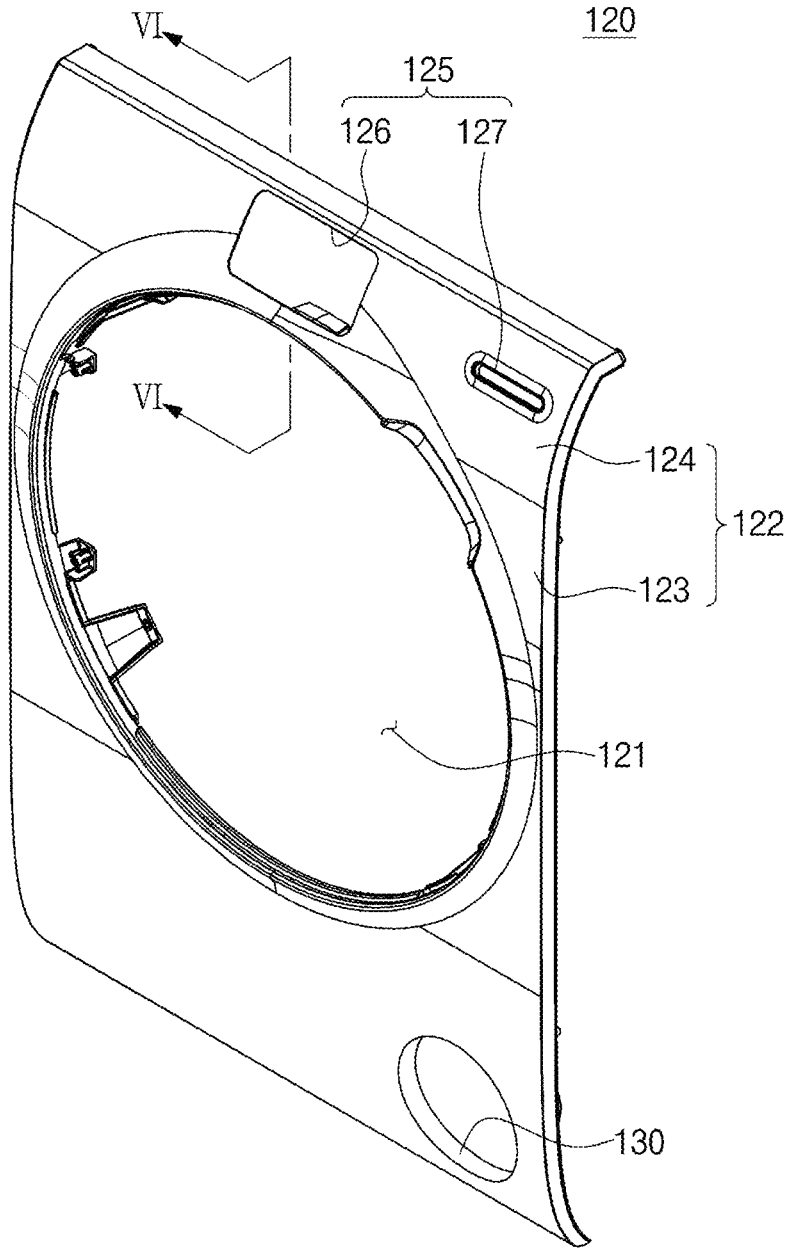

[Fig. 14]
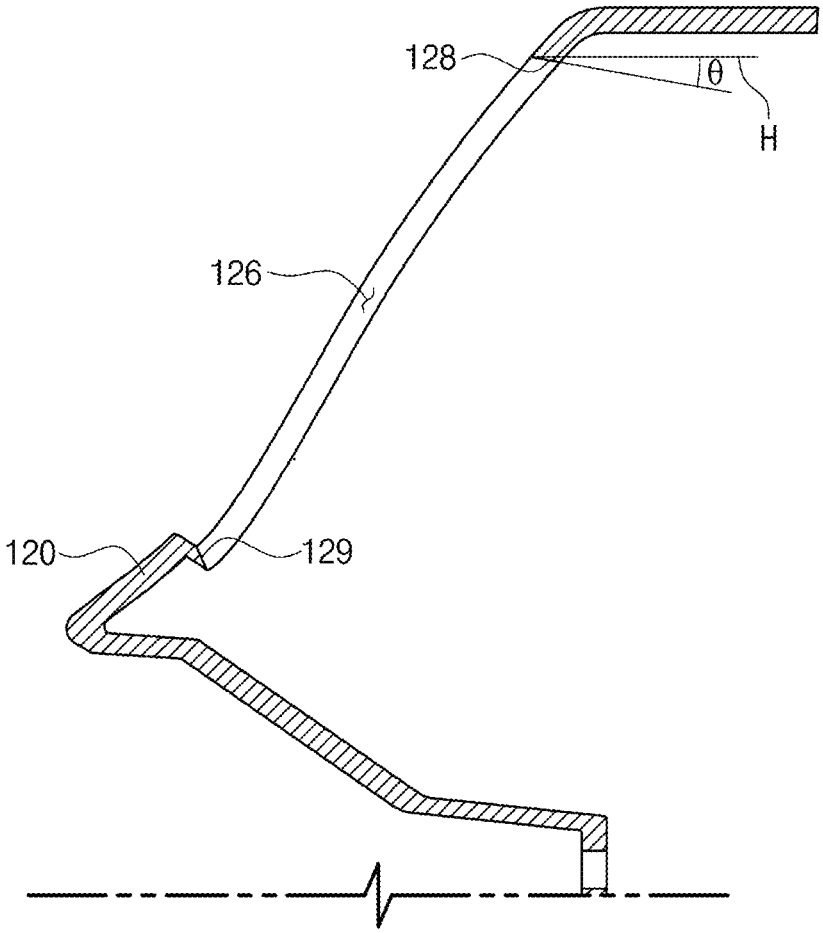

[Fig. 15]
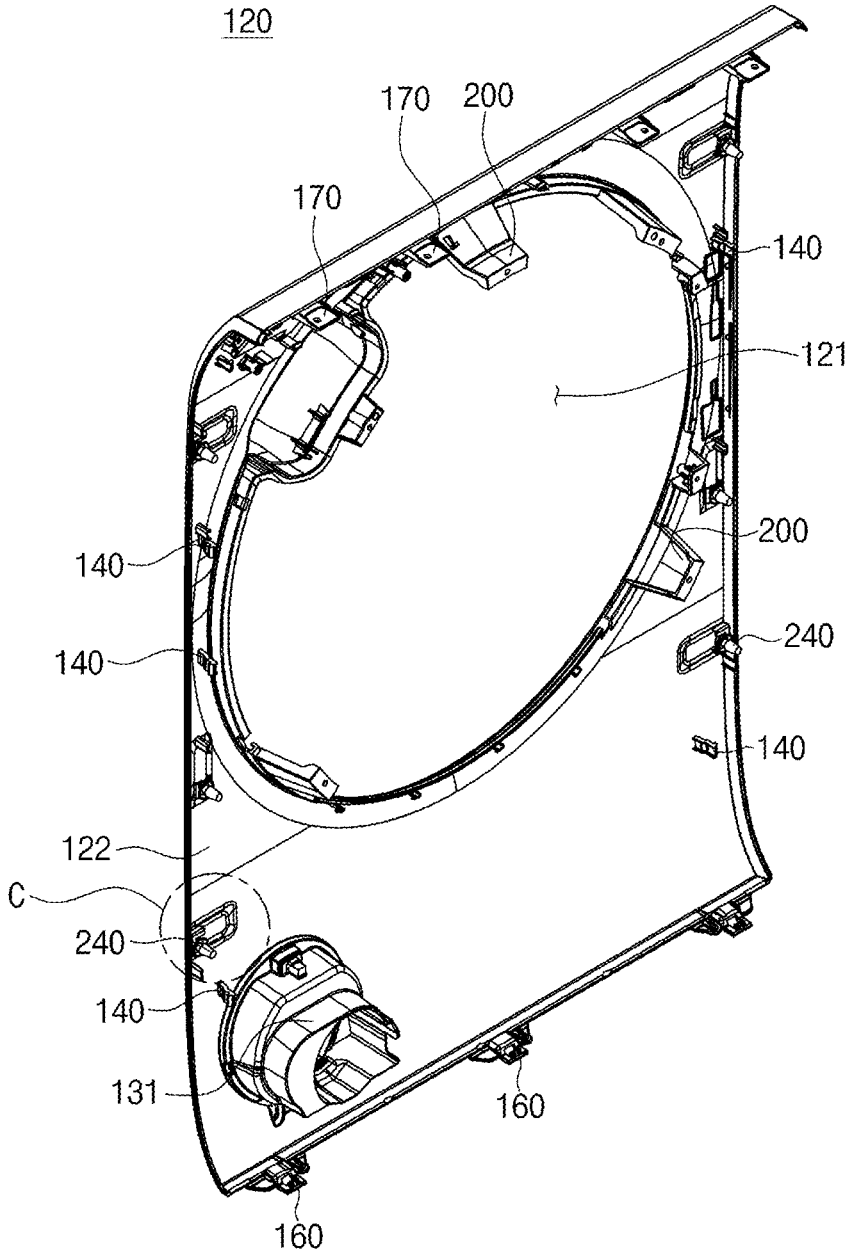

[Fig. 16]
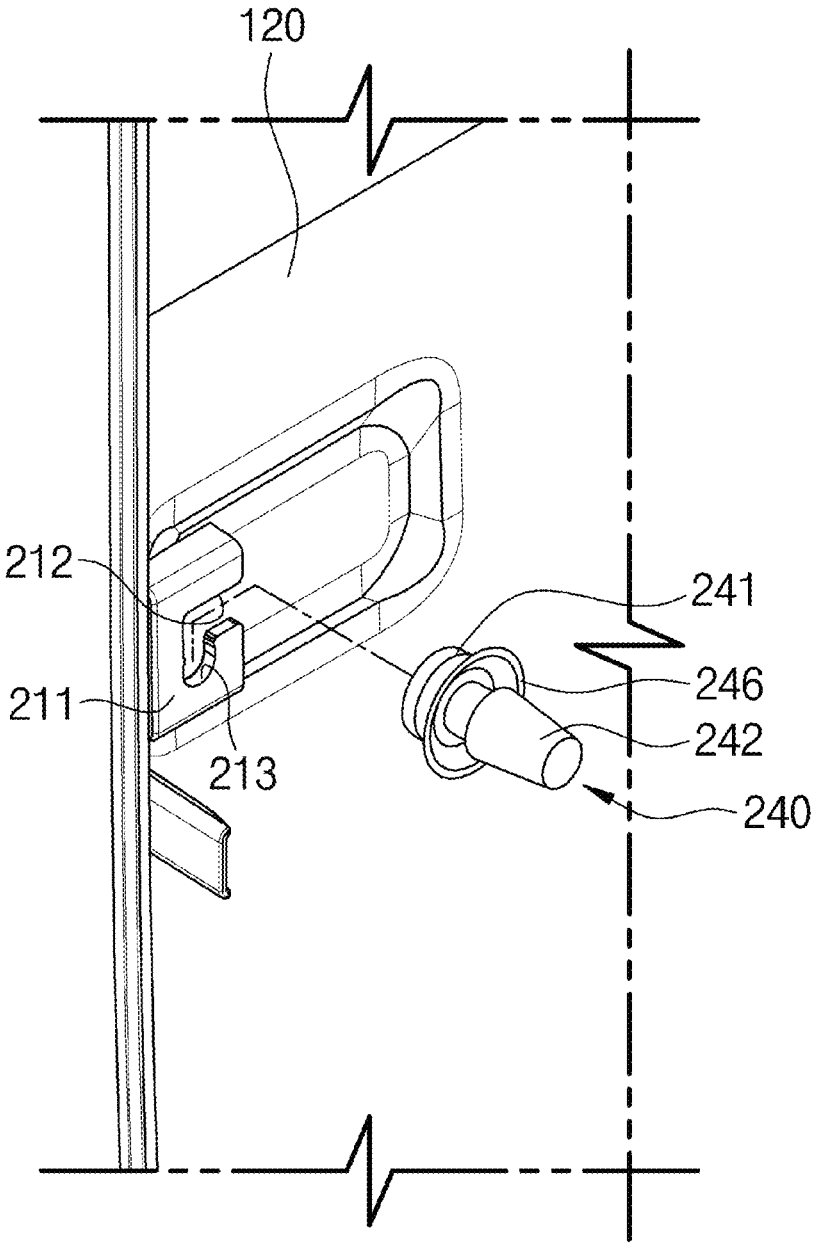

[Fig. 17]
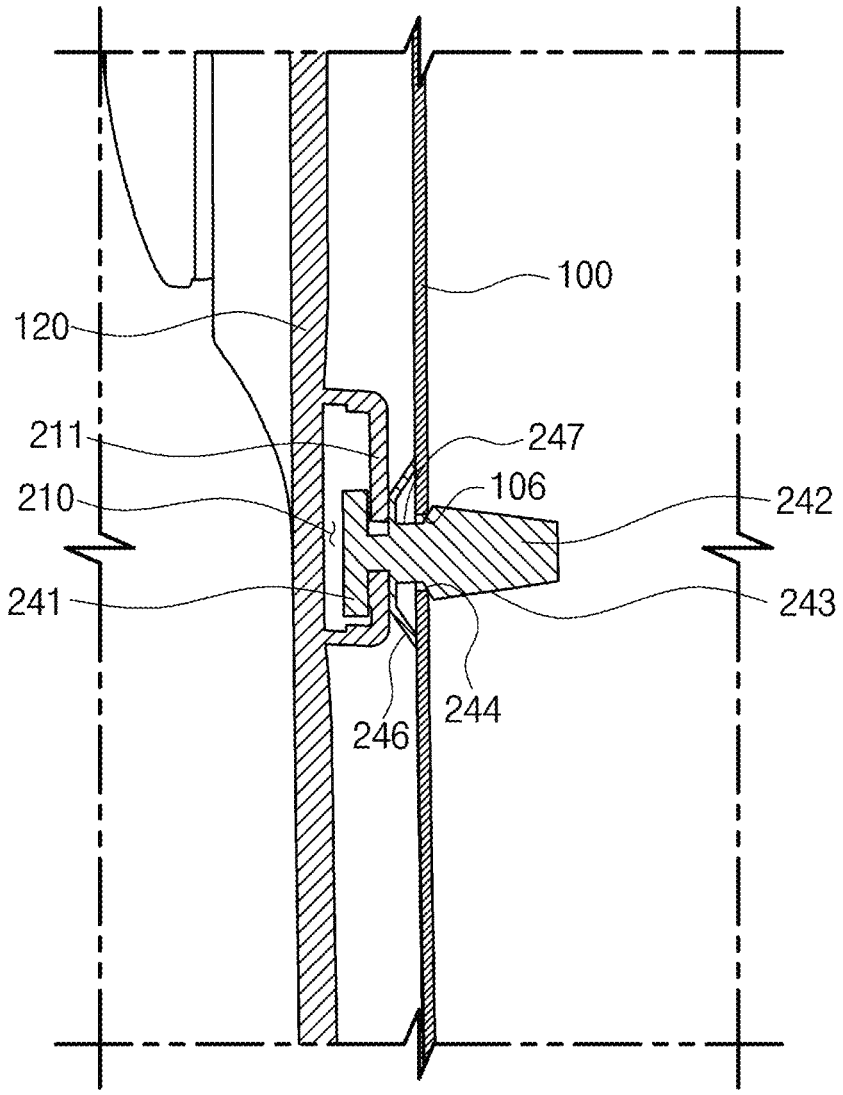

[Fig. 18]
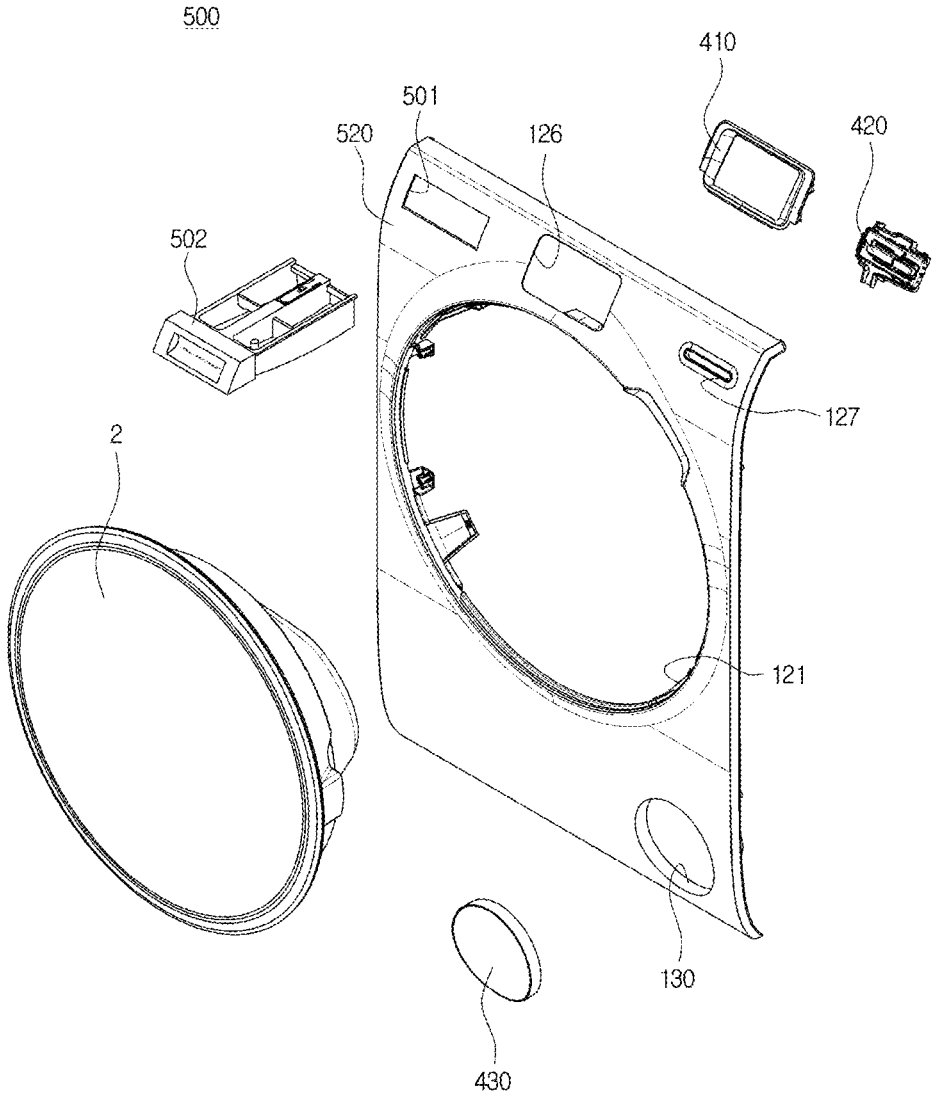

[Fig. 19]
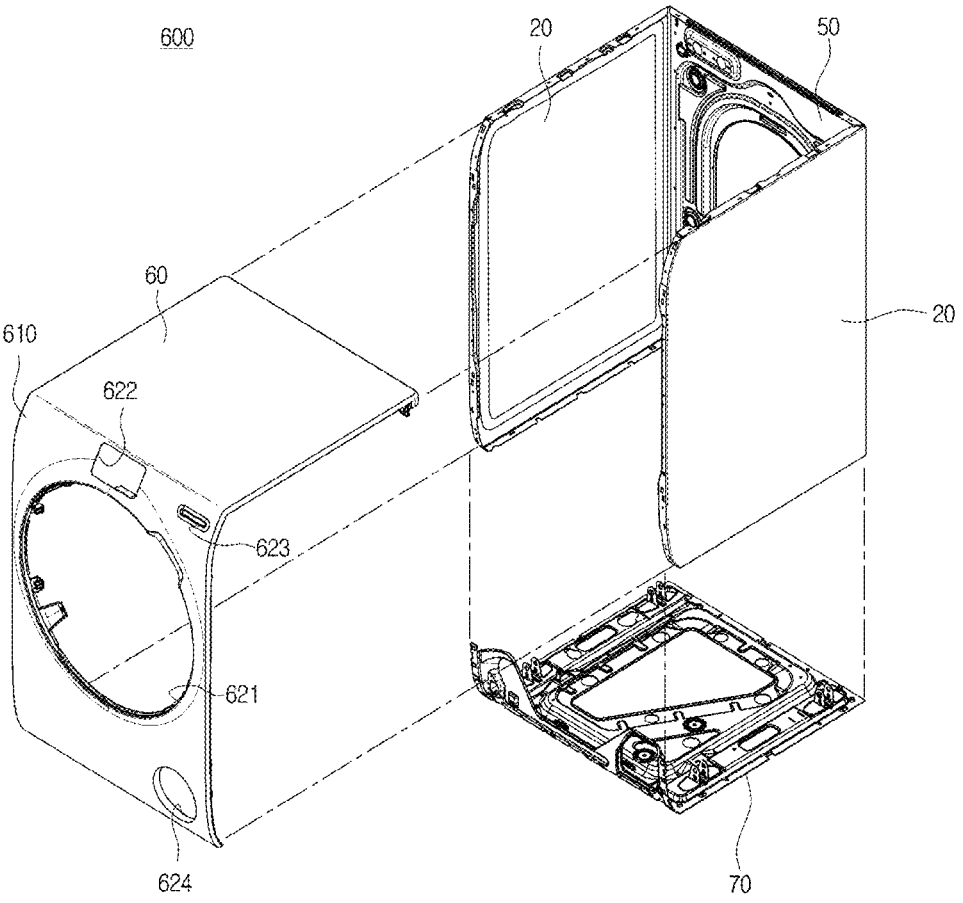

[Fig. 20]
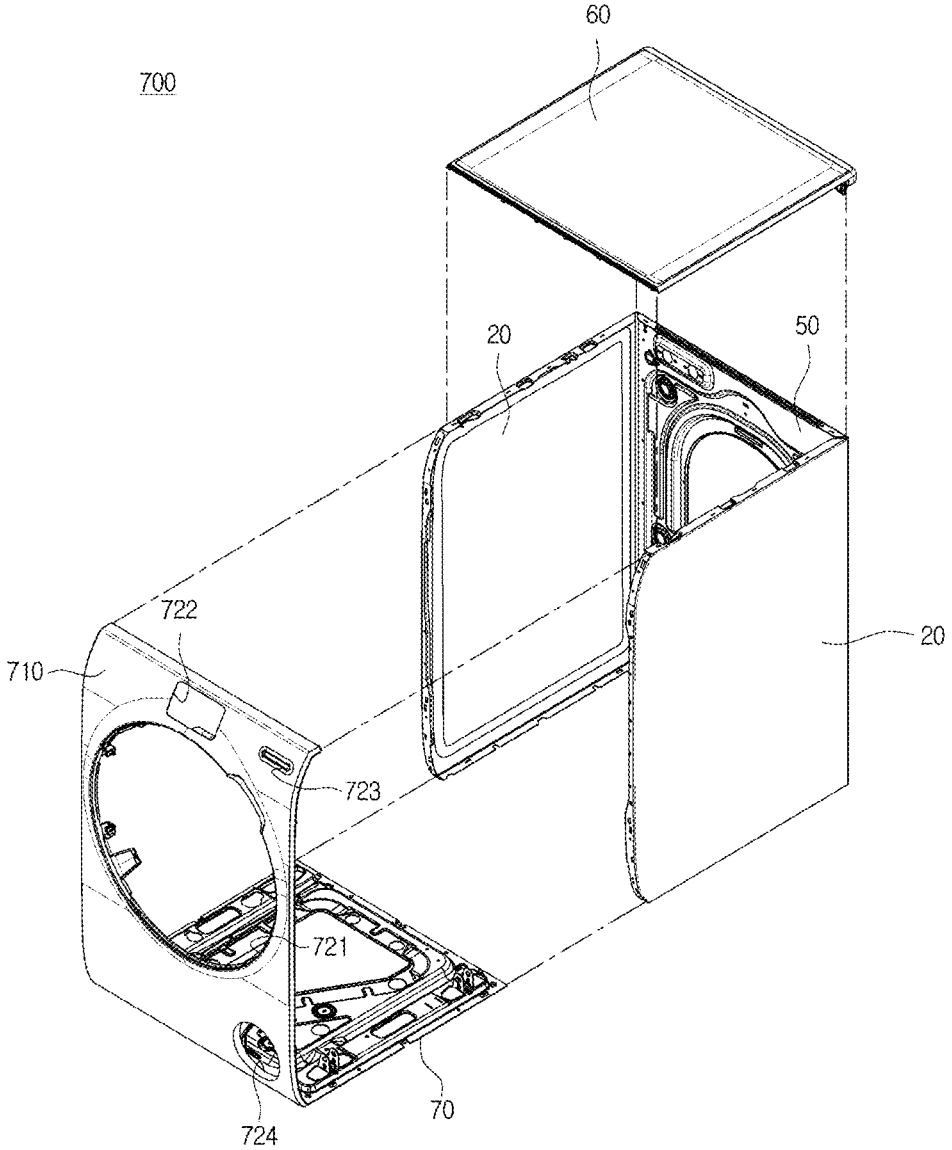

[Fig. 21]
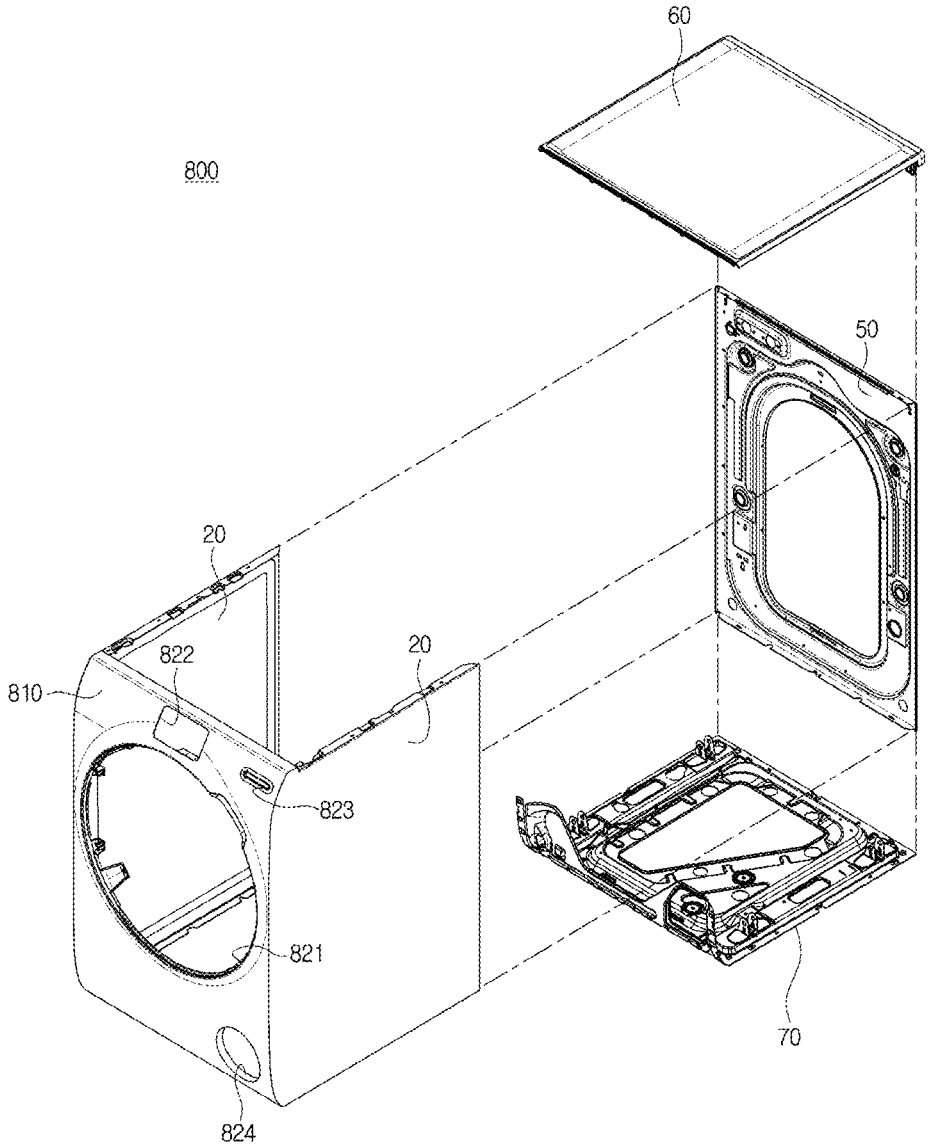

[Fig. 22]
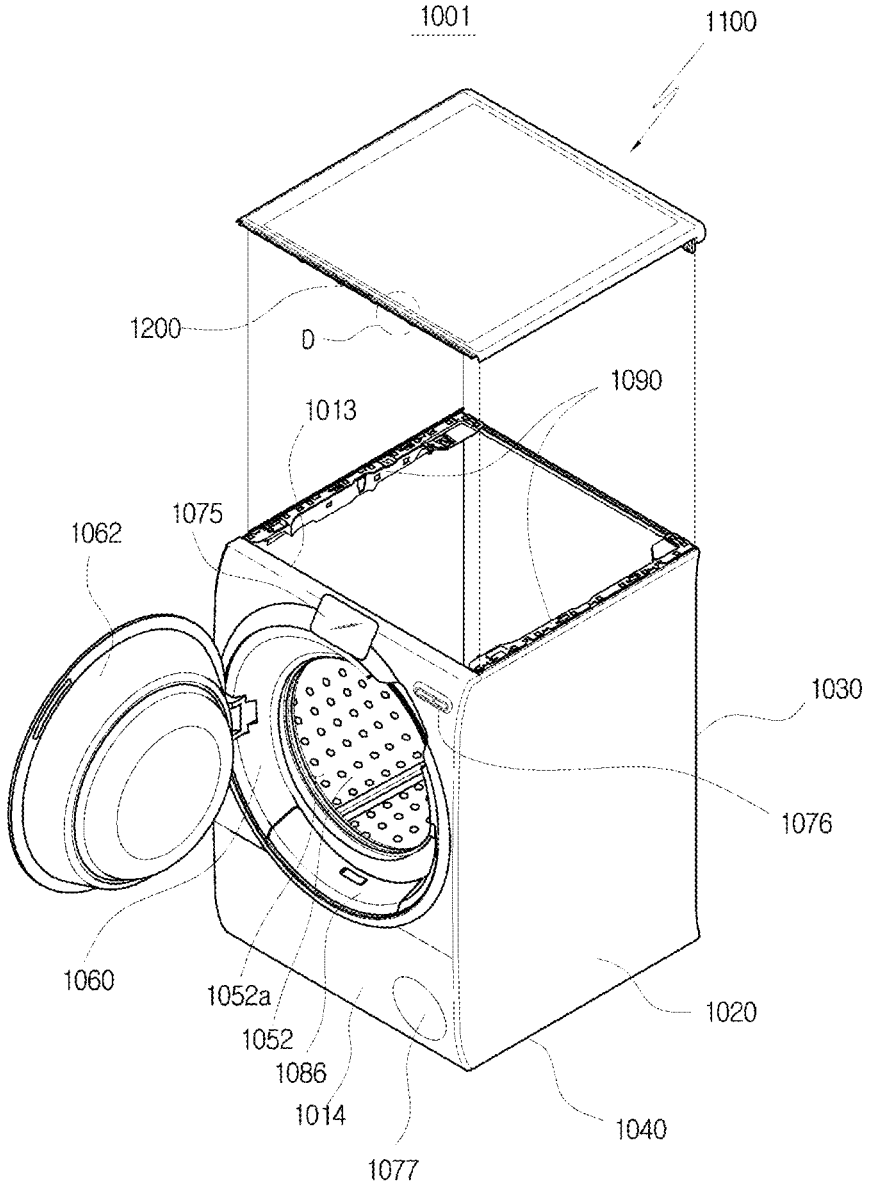

[Fig. 23]
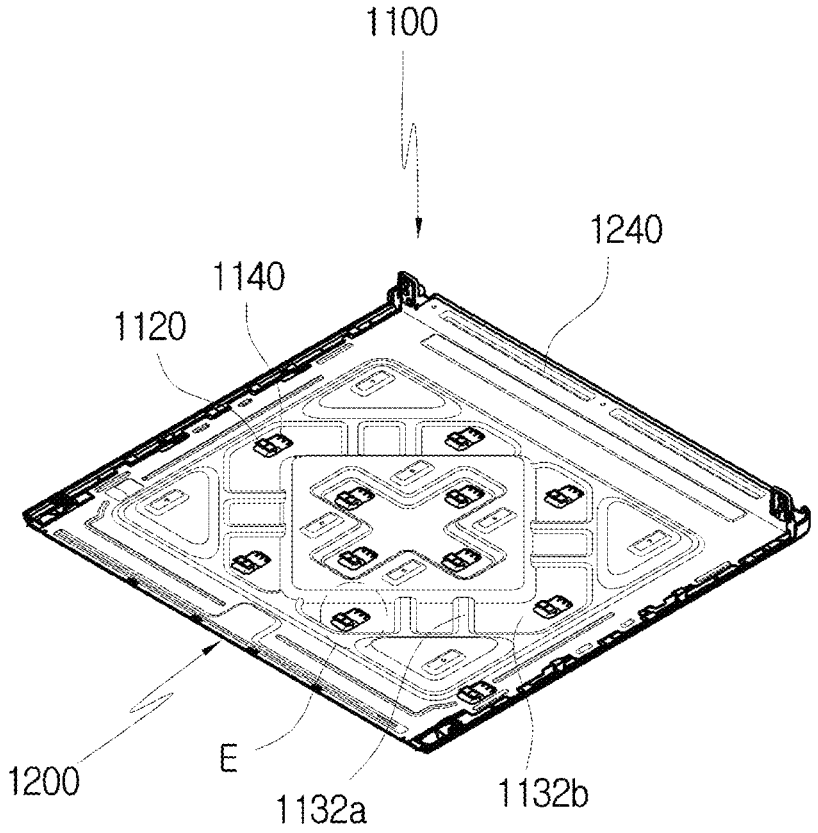

[Fig. 26]
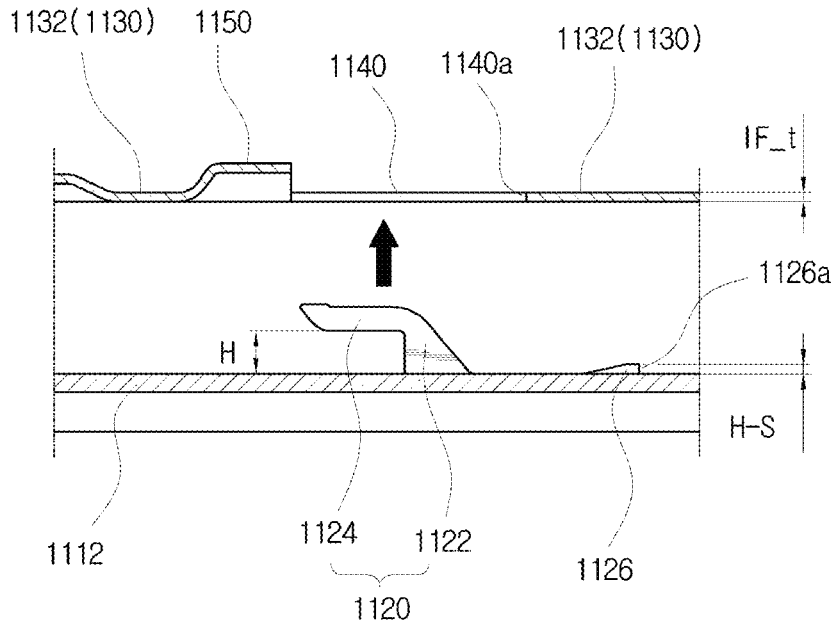
[Fig. 27]
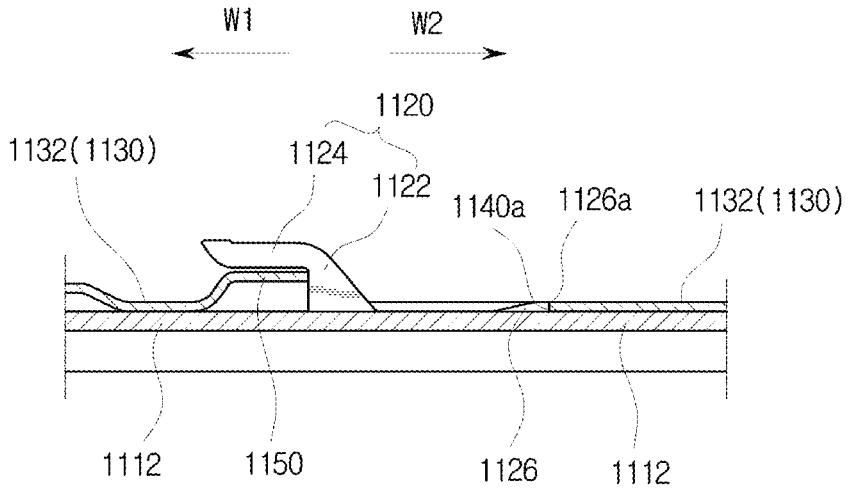

[Fig. 28]
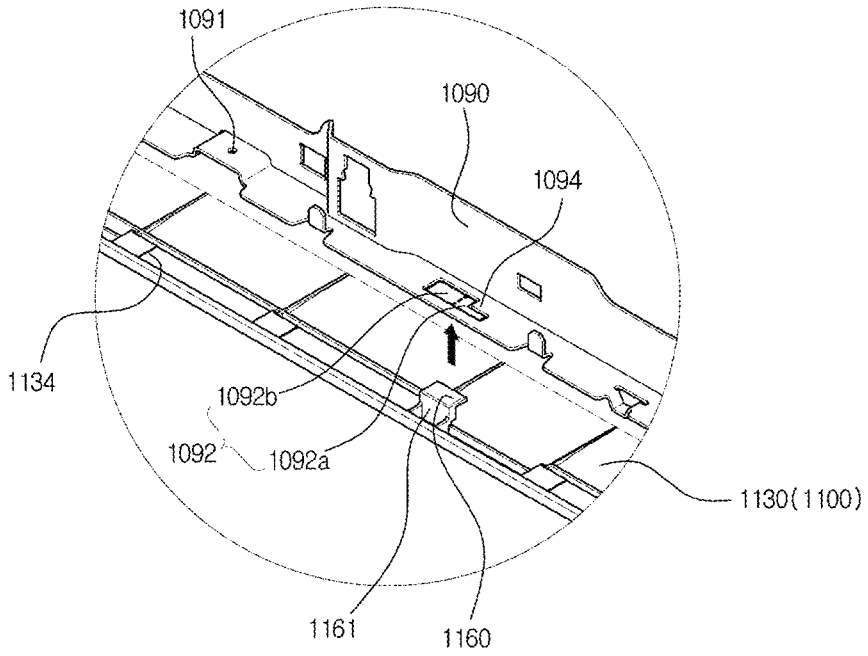
[Fig. 29]
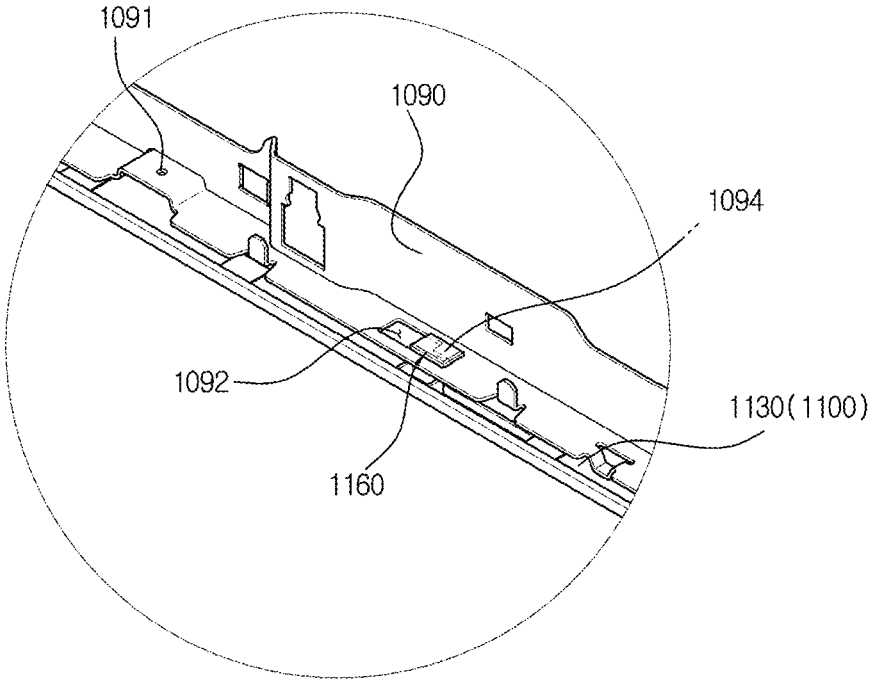

[Fig. 30]
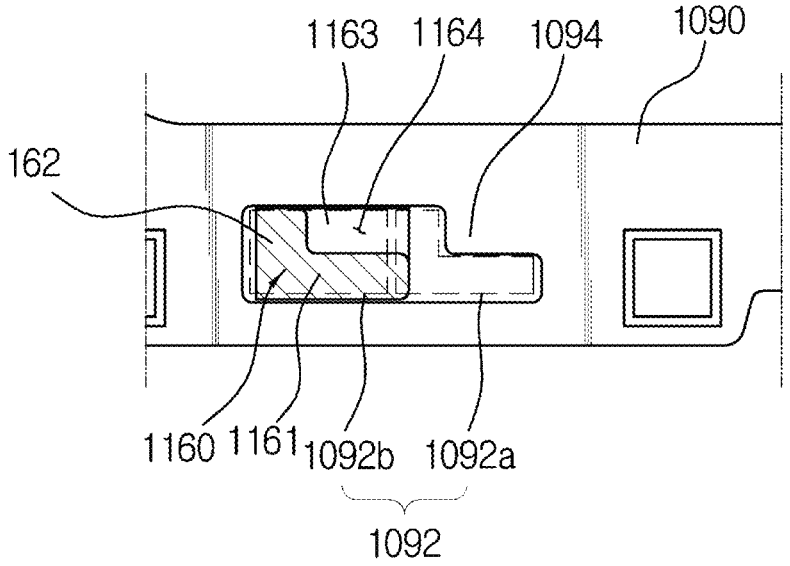
[Fig. 31]
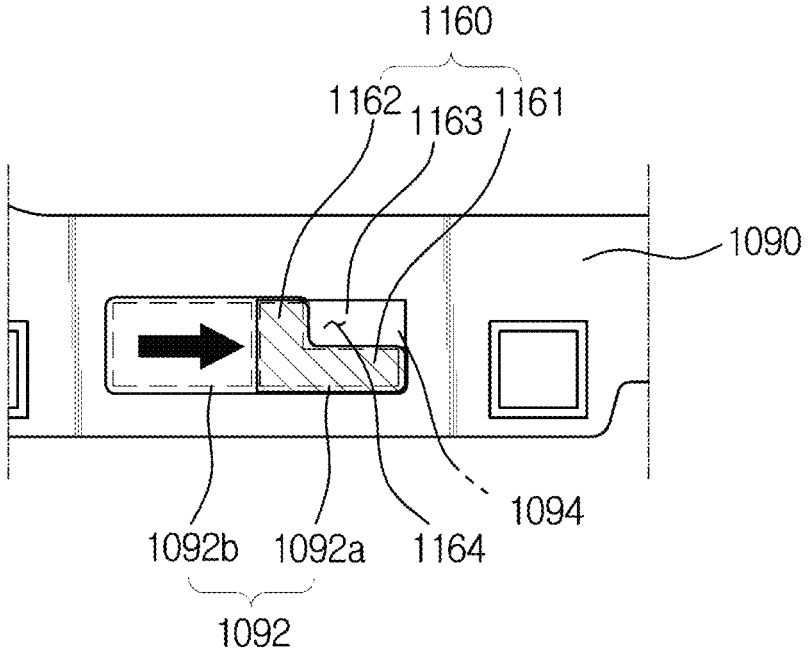

[Fig. 32]
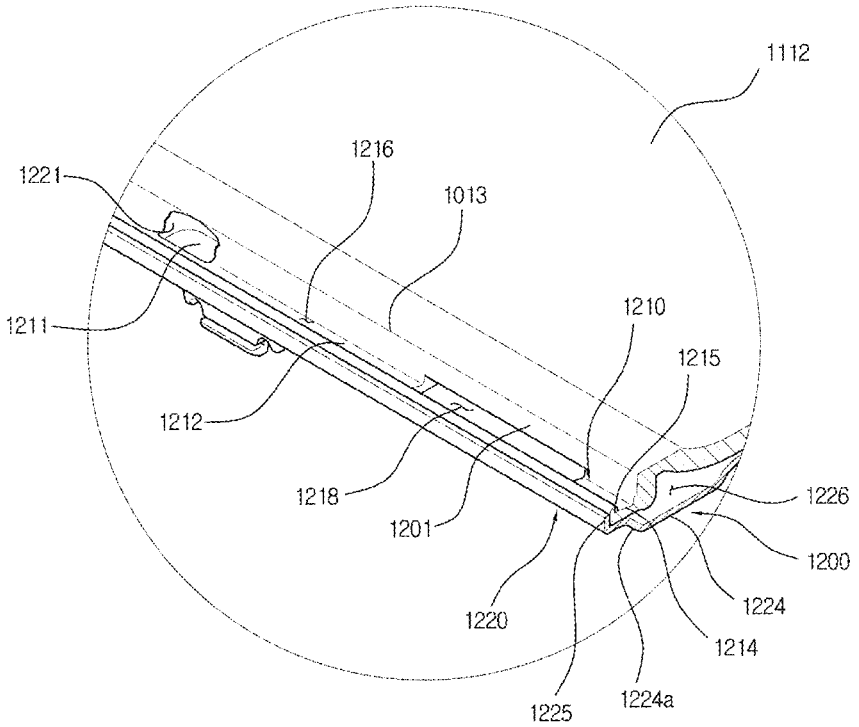
[Fig. 33]
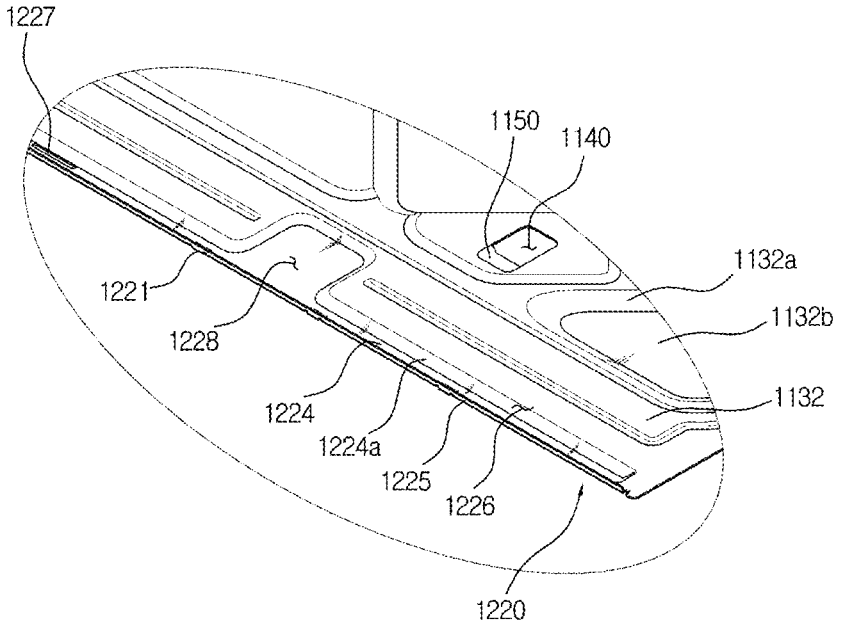

[Fig. 34]
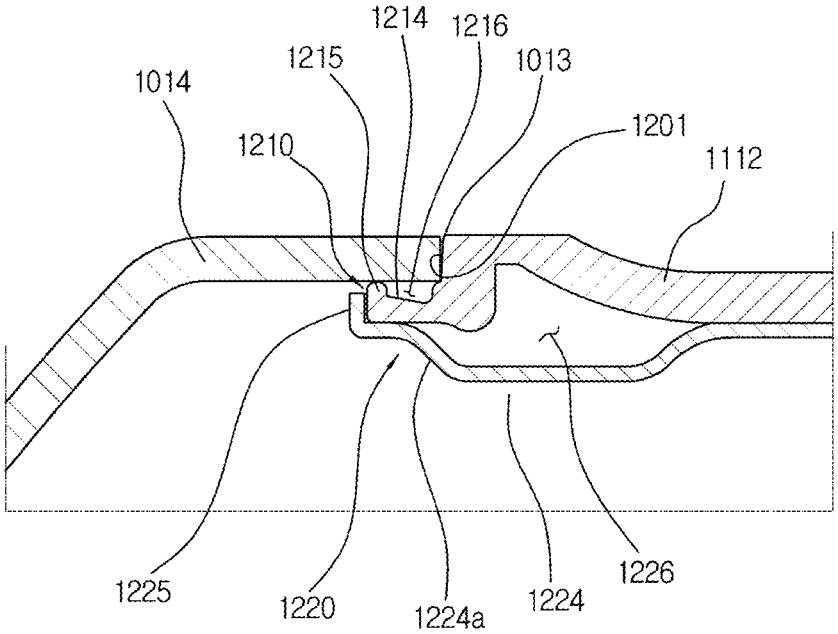
[Fig. 35]
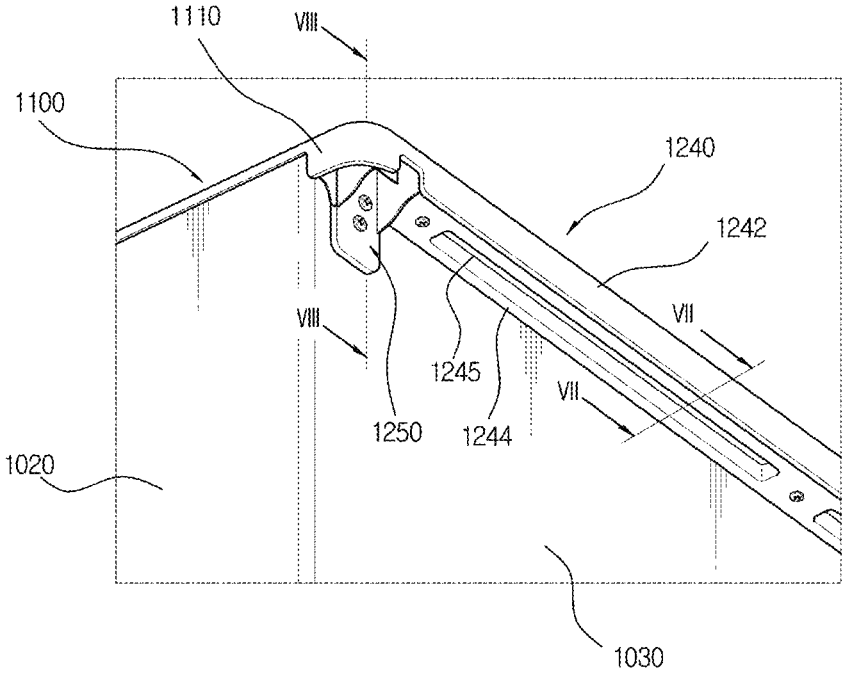

[Fig. 36]
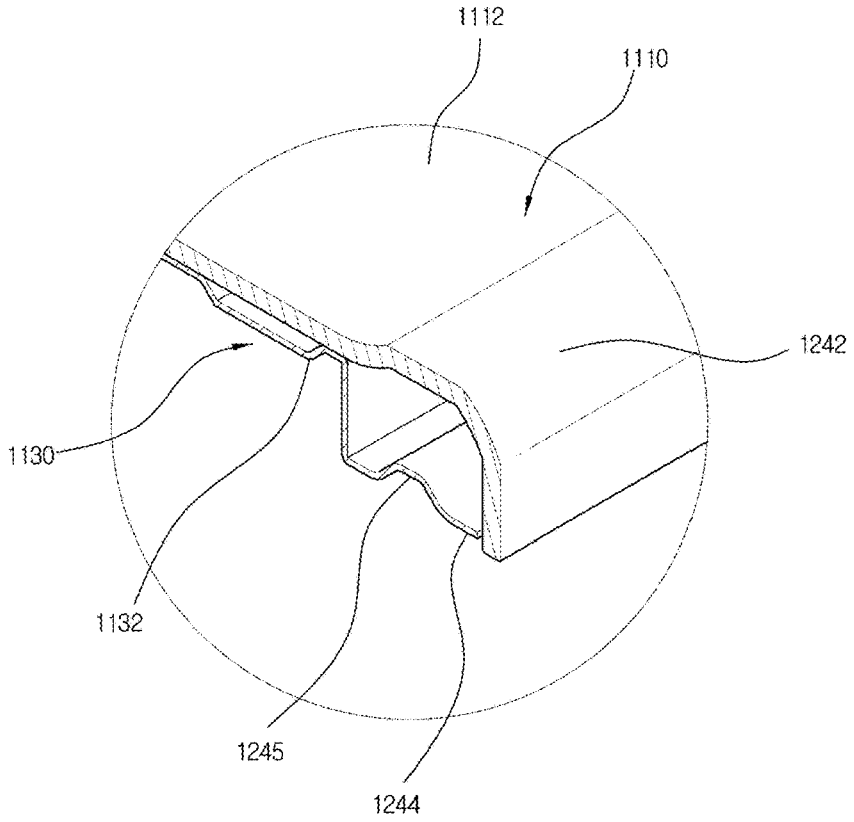
[Fig. 37]
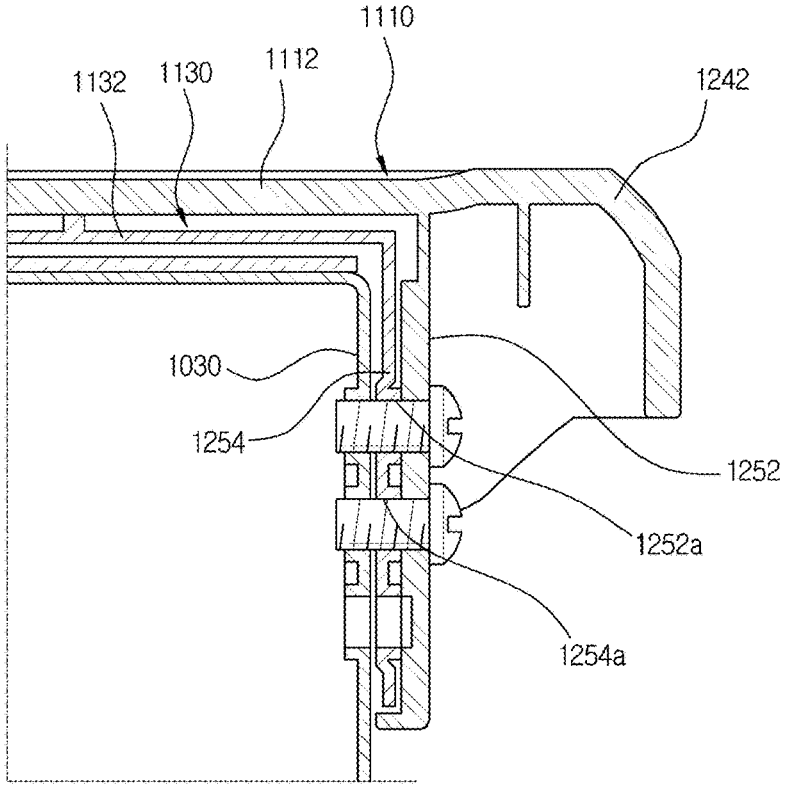

[Fig. 38]
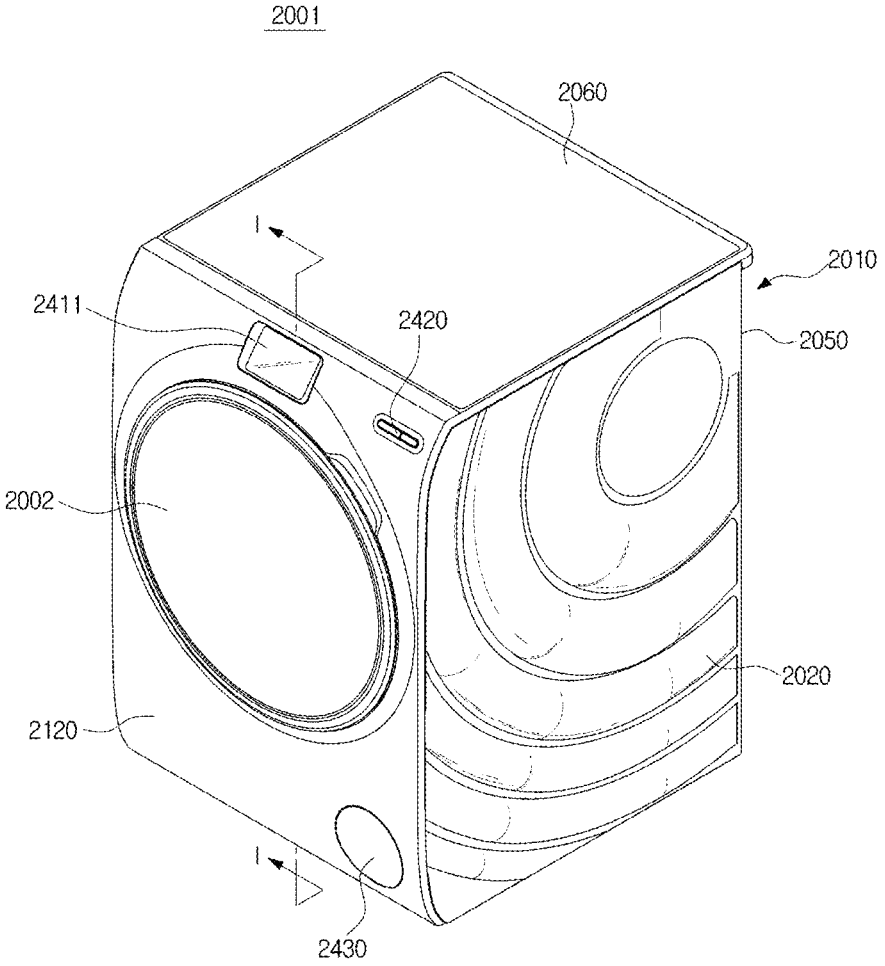

[Fig. 39]
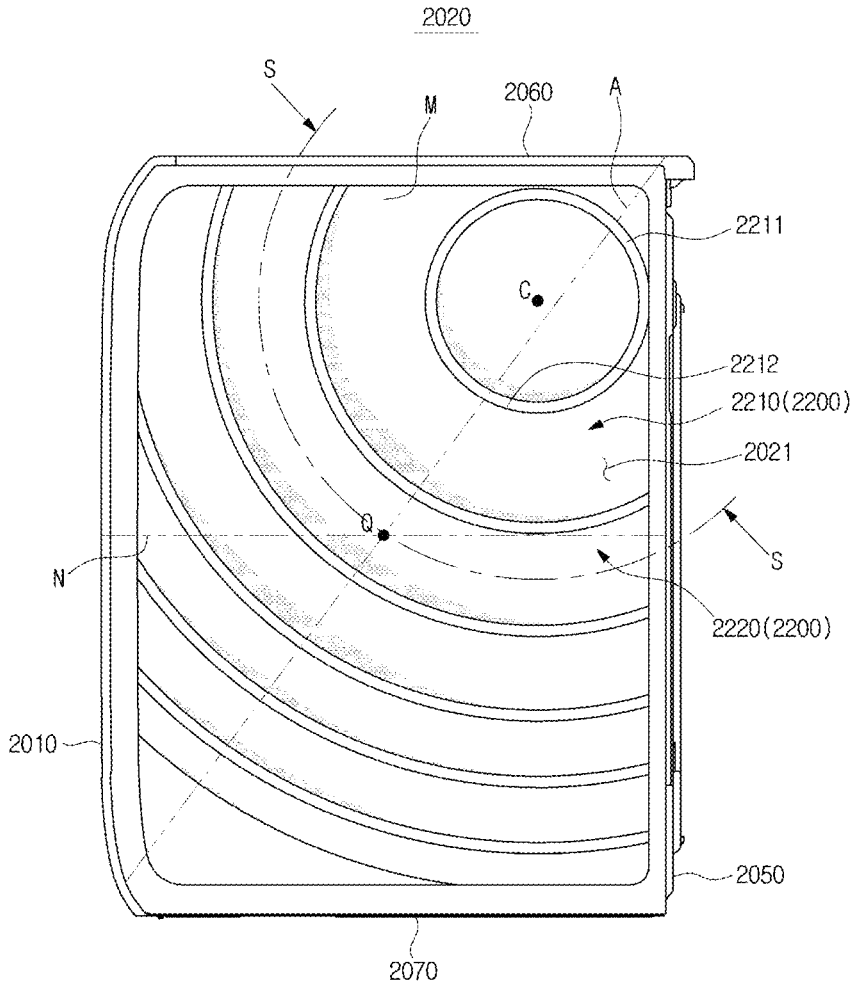
[Fig. 40]
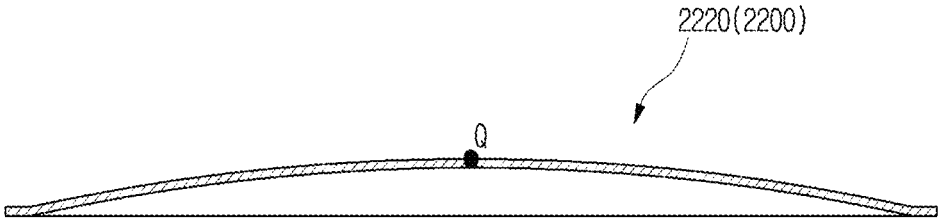

[Fig. 41]
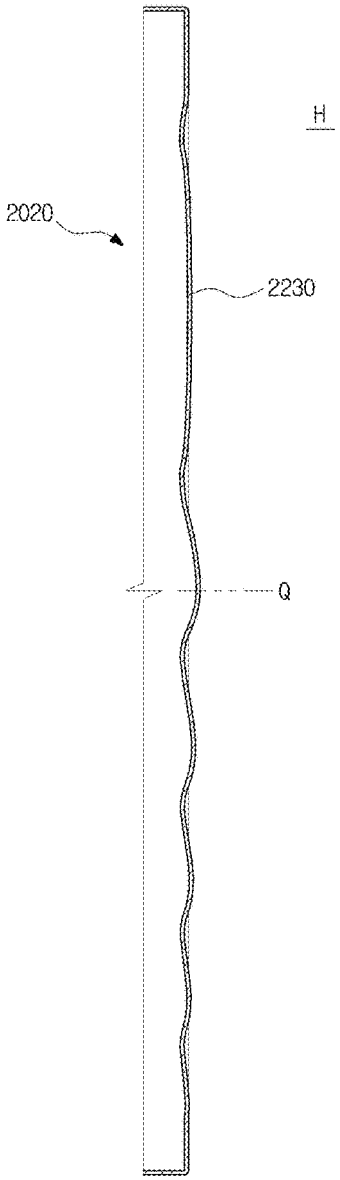
[Fig. 42]
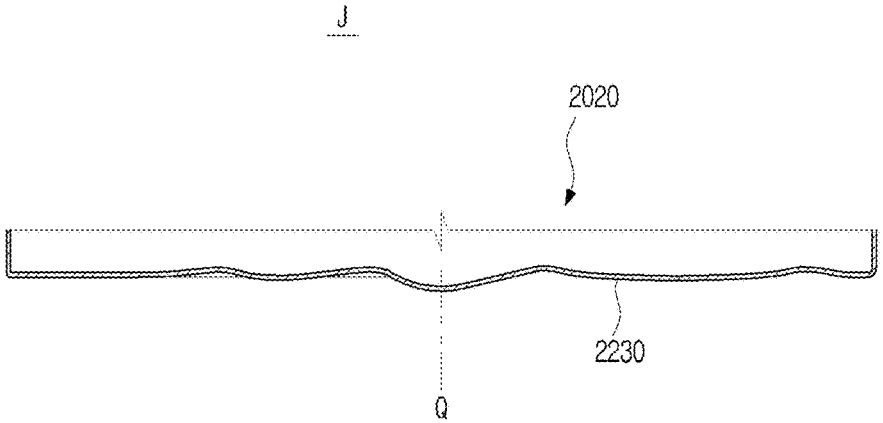

[Fig. 43]
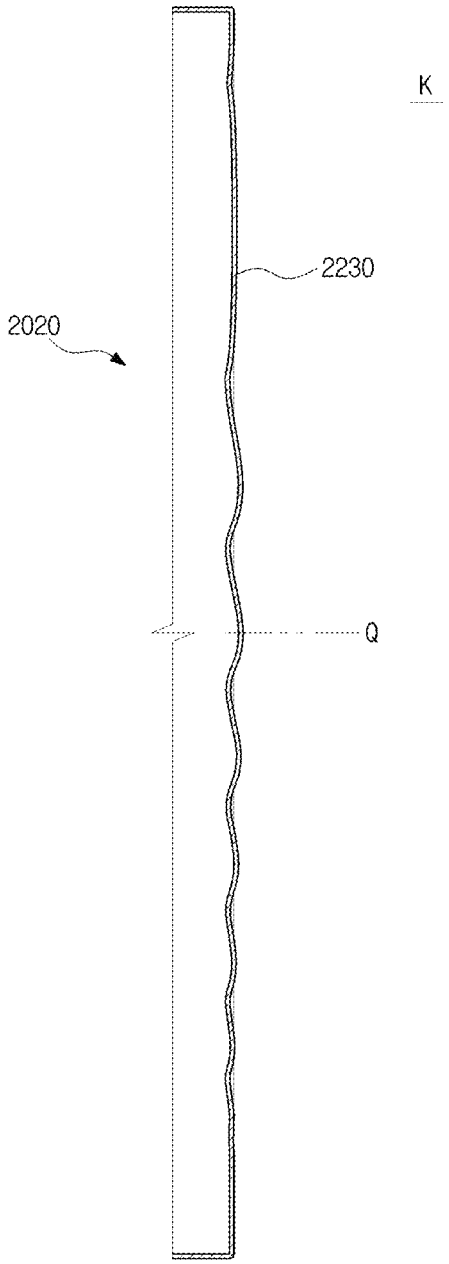

[Fig. 44]
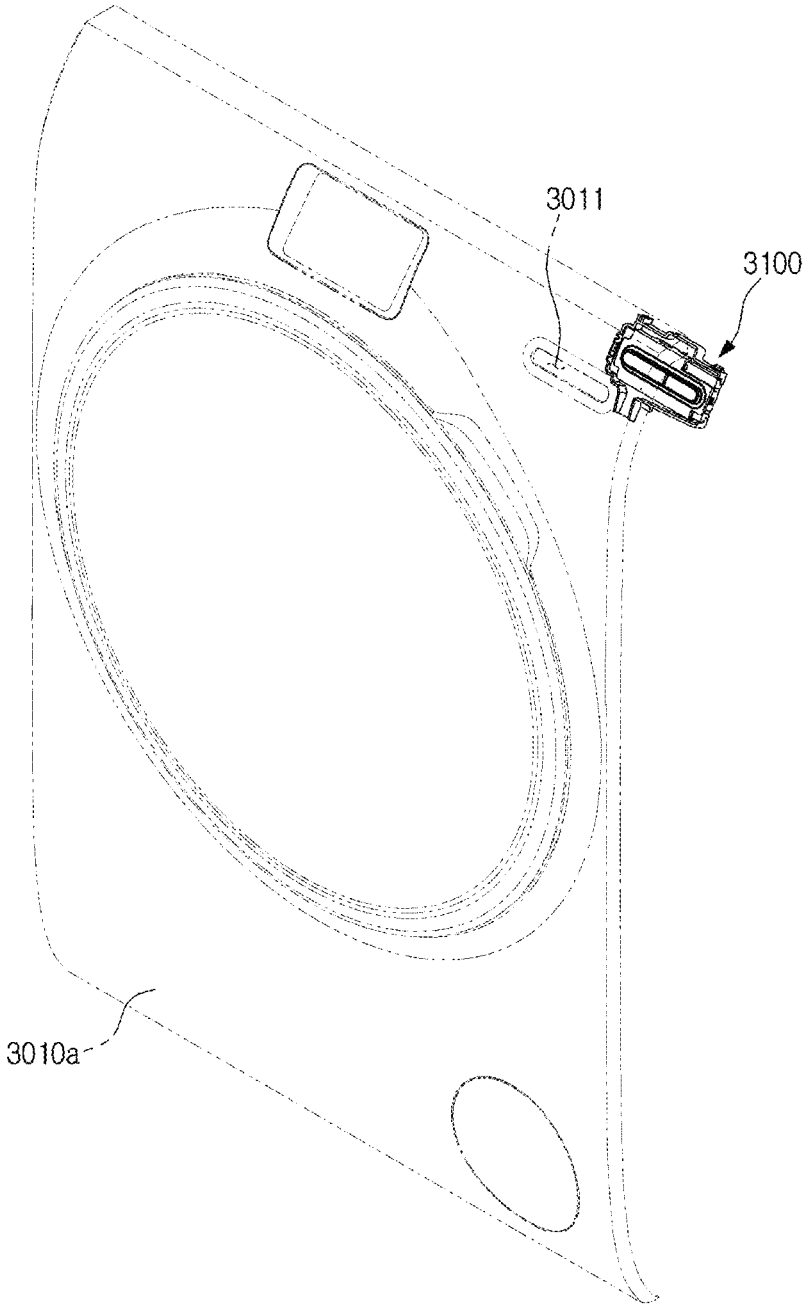

[Fig. 45]
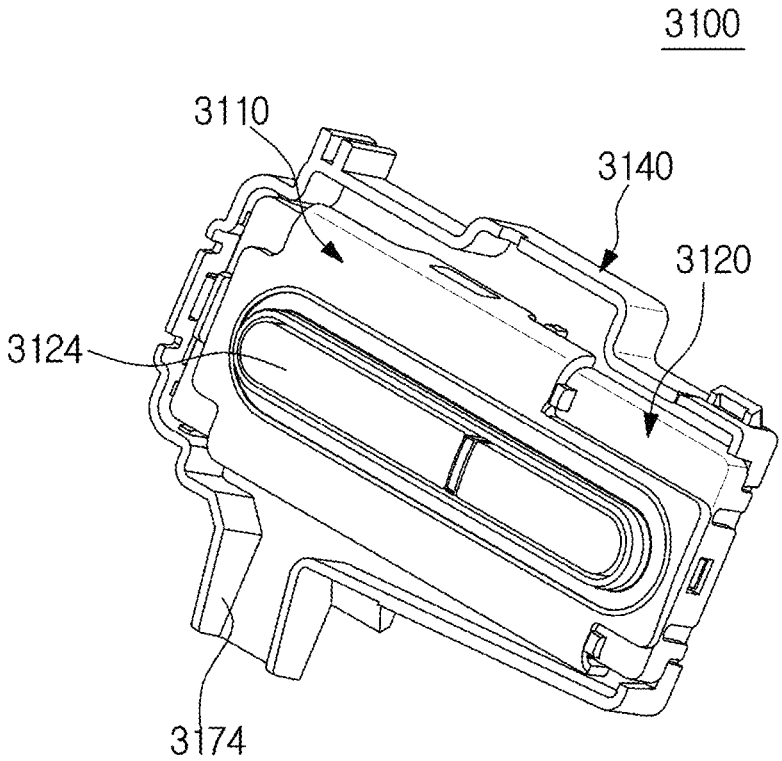
[Fig. 46]
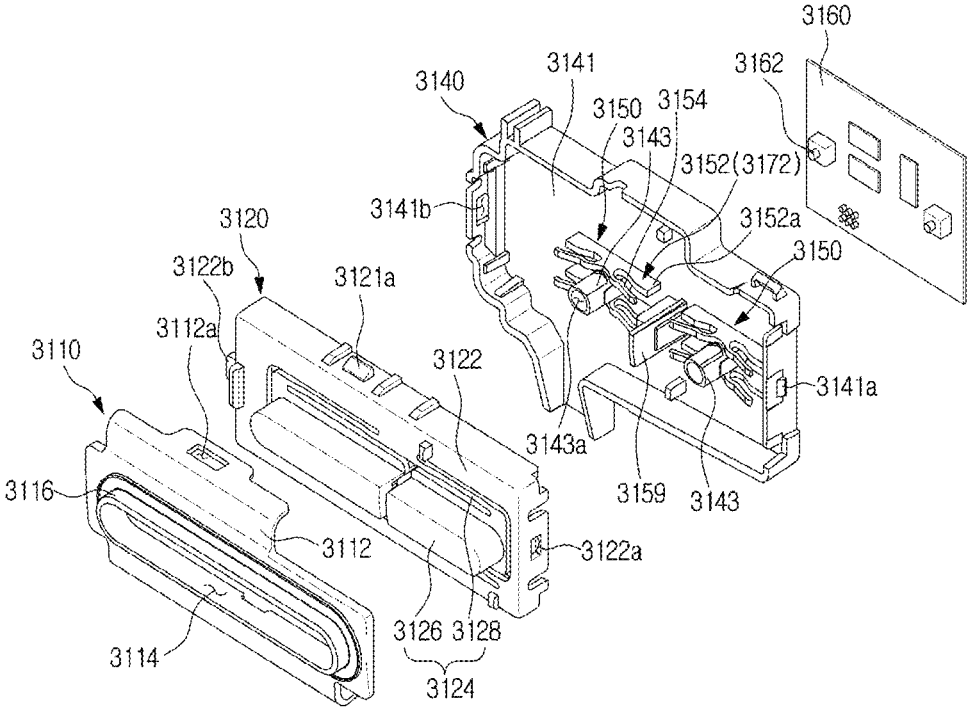

[Fig. 47]
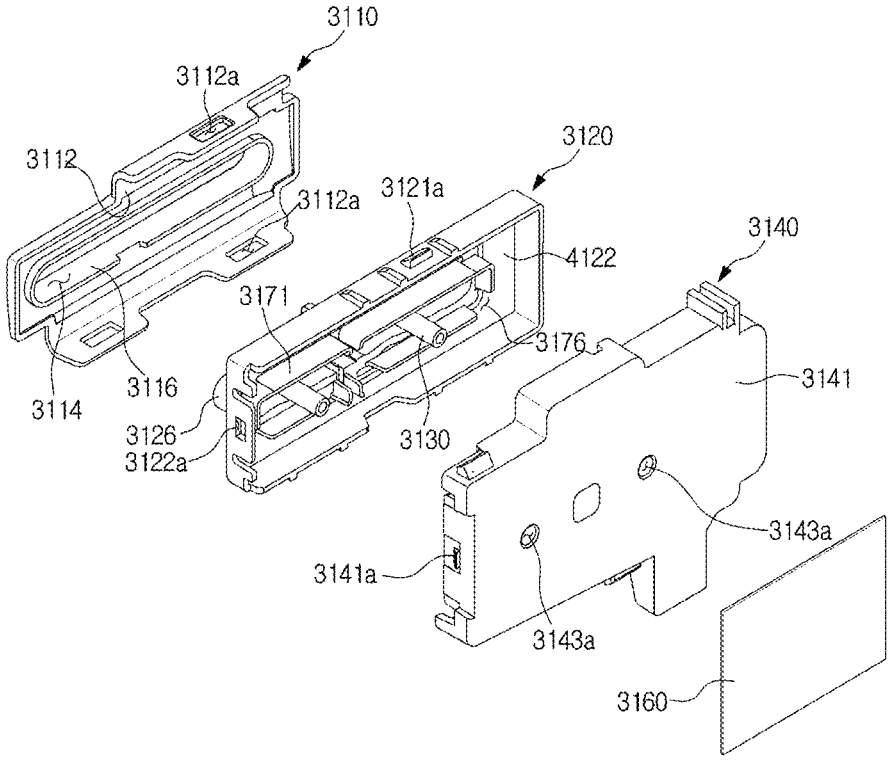
[Fig. 48]
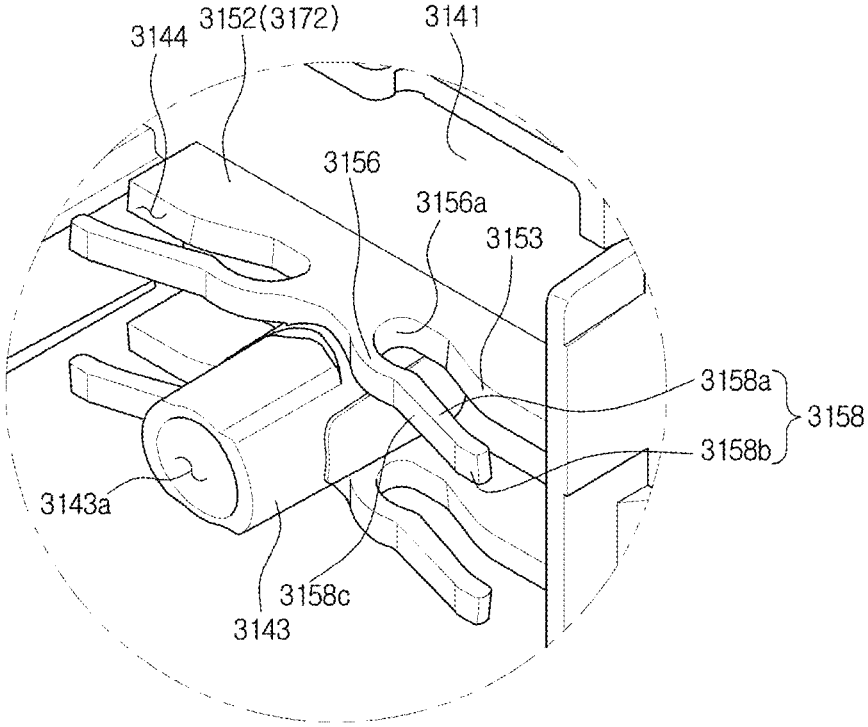

[Fig. 49]
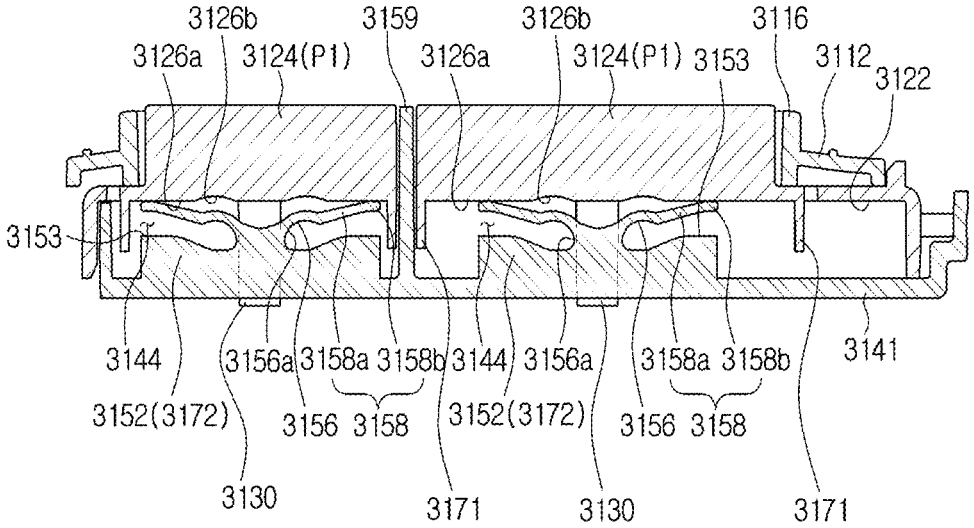
[Fig. 50]
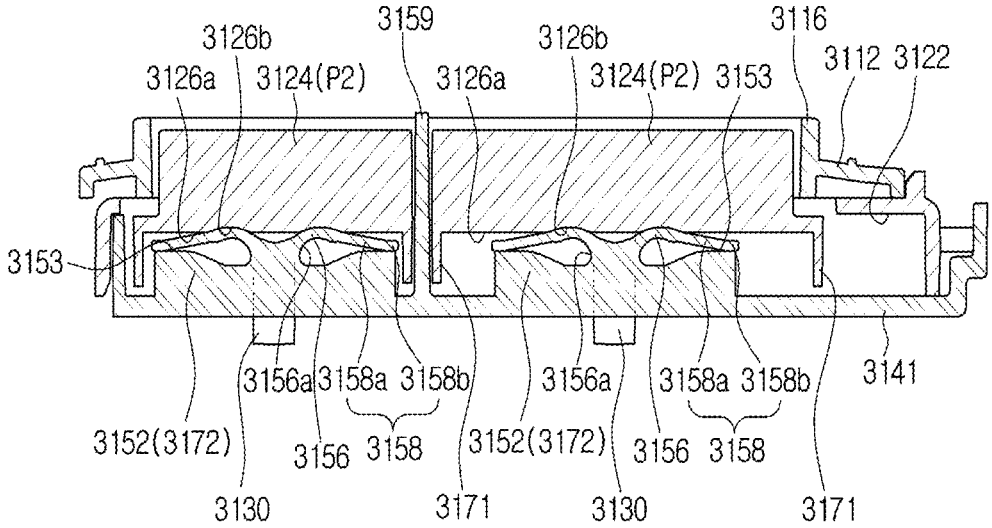

[Fig. 51]
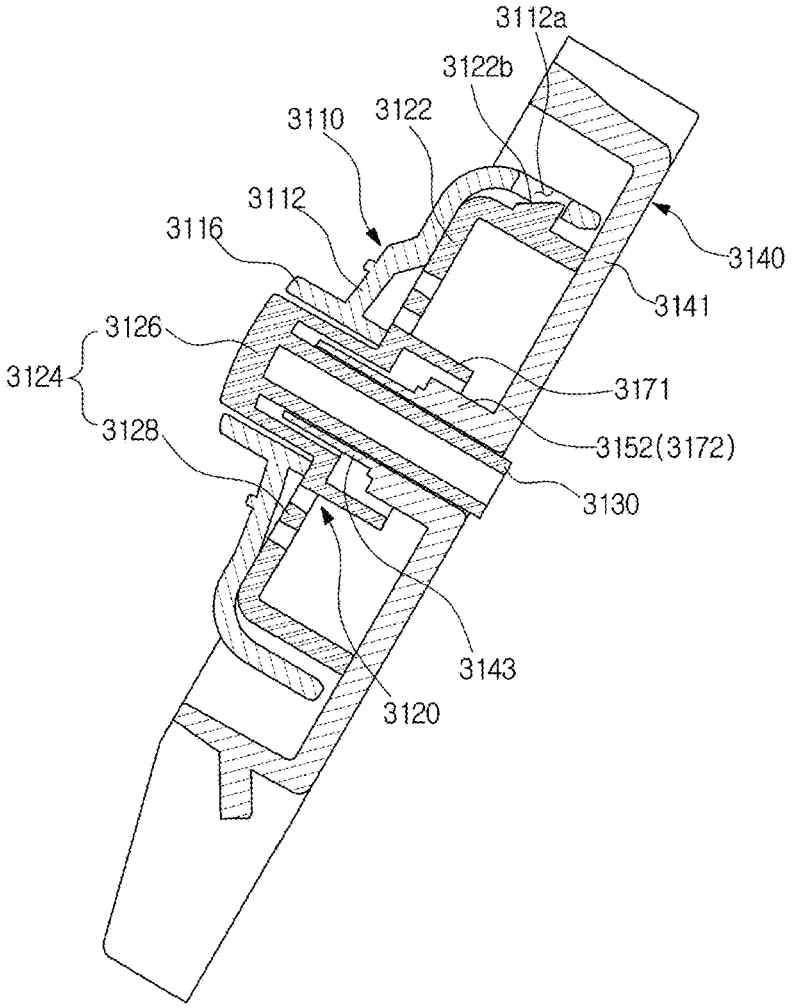
[Fig. 52]
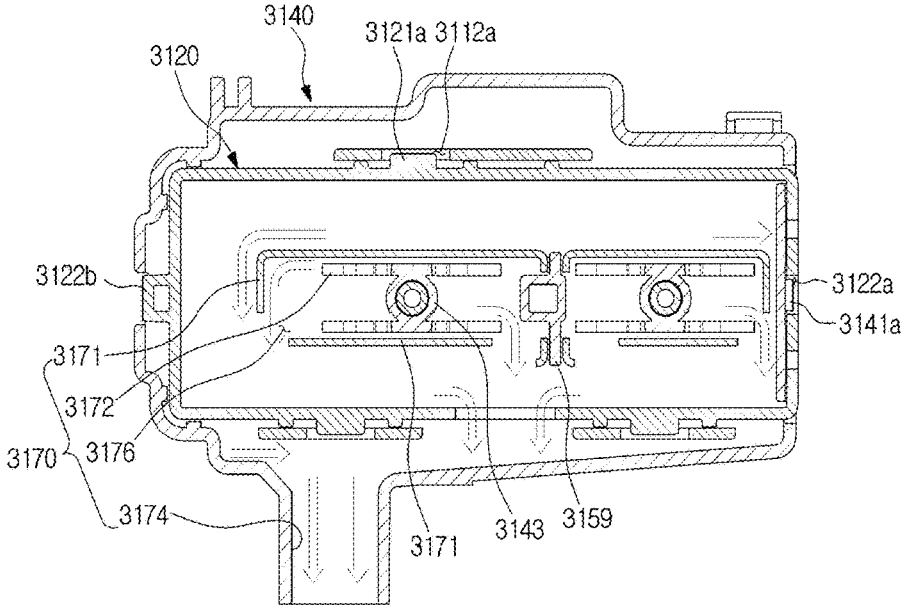

[Fig. 53]
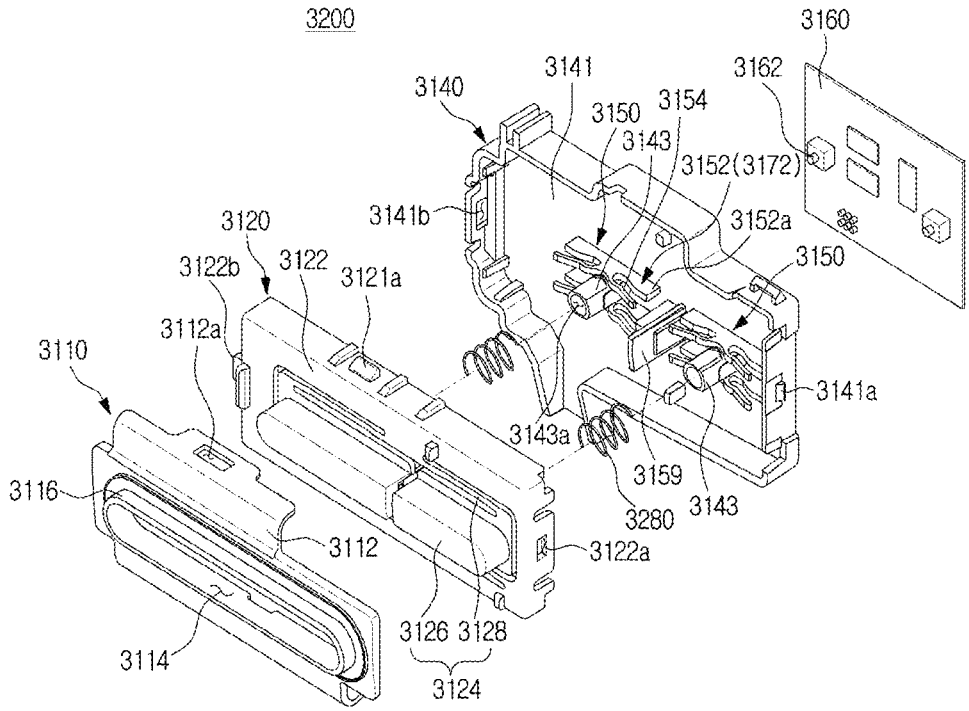
[Fig. 54]
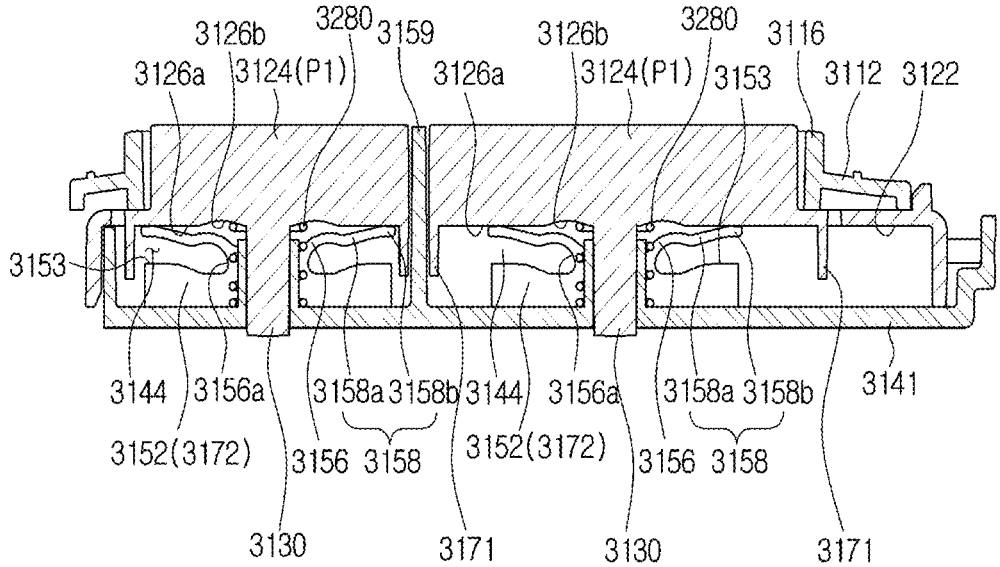

[Fig. 55]
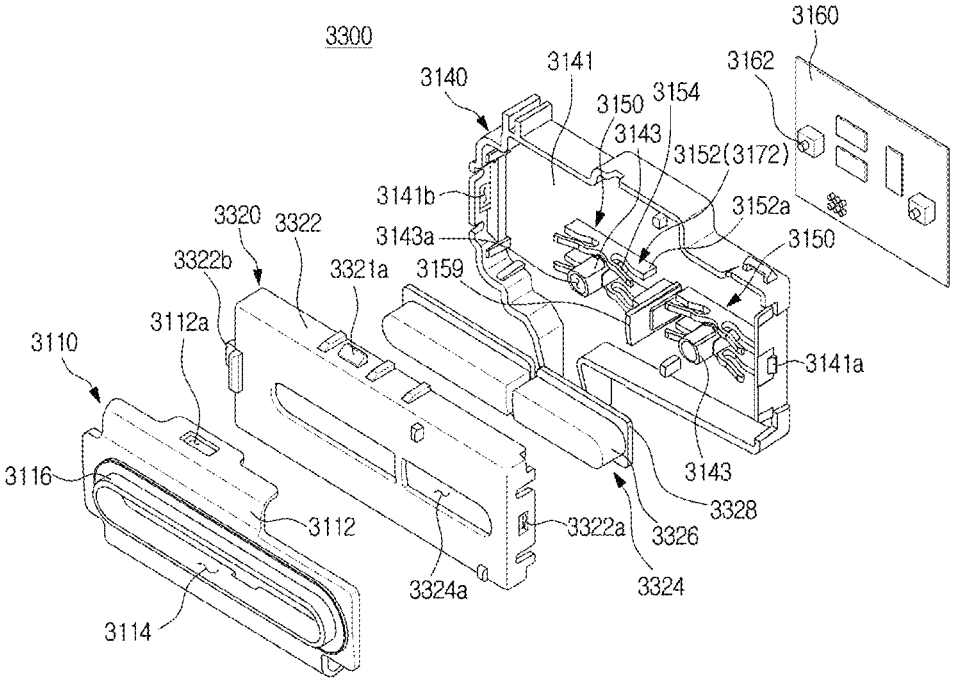
[Fig. 56]
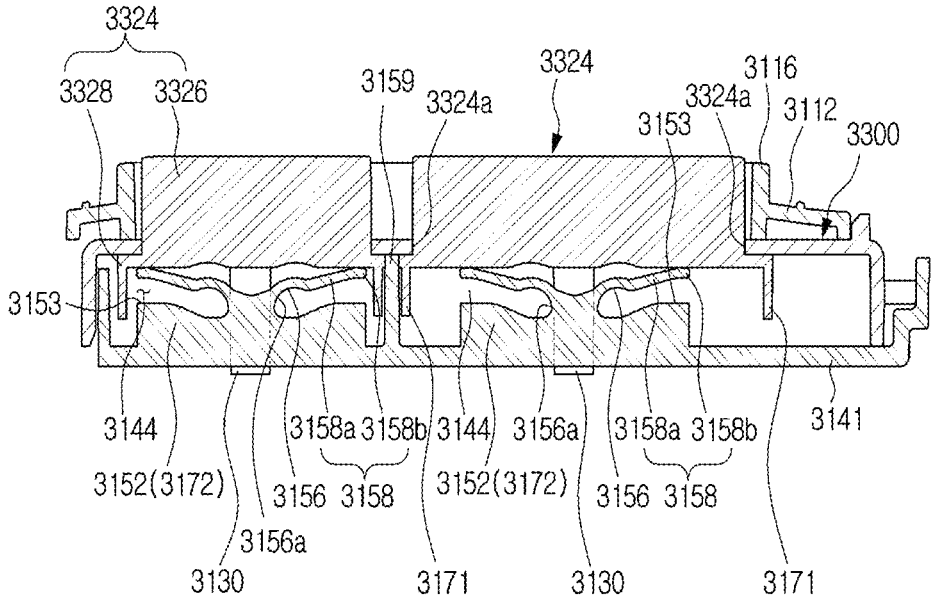

[Fig. 57]
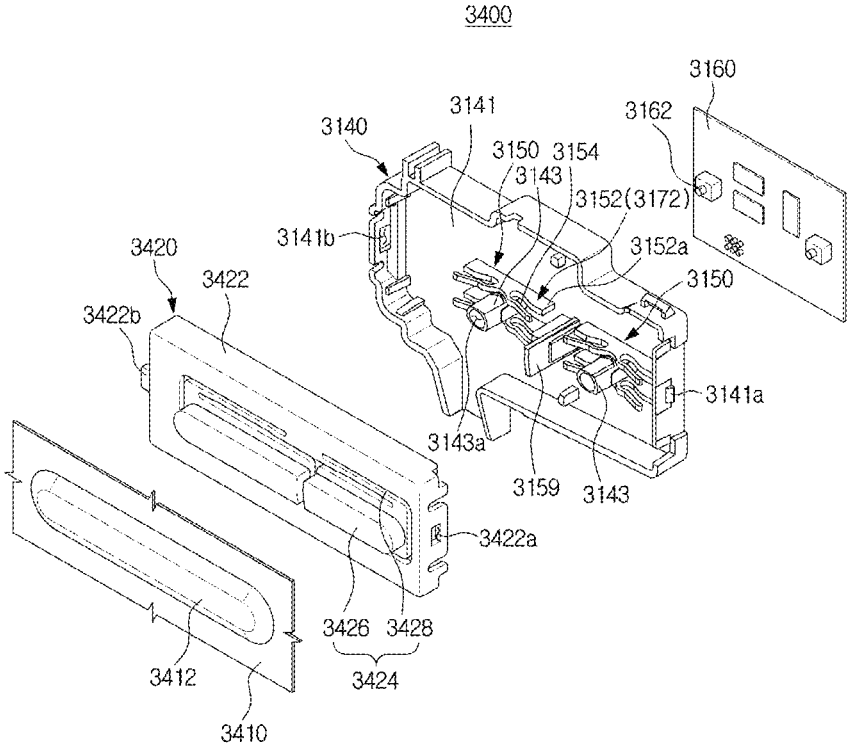
[Fig. 58]
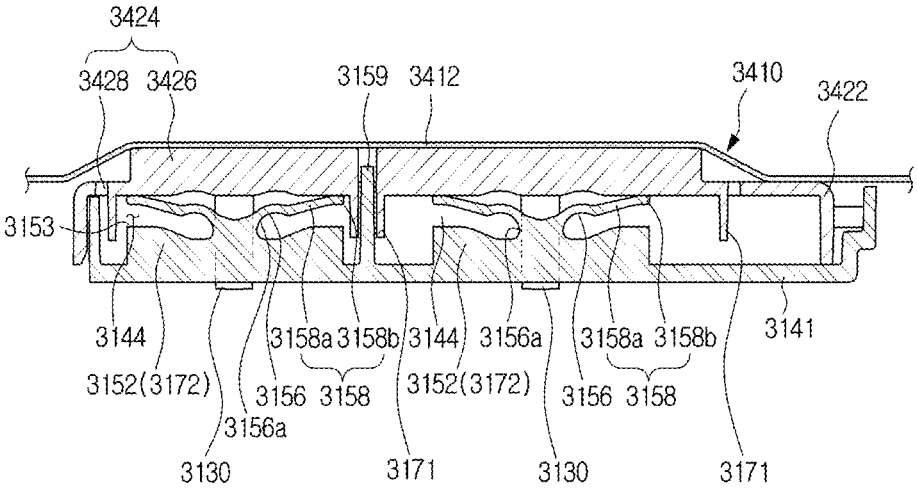

[Fig. 59]
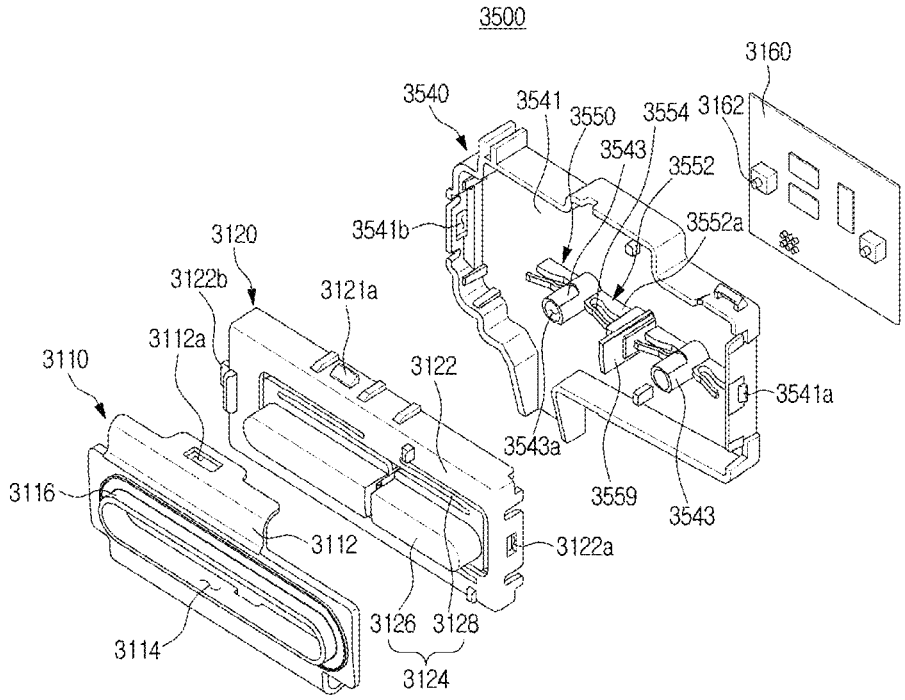
[Fig. 60]
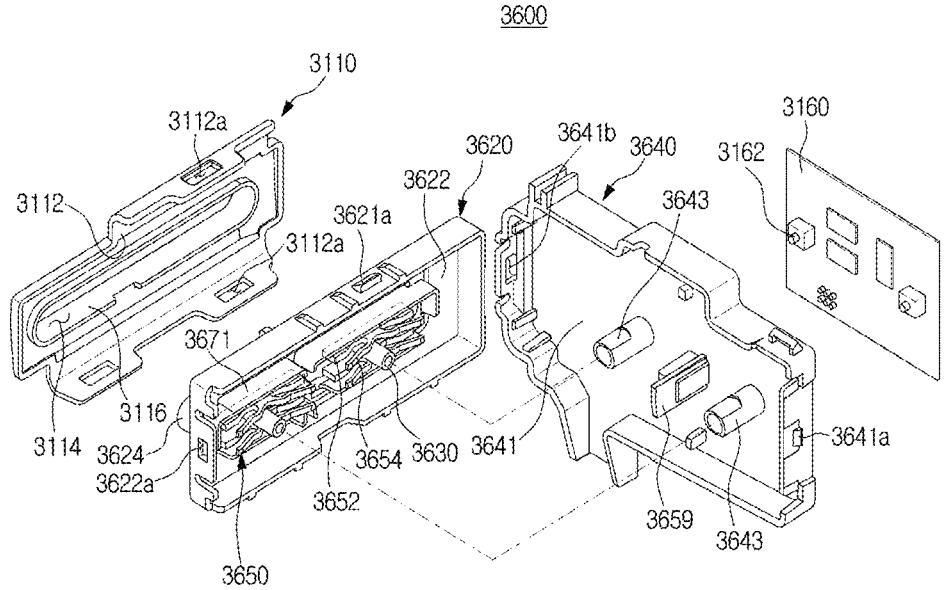

[Fig. 61]
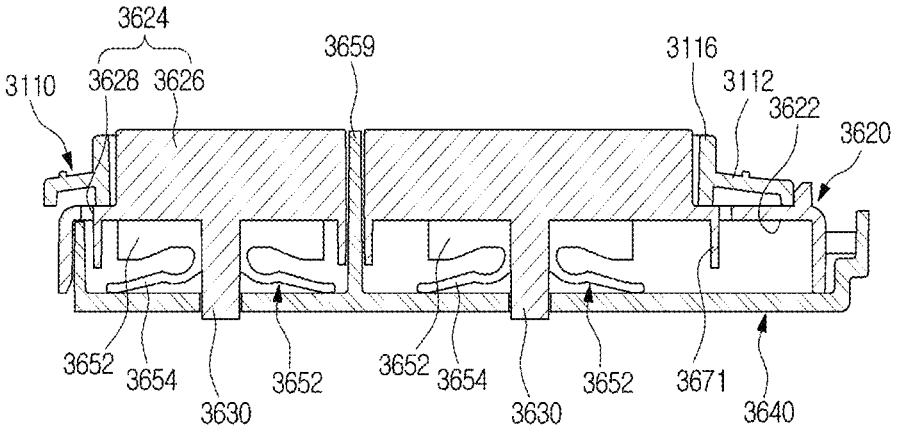
[Fig. 62]
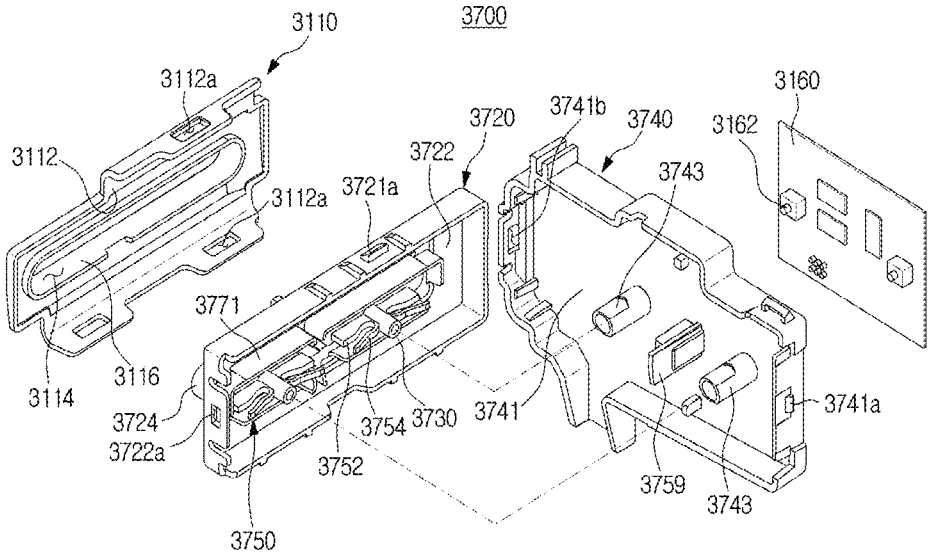

WASHING MACHINE

CROSS-REFERENCE TO RELATED APPLICATIONS

The present application is a divisional of U.S. patent application Ser. No. 15/118,471 filed on Aug. 11, 2016, which is a 371 of International Patent Application No. PCT/KR2015/001392 filed on Feb. 11, 2015, which claims priority to Korean Patent Application No. 10-2014-0015607 filed on Feb. 11, 2014, Korean Patent Application No. 10-2014-0016853 filed on Feb. 13, 2014, Korean Patent Application No. 10-2014-0033574 filed on Mar. 21, 2014, Korean Patent Application No. 10-2014-0033677 filed on Mar. 21, 2014, and Korean Patent Application No. 10-2014-0186393 filed on Dec. 22, 2014, the disclosures of which are herein incorporated by reference in their entirety.

BACKGROUND

1. Field

The present invention relates to a washing machine having an enhanced exterior by including an integrally-formed front cover.

2. Description of Related Art

Washing machines are home appliances that include a main body that forms an exterior, a tub, which is disposed in the main body and in which washing water is stored, a rotating tub rotatably disposed in the tub and a motor that provides a driving force to the rotating tub, thereby washing clothes.

In particular, in drum washing machines, a laundry port through which laundry is put into the rotating tub, is formed at a front side of the main body, and the rotating tub is disposed to rotate about a rotation shaft approximately horizontally formed, and a lifter inside the rotating tub lifts or lowers the laundry while the rotating tube rotates, so that the drum washing machines can wash the laundry.

In general, a front side of a drum washing machine includes a front frame that is press-formed of a steel plate material or injection-molded using a resin material, and a panel cover that is attached to a part of an upper side of the front frame so as to install a display panel or a manipulation panel and that is injection-molded using a resin material, or includes a front frame, a panel cover, and a lower cover that is press-formed using a steel plate material or injection-molded using a resin material so as to cover a lower portion of the front frame that is not covered by the panel cover.

A line is inevitably formed between an upper portion and a lower portion of the front side of the drum washing machine having the above configuration. Thus, the exterior of the drum washing machine is not simple, and an esthetic appeal thereof is lowered.

The present invention is directed to providing a washing machine having a simple exterior and an enhanced esthetic appeal in which a line that partitions a front side of the washing machine into an upper portion and a lower portion is not formed.

The present invention is also directed to providing a washing machine having a coupling structure of a front cover having an enhanced exterior in which a screw member is not exposed to the outside.

The present invention is also directed to providing a washing machine having a coupling structure of a front cover in which the usage of a screw member is minimized and the front cover can be easily attached to and detected from the washing machine.

The present invention is also directed to providing a washing machine having an enhanced exterior in which a gap formed between a front cover and a bending portion of each of press-formed side frames is not exposed to the outside.

The present invention is also directed to providing a washing machine having a top frame in which an esthetic appeal can be enhanced and simultaneously strength can be reinforced.

The present invention is also directed to providing a washing machine that prevents water flowing from an outside of the washing machine from permeating an internal configuration of the washing machine.

The present invention is also directed to providing a washing machine having an enhanced structure in which transportation of the washing machine can be easily performed.

The present invention is also directed to providing a washing machine in which assembling and mounting of a top frame can be easily performed.

The present invention is also directed to providing a washing machine having an enhanced structure in which rigidity of a main body can be secured.

The present invention is also directed to providing a washing machine having an enhanced structure in which a design of the main body can be enhanced.

The present invention is also directed to providing a washing machine having a control button assembly in which a pressing force of a control button can be enhanced.

The present invention is also directed to providing a washing machine having a control button assembly having a discharge structure in which moisture can be discharged.

SUMMARY

One aspect of the present invention provides a washing machine including: a cabinet including a plurality of side frames, a back frame, a top frame, and a bottom frame; a tub disposed in the cabinet; a rotating tub that is rotatably disposed in the tub and accommodates laundry; a front frame coupled to a front of the cabinet; and a front cover that is disposed in front of the front frame, extends from the top frame to the bottom frame and is seamless.

The front frame may include an internal laundry port through which the laundry is put into the rotating tub.

The front cover may include an external laundry port corresponding to the internal laundry port.

The front cover may cover an entire area of the front frame.

The front cover may include a panel portion having a flat or curved surface shape and at least one elastic hook that protrudes from the panel portion rearward so that the front cover may be detachably coupled to the front frame or the side frames through the at least one elastic hook.

The at least one elastic hook may include: a root portion connected to the panel portion; a head portion that is detachably engaged with the front frame or the side frames; and stem portions including at least one straight line portion that connects the root portion and the head portion and that is formed to be parallel to a progression direction when the front cover is detached from the front frame or the side frames and at least one bending portion that is slantly formed in the at least one straight line portion.

The front cover may include a panel portion having a flat or curved surface shape and a bottom coupling portion that protrudes from the panel portion rearward so that the front cover may be detachably coupled to the bottom frame.

Each of the side frames may include side portions that form sides of the cabinet, a front portion coupled to the front frame, and a bending portion that connects the side portions and the front portion.

The front cover may include a close contact portion that comes into close contact with the front portion, and the close contact portion may include a filler portion that protrudes toward the bending portion so as to fill a gap between the close contact portion and the bending portion.

The front cover may include a close contact portion that comes into close contact with the front portion, and the close contact portion may include a filler portion that protrudes toward the bending portion so as to fill a gap between the close contact portion and the bending portion.

The washing machine may further include a guide door that is disposed between the front cover and the front frame and has a shape of a ring that connects the external laundry port and the internal laundry port.

A diameter of the external laundry port may be larger than that of the internal laundry port.

The front cover may include at least one support leg that protrudes from a portion adjacent to the external laundry port rearward so as to be supported on the front frame.

Another aspect of the present invention provides a washing machine including: a cabinet including a plurality of side frames, a back frame, a top frame, and a bottom frame; a tub disposed in the cabinet; a rotating tub that is rotatably disposed in the tub and accommodates laundry; a front frame coupled to a front of the cabinet; and a front cover that is disposed in front of the front frame and includes a laundry port through which the laundry is put into the rotating tub and to which a door is coupled, and a detergent box installation port to which a detergent box that accommodates detergent is coupled.

Still another aspect of the present invention provides a washing machine including: a cabinet including a plurality of side frames, a back frame, a top frame, and a bottom frame; a tub disposed in the cabinet; a rotating tub that is rotatably disposed in the tub and accommodates laundry; a front frame coupled to a front of the cabinet; and a front cover that is disposed in front of the front frame and includes a laundry port through which the laundry is put into the rotating tub and to which a door is coupled, and an attached panel installation port in which an attached panel for displaying or receiving operation information is installed.

The attached panel installation port may include a display panel installation port in which a display panel for displaying operation information of the washing machine is installed.

The attached panel installation port may include a manipulation panel installation port in which a manipulation panel for operating the washing machine is installed.

Yet still another aspect of the present invention provides a washing machine including: a cabinet including a plurality of side frames, a back frame, a top frame, and a bottom frame; a tub disposed in the cabinet; a rotating tub that is rotatably disposed in the tub and accommodates laundry; and a front cover that is disposed in front of the cabinet and is formed integrally with one of the top frame, the bottom frame and the plurality of side frames.

Yet still another aspect of the present invention provides a washing machine including: a cabinet that includes a plurality of side frames, a rear frame and a front frame and forms a washing space in the cabinet; and a top frame disposed at an upper portion of the cabinet, wherein the top frame may include: an external frame that forms an exterior; and an internal frame that is disposed to come into close contact with a lower portion of the external frame, is disposed to be separated from the external frame and is disposed to be coupled to the cabinet.

The external frame may be disposed to slide in a coupling direction in which the external frame is coupled to the internal frame and in a separation direction opposite to the coupling direction and to be separated from the internal frame.

The external frame may include at least one hook unit that protrudes toward the internal frame, and the internal frame may include: hook insertion holes through which the at least one hook unit penetrates into the internal frame; and hook stopper portions that are disposed at ends of the hook insertion holes in the coupling direction and protrude more than the adjacent internal frame so that the at least one hook unit is capable of being inserted into and coupled to the hook stopper portions.

The at least one hook unit may include: a hook body that extends to be spaced apart from the external frame; and a hook portion that is bent from the hook body and is disposed to be parallel to the external frame.

The external frame may further include a separation prevention jaw that is disposed to be separated from the at least one hook unit in the separation direction so that the external frame is not arbitrarily separated from the internal frame, and that limits progression of the external frame in the separation direction.

The washing machine may further include a water permeation prevention member that is disposed at a connection portion of the front frame and the top frame and is disposed to guide water introduced into the connection portion, wherein the water permeation prevention member may include: an introduction guide portion that extends from the external frame and disperses and discharges water introduced from the connection portion in a lengthwise direction of the water permeation prevention member; and a discharge guide portion that extends from the internal frame, is disposed at a lower portion of the introduction guide portion and guides water discharged from the introduction guide portion in a lateral direction of the cabinet.

The introduction guide portion may include: a plurality of dispersion guide portions that guide water introduced from the connection portion to be dispersed; and a plurality of introduction holes, which are disposed to be adjacent to the plurality of dispersion guide portions and through which water guided by the plurality of dispersion guide portions is discharged.

The discharge guide portion may include a discharge flow path formed in a lengthwise direction of the water permeation prevention member so that water discharged from the introduction guide portion flows through the discharge guide portion, and the discharge flow path may be disposed so that the discharge flow path toward the front frame is sealed along the lengthwise direction of the water permeation prevention member.

Ends of the introduction guide portion toward the front frame and ends of the discharge guide portion toward the front frame may come into close contact with each other so that the discharge flow path toward the front frame may be sealed.

The introduction guide portion may include a dispersion guide bottom surface and a dispersion guide flange that extends from the dispersion guide bottom surface and forms a dispersion flow path through which water introduced through the connection portion flows, together with the dispersion guide bottom surface, and the discharge guide portion may include a discharge guide bottom surface and a discharge guide flange that extends from the discharge guide bottom surface and forms a discharge flow path through which water discharged from the introduction guide portion flows, together with the discharge guide bottom surface, and an inside of the discharge guide flange may be disposed to come into close contact with an outside of the dispersion guide flange.

The discharge guide portion may include: a discharge flow path through which water discharged from the plurality of introduction holes is guided in a lateral direction of the cabinet; a discharge hole, which is disposed in the discharge flow path and discharges water flowing on the guide flow path; and a discharge/storing space that is disposed in the discharge flow path so that water excessively discharged into the plurality of introduction holes is temporarily stored.

The washing machine may further include coupling assistant members that are disposed at upper portions of the side frames so that the top frame is inserted into and coupled to the side frames.

The top frame may include fixing protrusions including a lateral movement limitation portion that limits lateral movement of the top frame in a left/right direction, a forward movement limitation portion that is bent from the lateral movement limitation portion and limits forward movement of the top frame, and an escape prevention portion that connects the lateral movement limitation portion and the forward movement limitation portion so that the top frame may not escape from the coupling assistant members, and each of the coupling assistant members may include: fixing insertion holes including a fixing area in which the fixing protrusions are fixed to the coupling assistant members, and a separation area in which the fixing protrusions are separated from the coupling assistant members; and coupling protrusions that are inserted into a space between the lateral movement limitation portion, the forward movement limitation portion and the escape prevention portion so that, when the fixing protrusions move from the separation area to the fixing area, the fixing protrusions are fixed to the coupling protrusions.

The top frame may further include a handle unit that extends from the top frame rearward so as to protrude more than the rear frame, and the handle unit may include a gripping portion that is disposed at a lower portion of the handle unit and is more concavely formed than the handle unit.

Yet still another aspect of the present invention provides a washing machine including: a cabinet including a frame that forms both sides of an exterior; a tub disposed in the cabinet; and a rotating tub that is rotatably disposed in the tub and accommodates laundry, wherein the frame may include beads for reinforcing rigidity, and the beads may further protrude toward an outside of the frame as they get closer to a center of the frame.

A first central line M that crosses upper and lower portions of the frame, and a second central line N that crosses the front and rear of the frame and is perpendicular to the first central line M may form an intersection point Q, and the beads may further protrude toward the outside of the frame as they get closer to the intersection point Q.

The beads may include first beads including at least one of a circular shape and an oval shape, and second beads that are spaced apart from the first beads and include at least one of a concentric circular shape of the first beads and an oval shape.

Yet still another aspect of the present invention provides a washing machine including: a cabinet including a washing unit in which laundry is washed; and a control button assembly that is disposed on one surface of the cabinet and inputs an operation of the washing unit, wherein the control button assembly may include: a control panel having a control button exposed to an outside of the cabinet; and a support panel that has elastic support units for supporting a rear side of the control button and is coupled to the control panel, and each of the elastic support units may include a plurality of elastic ribs disposed to have elasticity in an opposite direction to a direction in which the control button is pressed, so that the control button is prevented from being leant toward one side.

The plurality of elastic ribs may be disposed to be diverged from the support panel, and both ends of each of the elastic ribs may elastically support the rear side of the control button in a lengthwise direction of the control button.

The plurality of elastic ribs may include: an elastic portion disposed to be bent with elasticity; and a support portion that extends from the elastic portion and supports the rear side of the control button.

The elastic portion may be formed to have a C-shape in which one side of the elastic portion is opened, so that the elastic portion has elasticity in an opposite direction to a direction in which the control button is pressed.

The control panel may include pressing protrusions that press an on/off switch of a printed circuit board (PCB), and the support panel may include guide protrusions that are formed between the elastic support units and guide advance and retreat of the pressing protrusions, and the control button assembly may include guide ribs that are disposed between the control panel and the support panel and prevent moisture from being introduced into the pressing protrusions.

The guide ribs may include: first guide ribs formed from the rear side of the control button in the lengthwise direction of the control button; and second guide ribs formed from a front side of the support panel in the lengthwise direction of the control button and disposed to come into close contact with the first guide ribs so that the first guide ribs slide.

The plurality of elastic ribs may extend from the second guide ribs.

As described above, according to the spirit of the present invention, a front cover of a washing machine is integrally formed to extend from a top frame to a bottom frame so that a line that partitions a front side of the washing machine into an upper portion and a lower portion is not formed and thus an esthetic appeal of the washing machine can be enhanced.

In addition, the front cover is coupled to a front frame or side frames using at least one elastic hook or elastic fixer so that the front cover can be prevented from coming off from the front frame.

Furthermore, the elastic hook has a structure in which, when the elastic hook pulls the front cover, the elastic hook is rotated by a rotation moment, so that detachment of the front cover can be easily performed.

Furthermore, since a screw member that couples the front cover to a bottom frame or a front frame can be fastened in a vertical direction from down to up or from up to down, the screw member may not be exposed to the front of the washing machine.

Furthermore, since the front cover includes a filler portion that protrudes so as to fill a gap between the front cover and a bending portion of each of the side frames, the gap between the front cover and the bending portion of each side frame can be shielded and thus, an esthetic appeal of an exterior can be enhanced.

According to the spirit of the present invention, in the washing machine, the top frame includes a plurality of panels so that improvements in esthetic appeal and strength reinforcement can be achieved.

Furthermore, the structure of the top frame is enhanced so that water introduced from the outside does not affect an internal configuration of the washing machine.

Furthermore, the structure of the top frame is enhanced so that a handle unit can be integrally formed and thus transportation of the washing machine or attachment/detachment of the top frame can be easily performed.

Furthermore, the top frame can be easily assembled to and mounted on the washing machine.

According to the spirit of the present invention, beads that further protrude toward an outer side of the side frame as they get closer to a center of the side frame are formed so that shock and vibration that may be applied to the center of the side frame during a washing operation can be supported.

Furthermore, beads having curved surfaces and regular patterns are formed in the side frame so that an esthetic appeal of the washing machine can be enhanced.

According to the spirit of the present invention, a pressing force of a control button is enhanced so that the control button can be prevented from being recessed or leant toward one side and thus the quality of a product can be enhanced.

Furthermore, a control button assembly has a discharge structure in which moisture can be discharged, so that durability of a printed circuit board (PCB) and the control button assembly can be enhanced.

BRIEF DESCRIPTION OF THE DRAWINGS

FIG. 4 is a view of a coupling structure of a front cover, a front frame, and a cabinet of the washing machine according to the first embodiment of the present invention.

FIG. 5 is a cross-sectional view of a main configuration of the washing machine according to the first embodiment of the present invention, taken along line II-II of FIG. 1;

FIG. 6 is an enlarged view of a portion A of FIG. 5.

FIG. 7 is a view for describing an operation of an elastic hook of FIG. 6.

FIG. 8 is an enlarged view of a portion B of FIG. 7.

FIG. 9 is a cross-sectional view taken along line of FIG. 1.

FIG. 10 is an excerpt bottom perspective view of a part of a lower portion of the washing machine according to the first embodiment of the present invention.

FIG. 11 is a cross-sectional view taken along line IV-IV of FIG. 10.

FIG. 12 is a cross-sectional view taken along line V-V of FIG. 10.

FIG. 13 is a front perspective view of a front cover of the washing machine according to the first embodiment of the present invention.

FIG. 14 is a cross-sectional view taken along line VI-VI of FIG. 13.

FIG. 15 is a rear perspective view of the front cover of the washing machine according to the first embodiment of the present invention.

FIG. 16 is an enlarged view of a portion C of FIG. 15.

FIG. 17 is a cross-sectional view for describing a coupling structure of a fixer member of FIG. 16.

FIG. 18 is a view of a front cover of a washing machine according to a second embodiment of the present invention.

FIG. 19 is an exploded view of an essential portion of a washing machine according to a third embodiment of the present invention.

FIG. 20 is an exploded view of an essential portion of a washing machine according to a fourth embodiment of the present invention.

FIG. 21 is an exploded view of an essential portion of a washing machine according to a fifth embodiment of the present invention.

FIG. 22 is an exploded perspective view of a cabinet and a top frame of a washing machine according to a sixth embodiment of the present invention.

FIG. 23 is a bottom perspective view of the top frame of the washing machine according to the sixth embodiment of the present invention.

FIGS. 26 and 27 are views of coupling of a hook unit and hook insertion holes when an external frame and an internal frame of the washing machine according to the sixth embodiment of the present invention are coupled to each other.

FIGS. 28 and 29 are perspective views of coupling of fixing protrusions and fixing insertion holes when the top frame and a coupling assistant member of the washing machine according to the sixth embodiment of the present invention are coupled to each other.

FIGS. 30 and 31 are front views of the coupling of fixing protrusions and fixing insertion holes when the top frame and the coupling assistant member of the washing machine according to the sixth embodiment of the present invention are coupled to each other.

FIG. 32 is an enlarged view of a portion E of FIG. 23.

FIG. 33 is an enlarged view of a part of the internal frame of the washing machine according to the sixth embodiment of the present invention.

FIG. 34 is a side cross-sectional view of a coupling structure of the front cover and the top frame of the washing machine according to the sixth embodiment of the present invention.

FIG. 35 is an enlarged view of a handle unit of the washing machine according to the sixth embodiment of the present invention.

FIG. 36 is a cross-sectional view taken along line VII-VII of FIG. 35.

FIG. 37 is a cross-sectional view taken along line VIII-VIII of FIG. 35.

FIG. 38 is a perspective view of a washing machine according to a seventh embodiment of the present invention.

FIG. 39 is a front view of a frame of the washing machine according to the seventh embodiment of the present invention.

FIG. 40 is a cross-sectional view of a portion S-S of FIG. 39.

FIG. 41 is a cutaway cross-sectional view based on a first central line M of FIG. 39.

FIG. 42 is a cutaway cross-sectional view based on a second central line N of FIG. 39.

FIG. 43 is a cutaway cross-sectional view based on a straight line A of FIG. 39.

FIG. 44 is a view of the arrangement of a control button assembly according to the first embodiment of the present invention.

FIG. 45 is a perspective view of the control button assembly according to the first embodiment of the present invention.

FIGS. 46 and 47 are exploded perspective views of the control button assembly according to the first embodiment of the present invention.

FIG. 48 is an enlarged view of an elastic support unit of the control button assembly according to the first embodiment of the present invention.

FIGS. 49 and 50 are views of an operation of the control button assembly according to the first embodiment of the present invention.

FIG. 51 is a cross-sectional view of the control button assembly according to the first embodiment of the present invention.

FIG. 52 is a view of a flow of moisture from the cross-sectional view of the control button assembly according to the first embodiment of the present invention.

FIG. 53 is an exploded perspective view of a control button assembly according to the second embodiment of the present invention.

FIG. 54 is a cross-sectional view of the control button assembly according to the second embodiment of the present invention.

FIG. 55 is an exploded perspective view of a control button assembly according to the third embodiment of the present invention.

FIG. 56 is a cross-sectional view of the control button assembly according to the third embodiment of the present invention.

FIG. 57 is an exploded perspective view of a control button assembly according to the fourth embodiment of the present invention.

FIG. 58 is a cross-sectional view of the control button assembly according to the fourth embodiment of the present invention.

FIG. 59 is an exploded perspective view of a control button assembly according to the fifth embodiment of the present invention.

FIG. 60 is an exploded perspective view of a control button assembly according to the sixth embodiment of the present invention.

FIG. 61 is a cross-sectional view of the control button assembly according to the sixth embodiment of the present invention.

FIG. 62 is an exploded perspective view of a control button assembly according to the seventh embodiment of the present invention.

DETAILED DESCRIPTION

Hereinafter, exemplary embodiments of the present invention will be described in detail.

Figure 1:
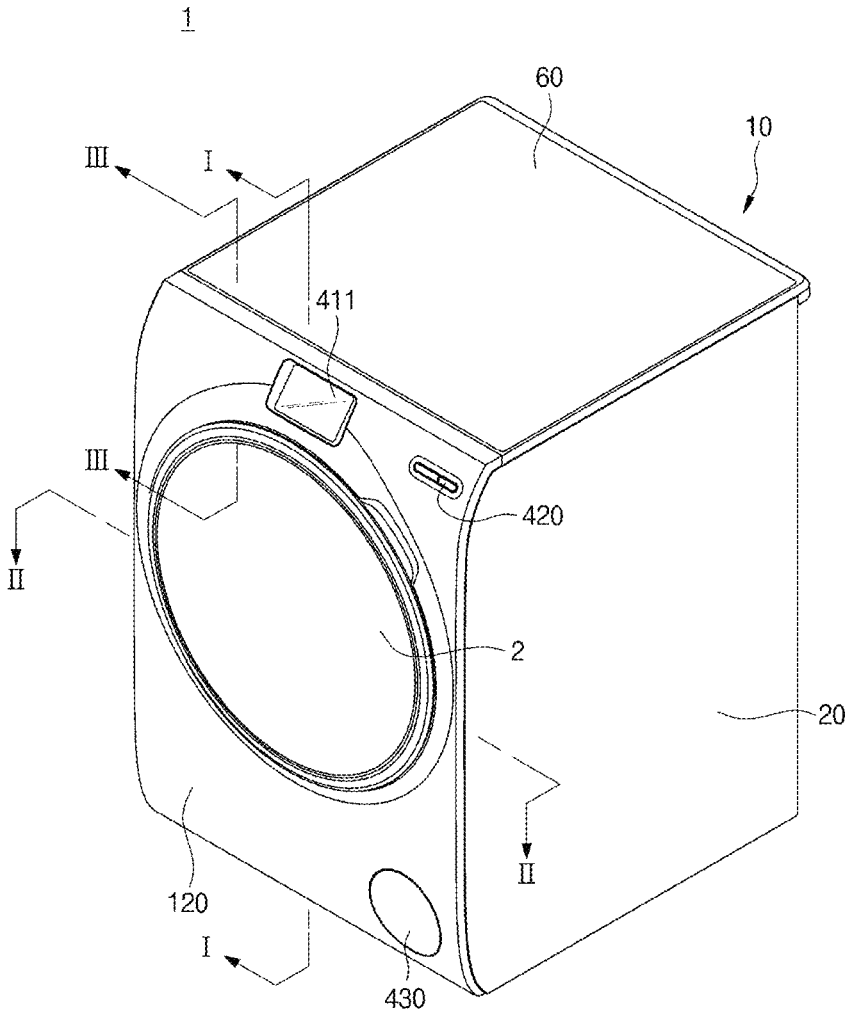
FIG. 1 is a perspective view of a washing machine according to a first embodiment of the present invention.
Figure 2:
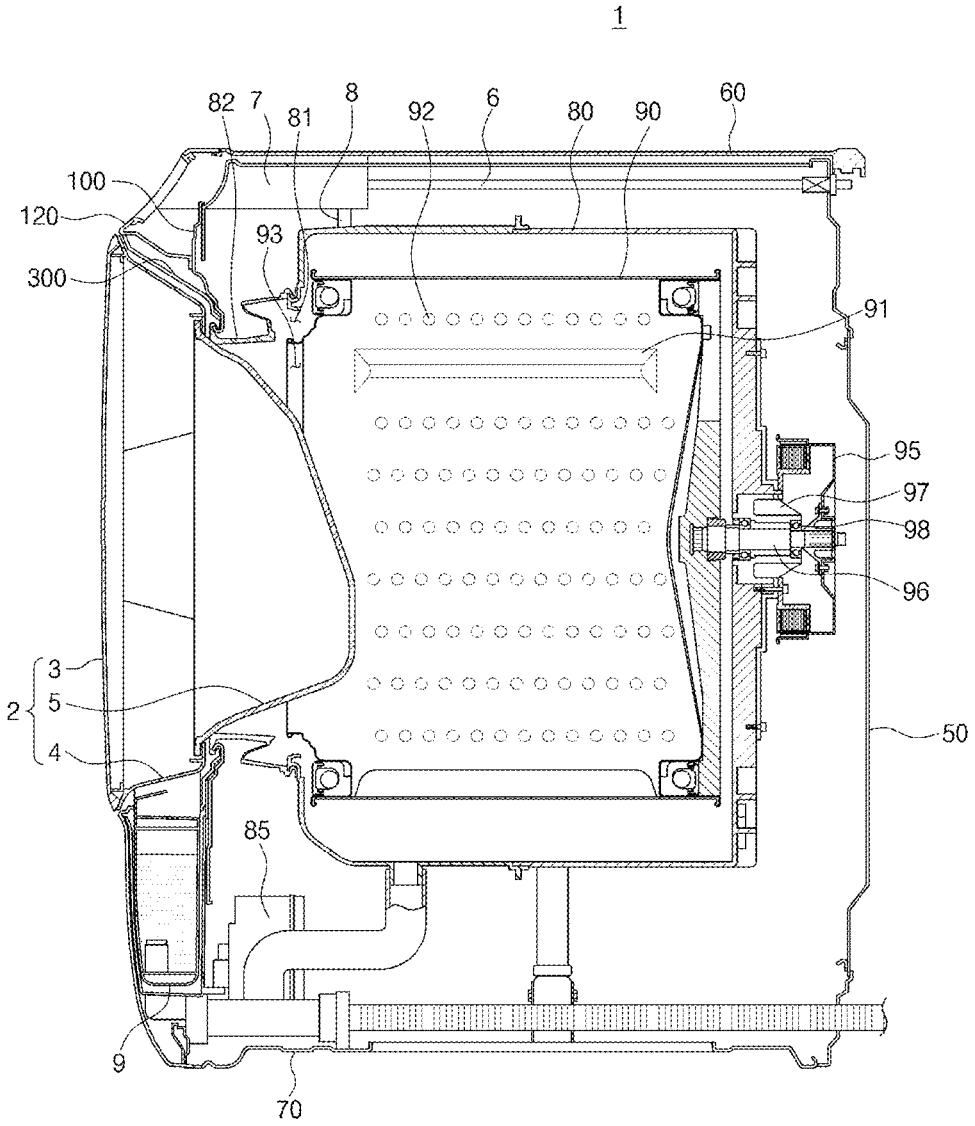
FIG. 2 is a schematic side cross-sectional view of the washing machine according to the first embodiment of the present invention, taken along line I-I of FIG. 1.
Figure 3:
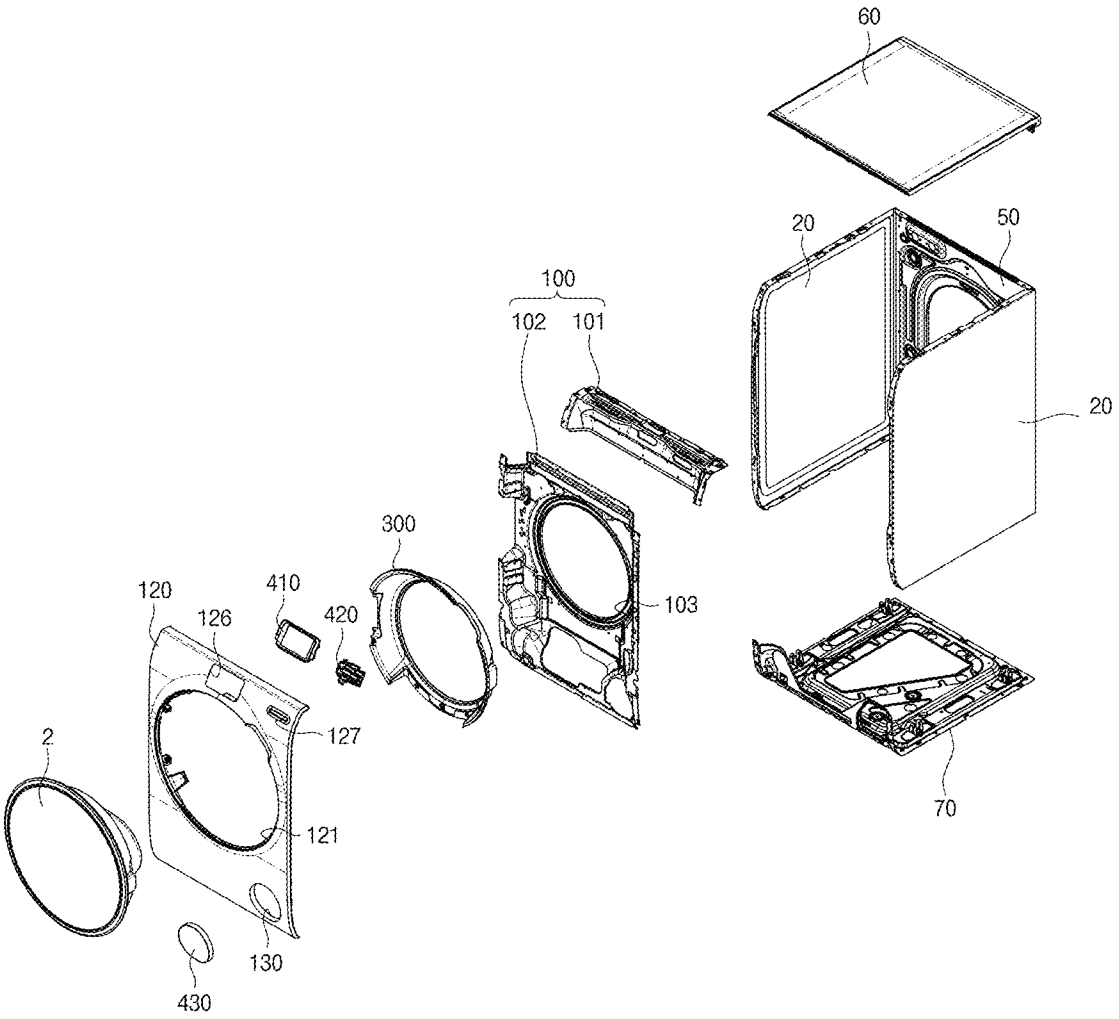
FIG. 3 is an exploded perspective view of a main configuration of the washing machine according to the first embodiment of the present invention.

FIG. 1 is a perspective view of a washing machine according to a first embodiment of the present invention, and FIG. 2 is a schematic side cross-sectional view of the washing machine according to the first embodiment of the present invention taken along line I-I of FIG. 1, and FIG. 3 is an exploded perspective view of a main configuration of the washing machine according to the first embodiment of the present invention, and FIG. 4 is a view of a coupling structure of a front cover, a front frame, and a cabinet of the washing machine according to the first embodiment of the present invention, and FIG. 5 is a cross-sectional view of a main configuration of the washing machine according to the first embodiment of the present invention taken along line II-II of FIG. 1.

Referring to FIGS. 1 through 5, a washing machine 1 includes a main body that forms an exterior of the washing machine 1, a tub 80, which is disposed in the main body and in which washing water is stored, a rotating tub 90 that is rotatably disposed in the tub 80 and accommodates laundry, and a motor 95 that drives the rotating tub 90.

The rotating tub 90 may have an opening 93 formed in front of the rotating tub 90 and may be disposed to rotate about an approximately horizontal rotation shaft. A lifter 91 is disposed in the rotating tub 90 so as to lift the laundry, and when the rotating tub 90 rotates, the lifter 91 may lift or lower the laundry so that the laundry can be washed. Through holes 92 through which the washing water may flow into or may be discharged from the tub 80, may be formed around the rotating tub 90.

A motor 95 may be disposed in rear of the rotating tub 90 so as to generate a driving force. A driving shaft 96 may be disposed between the rotating tub 90 and the motor 95 so as to transfer the driving force. One end of the driving shaft 96 may be connected to a rear plate of the rotating tub 90, and the other end of the driving shaft 96 may be connected to the motor 95 through the tub 80.

A bearing housing 97 that rotatably supports the driving shaft 96 may be installed in a rear wall of the tub 80. The bearing housing 97 may be formed of an aluminum alloy and may be inserted into the tub 80 when the tub 80 is injection-molded. A bearing 98 may be disposed between the bearing housing 97 and the driving shaft 96 so that the driving shaft 96 may be smoothly rotated.

A water supply pipe 6 that supplies washing water to the tub 80 may be disposed above the tub 80. One side of the water supply pipe 6 may be connected to an external water supply source (not shown), and the other side of the water supply pipe 6 may be connected to a washing water supply device 7. The washing water supply device 7 may be connected to the tub 80 through a connection pipe.

A pump 85 that discharges or circulates the washing water in the tub 80 may be disposed below the tub 80.

The main body includes a cabinet 10 including side frames 20 disposed at both sides of the cabinet 10, a back frame 50, a top frame 60 and a bottom frame 70, a front frame 100 disposed in front of the cabinet 10, and a front cover 120 disposed in front of the front frame 100.

Both side frames 20 and the back frame 50 may be integrally press-formed using a steel plate material and then may be bent.

The front frame 100 is used to fix shapes of the side frames 20 and the back frame 50 and to reinforce rigidity. The front frame 100 may be formed by coupling an upper front frame 101 and a main front frame 102. The upper front frame 101 and the main front frame 102 may be respectively press-formed using the steel plate material. However, unlike in the present embodiment, the front frame 100 may also be integrally formed.

An internal laundry port 103, which is connected to the tub 80 and the opening 93 of the rotating tub 90 and through which the laundry may be put into or taken out of the rotating tub 90, may be formed in the front frame 100. The internal laundry port 103 of the front frame 100 and an opening 81 of the tub 80 may be connected by a connection member 82.

The front frame 100 may be coupled to the side frames 20 using a screw member, such as a screw, a bolt, a pin, or a rivet.

The front cover 120 that forms the front exterior of the washing machine 1 may be integrally injection-molded using a resin material. In particular, the front cover 120 according to the current embodiment of the present invention may be formed to extend from the upper, top frame 60 to the lower, bottom frame 70 and thus may cover the whole area of the front frame 100. That is, the front cover 120 is seamless. Thus, a line that partitions the front side of the washing machine 1 into an upper portion and a lower portion, is not formed. Thus, the exterior of the washing machine 1 can be simplified, and an esthetic appeal thereof can be enhanced.

An external laundry port 121 corresponding to the internal laundry port 103 of the front frame 100 may be formed in the front cover 120.

A guide door 300 that connects the external laundry port 121 and the internal laundry port 103 may be disposed between the front cover 120 and the front frame 100. The guide door 300 may have an approximately ring shape. A door 2 that opens/closes the external laundry port 121 and the internal laundry port 103 may be mounted on the guide door 300. The door 2 may be rotatably mounted on the guide door 300.

A diameter of the external laundry port 121 may be greater than a diameter of the internal laundry port 103. Thus, from viewing from the outside, a sense of opening may be increased, and the effect in which the laundry may be easily put into or taken out of the washing machine 1, can be achieved.

A detergent box 9 may be disposed between the front cover 120 and the front frame 100.

A display panel 411, a manipulation panel 420, and a pump filter cover 430 may be installed in the front cover 120. To this end, a display panel installation port 126, a manipulation panel installation port 127, and a pump filter cover installation port 130 may be formed in the front cover 120. A display panel support frame 410 may be installed in the display panel installation port 126, and the display panel 411 may be installed in the display panel support frame 410.

The front cover 120 may be detachably coupled to the front frame 100, the side frames 20, the top frame 60, and the bottom frame 70.

The door 2 may be formed by coupling a first door member 3, a second door member 4, and a third door member 5.

Hereinafter, a detailed configuration of the front cover 120 and a coupling structure thereof will be described in detail.

FIG. 6 is an enlarged view of a portion A of FIG. 5, and FIG. 7 is a view for describing an operation of an elastic hook of FIG. 6.

A coupling structure of the front cover 120 and the guide door 300 and a coupling structure of the front cover 120 and the front frame 100 will be described with reference to FIGS. 6 and 7.

As described above, the guide door 300 that connects the external laundry port (see 121 of FIG. 3) of the front cover 120 and the internal laundry port (see 103 of FIG. 3) of the front frame 100 may be disposed between the front cover 120 and the front frame 100.

The guide door 300 may include coupling protrusions 310 formed in at least a portion of the guide door 300 along a circumferential direction of the guide door 300 so as to be inserted into and coupled to the front cover 120.

Coupling grooves 190 corresponding to the coupling protrusions 310 may be formed in at least a part of the front cover 120 along a circumferential direction of the external laundry port 121 so that the coupling protrusions 310 of the guide door 300 may be inserted into the coupling grooves 190. The front cover 120 may include a first coupling groove formation portion 191, a second coupling groove formation portion 192, and a third coupling groove formation portion 193 that are continuously bent so as to form the coupling grooves 190.

Through this configuration, the coupling protrusions 310 are inserted into the coupling grooves 190 so that the guide door 300 can be coupled to the front cover 120.

Meanwhile, each of the side frames 20 may include side portions 21 that forms sides of the cabinet 10, a front portion 23 coupled to the front frame 100, a bending portion 22 that connects the side portions 21 and the front portion 23, and a hanging portion 24, which is bent from the front portion 23 rearward and with which an elastic hook 140 may be engaged.

The front cover 120 may include a panel portion 122 having a flat surface or curved surface shape, and at least one elastic hook 140 that protrudes from the panel portion 122 rearward so as to be detachably coupled to the side frames 20.

As described above, since the front cover 120 is integrally, long formed to extend from the top frame 60 to the bottom frame 70, the front cover 120 may come off from the front frame 100. Thus, the front cover 120 is coupled to the side frames 20 using the elastic hook 140 so that the front cover 120 can be prevented from coming off from the front frame 100 and the front cover 120 can be solidly fixed to the front frame 100. Thus, at least one or more elastic hooks 140 may be disposed in appropriate positions in a vertical direction of the front cover 120 (FIG. 15).

Also, since the elastic hooks 140 are formed integrally with the panel portion 122, the front cover 120 may be coupled to the side frames 20 without using a separate screw member.

Also, the elastic hooks 140 may be elastically deformed and thus may simply pull the front cover 120 coupled to the side frames 20 so that the front cover 120 may be removed. Thus, service characteristics of the washing machine 1 can be enhanced.

In detail, each of the elastic hooks 140 may include a root portion 141, which is connected to a panel portion of the front cover 120 and from which protrusion starts, a head portion 146 that is detachably engaged with the side frames 20, and stem portions 142, 143, 144, and 145 that connect the root portion 141 and the head portion 146.

The stem portions 142, 143, 144, and 145 may include at least one straight line portion 143 and 145 formed approximately parallel to a progression direction M1 when the front cover 120 is detached, and at least one bending portion 142 and 144 slantly formed in the straight line portions 143 and 145.

Through this configuration, a predetermined distance L can be formed between an innermost point of the head portion 146 and an innermost point of the root portion 141, and a sufficient straight line distance between the head portion 146 and the root portion 141 can be secured. Thus, a rotation moment occurs in the elastic hooks 140 when the front cover 120 is removed, so that the elastic hooks 140 may be rotated (M2) and the front cover 120 may be easily removed in a state in which the elastic hooks 140 are not broken.

The head portion 146 may include an inclination surface 147 that comes into contact with the side frames 20 when the front cover 120 is mounted and is slantly formed so that the elastic hooks 140 may smoothly enter the head portion 146, and a support surface 148 that is interfered with the side frames 20 after mounting of the front cover 120 is finished, and fixes the elastic hooks 140.

Passage holes 104 through which the elastic hooks 140 may pass, may be formed in the front frame 100.

Through the above configuration, if the front cover 120 and the side frames 20 approach each other, a slight gap between the elastic hooks 140 is formed, and the head portion 146 of each elastic hook 140 is interfered with the hanging portion 24 of each side frame 20 so that the front cover 120 may be fixed to the side frames 20. Contrary to this, if the front cover 120 is pulled from the side frames 20, a slight gap between the elastic hooks 140 is formed so that coupling of the front cover 120 and the side frames 20 may be released.

Although not shown, the elastic hooks 140 may be disposed to be engaged with not the side frames 20 but the front frame 100. Also, the front cover 120 may include a plurality of elastic hooks 140, and at least a part of the plurality of elastic hooks 140 may be coupled to the side frames 20, and the other part of the elastic hooks 140 may be coupled to the front frame 100.

FIG. 8 is an enlarged view of a portion B of FIG. 7.

A filler portion 181 for shielding a side gap G between the side frame 20 and the front cover 120 will be described with reference to FIG. 8.

As described above, since the side frames 20 are press-formed using a steel plate material, the bending portion 22 having a rounded surface is inevitably formed between each of the side portions 21 and the front portion 23.

Thus, a gap G is formed between a close contact portion 180 of the front cover 120 that comes into close contact with the front portion 23 of the side frame 20 and the bending portion 22 of the side frame 20. Here, it is assumed that the close contact portion 180 is approximately flat formed.

The gap G is exposed to the outside when the washing machine 1 is seen in a lateral direction, and may give the feeling that the side frames 20 and the front cover 120 are not solidly coupled to each other, which lowers an esthetic appeal.

The close contact portion 180 of the front cover 120 includes the filler portion 181 that protrudes toward the side frames 20 so that the gap G may not be exposed.

The filler portion 181 may protrude toward the bending portion 22 of the side frames 20 from an outer part of the close contact portion 180 of the front cover 120. The filler portion 181 may be formed integrally with the close contact portion 180.

The filler portion 181 may include an inner curved surface portion 182 formed to be rounded to correspond to the rounded surface of the bending portion 22. The inner curved surface portion 182 may come into close contact with the bending portion 22. The filler portion 181 may include an outer flat surface portion 183 that is disposed at an outside of the inner curved surface portion 182 and forms an exterior.

FIG. 9 is a cross-sectional view taken along line of FIG. 1.

An upper coupling structure of the front cover 120 will be described with reference to FIG. 9.

An upper portion of the front cover 120 and an upper portion of the front frame 100 may be solidly coupled to each other using a screw member S1.

To this end, the front cover 120 may include an upper coupling portion 170 that protrudes from the upper portion of the front cover 120 rearward so that the front cover 120 may be coupled to the upper portion of the front frame 100. The upper coupling portion 170 may extend approximately horizontally rearward and may be disposed to cover an upper side of the front frame 100.

A screw fastening hole 171 may be formed in the upper coupling portion 170, and a screw fastening hole 105 corresponding to the screw fastening hole 171 may be formed in the front frame 100. The screw member S1 may be fastened into the screw fastening holes 171 and 105. In this case, the screw member S1 may be fastened into the screw fastening holes 171 and 105 approximately vertically from upward to downward, as illustrated in FIG. 9. Also, the top frame 60 may be disposed at an upper side of the screw member S1. Thus, the screw member S1 may not be exposed to the outside. Thus, the exterior may be prevented from being damaged by the screw member S1.

FIG. 10 is an excerpt bottom perspective view of a part of a lower portion of the washing machine according to the first embodiment of the present invention. FIG. 11 is a cross-sectional view taken along line IV-IV of FIG. 10. FIG. 12 is a cross-sectional view taken along line V-V of FIG. 10.

A lower coupling structure of the front cover 120 will be descried with reference to FIGS. 10 through 12.

The front cover 120 includes a bottom coupling portion 160 that protrudes rearward so that the front cover 120 may be coupled to the bottom frame 70. The bottom coupling portion 160 may be disposed below the bottom frame 70 so as to cover the bottom frame 70.

The bottom coupling portion 160 may include a first coupling portion 161 coupled to the bottom frame 70 using a hanging structure. Also, the bottom coupling portion 160 may include a second coupling portion 163 coupled to the bottom frame 70 using a screw member S2.

As illustrated in FIG. 11, the first coupling portion 161 may have a hanging hole 162 into which a hanging protrusion 71 of the bottom frame 70 is inserted. Through this hanging structure, a bottom end of the front cover 120 may be coupled to the bottom frame 70 without using a separate screw member.

As illustrated in FIG. 12, the second coupling portion 163 may have a screw fastening hole 164 to which the screw member S2 is coupled. A screw fastening hole 72 to which the screw member S2 is coupled, may be formed in the bottom frame 70 so as to correspond to the screw fastening hole 164. The screw member S2 may be fastened into the screw fastening holes 164 and 72 in a direction from downward to upward.

Thus, since the screw member S2 is not exposed to the front of the washing machine 1, the exterior of the washing machine 1 is not be damaged, and the front cover 120 can be solidly coupled to the front frame 100 using the screw member S2.

FIG. 13 is a front perspective view of a front cover of the washing machine according to the first embodiment of the present invention. FIG. 14 is a cross-sectional view taken along line VI-VI of FIG. 13.

A structure of a mold ejection surface of an attached panel installation port will be described with reference to FIGS. 13 and 14.

The panel portion 122 of the front cover 120 includes a flat panel portion 123 that is approximately vertically formed, and an inclined panel portion 124 formed at an upper side of the flat panel portion 123 to be inclined toward the flat panel portion 123.

An attached panel installation port 125 including the display panel installation port 126 in which the display panel (see 411 of FIG. 1) is installed, and the manipulation panel installation port 127 in which the manipulation panel (see 420 of FIG. 1) is installed, is formed in the inclined panel portion 124.

In this way, the attached panel installation port 125 is disposed in the inclined panel portion 124 so that the display panel 411 and the manipulation panel 420 may be disposed to be slightly inclined. Thus, the washing machine 1 can easily operate in a user's standing posture, and operation conveniences can be enhanced.

As illustrated in FIG. 14, the display panel installation port 126 includes an upper mold ejection surface 128 and a lower mold ejection surface 129. The manipulation panel installation port 127 will be described but is the same as the display panel installation port 126.

As described above, the front cover 120 includes the flat panel portion 123 and the inclined panel portion 124 and is injection-molded integrally using a resin material. Thus, at least one of the upper mold ejection surface 128 and the lower mold ejection surface 129 of the display panel installation port 126 is approximately parallel to a horizontal plane H (not with respect to the inclined panel portion 124) so that mold cost can be reduced by minimizing the usage of a slide deformation core. For example, when an angle between the upper mold ejection surface 128 of the display panel installation port 126 and the horizontal plane H is 0, 0 may have the range from 10° in a downward direction of the horizontal plane H to 45° in an upward direction of the horizontal plane H.

FIG. 15 is a rear perspective view of the front cover of the washing machine according to the first embodiment of the present invention. FIG. 16 is an enlarged view of a portion C of FIG. 15. FIG. 17 is a cross-sectional view for describing a coupling structure of a fixer member of FIG. 16.

The configuration of the front cover 120 will be additionally described and a coupling structure of the front cover 120 and the front frame 100 or side frames 20 using an elastic fixer 240 will be described with reference to FIGS. 15 through 17.

A pump connection frame 131 to which a drainage pump (not shown) is connected, may be integrally formed in the front cover 120.

Also, at least one support leg 200 that protrudes from a portion adjacent to the external laundry port 121 rearward may be formed in the front cover 120 so as to be supported on the front frame 100.

Since the front cover 120 is formed integrally using a resin material and is formed to be long in a vertical direction, when a user presses a central portion of the front cover 120, the front cover 120 may be recessed toward the front frame 100. Thus, this recess phenomenon can be prevented by the support leg 200, and the movement of the front cover 120 can be prevented.

The elastic fixer 240 for detachably coupling the front cover 120 as well as the elastic hooks 140 to the front frame 100 or side frames 20 may be coupled to the front cover 120.

The elastic fixer 240 may couple the front cover 120 to the front frame 100 or the side frames 20 instead of the above-described elastic hooks 140 and 150 or in addition thereto.

The elastic hooks 140 and 150 are formed integrally with the front cover 120, whereas the elastic fixer 240 is disposed separately from the front cover 120.

The elastic fixer 240 may include a fixing portion 241 fixed to the front cover 120, an insertion portion 242 inserted into the front frame 100 or the side frames 20, and a connection portion 247 that connects the fixing portion 241 and the insertion portion 242.

In order to correspond to the fixing portion 241, the insertion portion 242 and the connection portion 247, a fixing groove 210 into which the fixing portion 241 is inserted, and a fixing wall 211 that causes the fixing portion 241 not to escape from the fixing groove 210 may be formed in the front cover 120, and an insertion hole 106 into which the insertion portion 242 is inserted, may be formed in the front frame 100 or the side frames 20.

A seating groove 213 on which the connection portion 247 of the elastic fixer 240 is seated, and a guide groove 212 that guides the connection portion 247 of the elastic fixer 240 toward the seating groove 213 may be formed in the fixing wall 211.

Thus, the user may move the elastic fixer 240 in a lateral direction and thus may insert the fixing portion 241 of the elastic fixer 240 into the fixing groove 210 of the front cover 120.

The insertion portion 242 of the elastic fixer 240 may be disposed to have a diameter greater than that of the insertion hole 106. Also, the insertion portion 242 may have a first inclination surface 243 that contacts the front frame 100 when the insertion portion 242 enters the insertion hole 106, and a second inclination surface 244 that contacts the front frame 100 when the insertion portion 242 escapes from the insertion hole 106. The insertion portion 242 may smoothly enter the insertion hole 106 or escape from the insertion hole 106 using the first inclination surface 243 and the second inclination surface 244.

Through this configuration, when the elastic fixer 240 approaches the insertion hole 106 of the front frame 100, the insertion portion 242 of the elastic fixer 240 shrinks and passes through the insertion hole 106, and if passage is finished, the insertion portion 242 extends again and is engaged with the insertion hole 106 so that the elastic fixer 240 can be fixed to the front frame 100.

Contrary to this, when the elastic fixer 240 is pulled in a state in which it is fixed to the front frame 100, the insertion portion 242 of the elastic fixer 240 shrinks and passes through the insertion hole 106. Thus, the elastic fixer 240 may escape from the front frame 100.

A skirt portion 246 of the elastic fixer 240 protrudes outward in a radial direction of the skirt portion 246 and comes into contact with the front frame 100 so that the movement of the elastic fixer 240 can be prevented.

As described above, the front cover 120 may be coupled to the front frame 100 or the side frames 20 to be easily detached therefrom using the elastic fixer 240.

As described above, the front cover 120 of the washing machine 1 according to the first embodiment of the present invention is disposed in front of the front frame 100 so as to form the exterior of the front side of the washing machine 1, is disposed to long extend to the upper, top frame 60 and the lower, bottom frame 70, and is injection-molded integrally using a resin material.

Top and bottom ends of the front cover 120 may be solidly coupled to the front frame 100 and the bottom frame 70 using the screw members S1 and S2. In this case, the screw members S1 and S2 may not be exposed to the outside and thus an esthetic appeal may not be lowered.

Since a central portion between the top and bottom ends of the front cover 120 is coupled to the front frame 100 or the side frames 20 using the elastic hooks 140 and 150 or the elastic fixer 240, the front cover 120 may be formed long in the vertical direction but may not come off from the front frame 100 or may not move. The elastic hooks 140 and 150 and the elastic fixer 240 may be separated from each other by performing an operation of pulling the front cover 120. Thus, removal of the front cover 120 can be easily performed, and service characteristics of the washing machine 1 can be enhanced.

FIG. 18 is a view of a front cover of a washing machine according to a second embodiment of the present invention. The washing machine according to the second embodiment of the present invention will be described with reference to FIG. 18. Like reference numerals are used for the same configuration as that of the first embodiment, and a description thereof may be omitted.

A washing machine 500 includes a detergent box 502 in which detergent is accommodated. The detergent box 502 may be disposed in the cabinet (see 10 of FIG. 1) using a front cover 520.

The detergent box 502 includes an accommodation space in which the detergent, a conditioner and a rinse agent may be accommodated. After putting the detergent into the detergent box 502, the user may mount the detergent box 502 on the washing water supply device (see 7 of FIG. 2) inside the cabinet 10 through a detergent box installation port 501 of the front cover 520 that will be described later.

The washing water supply device 7 on which the detergent box 502 is mounted, may be disposed in the cabinet 10. Washing water supplied via the water supply pipe (see 6 of FIG. 2) may be mixed with the detergent in the detergent box 502 in the washing water supply device 7 and then may be supplied to the tub (see 80 of FIG. 2) through the connection pipe of FIG. 2).

To this end, the detergent box installation port 501 through which the detergent box 502 passes, may be formed in the front cover 520. The detergent box 502 may be put into and taken out of the detergent box installation port 501. In the present embodiment, the detergent box installation port 501 is formed at one side of an upper portion of the front cover 520. However, the position of the detergent box installation port 501 is not limited thereto, and the detergent box installation port 501 may be formed in various positions.

In this way, the front cover 520 according to the current embodiment of the present invention is disposed to cover the whole of the front side of the washing machine 500, and may include a laundry port through which laundry may be put into the washing machine 500, a detergent box for putting detergent, a display panel and a manipulation panel for displaying or inputting operation information of the washing machine 500, and various installation ports in which a pump filter is installed.

FIG. 19 is an exploded view of an essential portion of a washing machine according to a third embodiment of the present invention. FIG. 20 is an exploded view of an essential portion of a washing machine according to a fourth embodiment of the present invention. FIG. 21 is an exploded view of an essential portion of a washing machine according to a fifth embodiment of the present invention.

Washing machines according to third through fifth embodiments of the present invention will be described with reference to FIGS. 19 through 21. Like reference numerals are used for the same configurations as those of the above-described embodiments, and a description thereof may be omitted.

Washing machines 600, 700, and 800 each have a cabinet including a plurality of side frames 20, a back frame 50, a top frame 60, and a bottom frame 70. Front covers 610, 710, and 810 may be coupled to the front of the cabinet.

The front covers 610, 710, and 810 cover the entire areas of outer parts of the front of the washing machines 600, 700, and 800. The front covers 610, 710, and 810 may be formed to extend from the top frame 60 to the bottom frame 70.

Since the front covers 610, 710, and 810 cover the entire areas of the outer parts of the front of the washing machines 600, 700, and 800, the front covers 610, 710, and 810 may include laundry ports 621, 721, and 821 having doors installed therein, attached panel installation ports 622, 623, 722, 723, 822, and 823 in which display panels and manipulation panels are installed, and cover installation ports 624, 724, and 824 in which pump filters are installed. Although not shown, the front covers 610, 710, and 810 may further include a detergent box installation port in which a detergent box is installed.

Since the front covers 610, 710, and 810 are formed to extend from the top frame 60 to the bottom frame 70, furthermore, the front covers 610, 710, and 810 may be formed integrally with the top frame 60 or the bottom frame 70.

That is, as illustrated in FIG. 19, the front cover 610 may be formed integrally with the top frame 60. In this case, the front cover 610 and the top frame 60 may be formed of the same material as a steel plate material.

As illustrated in FIG. 20, the front cover 710 may also be formed integrally with the bottom frame 70. In this case, the front cover 710 and the bottom frame 70 may be formed of the same material as the steel plate material.

As illustrated in FIG. 21, the front cover 810 may also be formed integrally with both side frames 20. In this case, the front cover 810 and the side frames 20 may be formed of the same material as the steel plate material.

FIG. 22 is an exploded perspective view of a cabinet and a top frame of a washing machine according to a sixth embodiment of the present invention. FIG. 23 is a bottom perspective view of the top frame of the washing machine according to the sixth embodiment of the present invention. Illustration and description of the same configuration as those of the above-described embodiments may be omitted.

Referring to FIGS. 22 and 23, a washing machine 1001 may include a main body that forms an exterior, a tub, which is disposed in the main body and in which washing water is stored, a rotating tub 1052, which is rotatably disposed in the tub and in which laundry is accommodated, and a motor that drives the rotating tub 1052.

The main body may include a cabinet including a front frame disposed in front of the main body, a front cover 1014 disposed in front of the front frame, side frames 1020 disposed at both sides of the front frame, a rear frame 1030 disposed to face the front frame and a bottom frame 1040 disposed to face the ground, and a top frame 1100 disposed at an upper portion of the cabinet.

The rotating tub 1052 may have an opening 1052*a* formed in front of the rotating tub 1052 and may be disposed to rotate about an approximately horizontal rotation shaft.

Both side frames 1020 and the rear frame 1030 may be press-formed integrally using a steel plate material and then may be bent. The front frame is used to fix shapes of the side frames 1020 and the rear frame 1030 and to reinforce rigidity. The front frame may be coupled to the side frames 1020 using a screw member, such as a screw, a bolt, a pin, or a rivet.

The front cover 1014 that forms the exterior of the front of the washing machine 1001 may be injection-molded integrally using a resin material. In particular, the front cover 1014 according to the current embodiment of the present invention may be formed to extend from the upper, top frame 1100 to the lower, bottom frame 1040 and may cover the entire area of the front frame. Thus, a line that partitions the front side of the washing machine 1001 into upper and lower portions, is not formed. Thus, the exterior of the washing machine 1001 can be simplified, and an esthetic appeal thereof can be enhanced.

A guide door 1062 may be disposed between the front cover 1014 and the front frame. The guide door 1062 may have an approximately ring shape. A detergent box 1086 may be disposed between the front cover 1014 and the front frame.

Electrical components, such as a display panel 1075 and a manipulation panel 1076, and a pump filter cover 1077 may be installed in the front cover 1014.

The top frame 1100 includes an external frame 1110 and an internal frame 1130.

The external frame 1110 is disposed to form the exterior. The internal frame 1130 is disposed to be separated from the external frame 1110 and is disposed at an inside of the external frame 1110. The external frame 1110 is disposed to cover the entire area of the internal frame 1130. The external frame 1110 and the internal frame 1130 may be disposed as an approximately rectangular panel.

Since the external frame 1110 is disposed to form the exterior, the external frame 1110 may be formed of plastics, for example, so as to realize a design shape. However, the material used for forming the external frame 1110 is not limited to plastics, and the external frame 1110 may be formed of any material that may be easily formed, so as to realize the design shape.

The internal frame 1130 is disposed inside the external frame 1110, i.e., to come into close contact with a lower portion of the external frame 1110 and is disposed to be separated from the external frame 1110. Also, as will be described later, the internal frame 1130 is configured so that the top frame 1100 may be coupled to the cabinet.

The internal frame 1130 is disposed at the lower portion of the external frame 1110 so as to reinforce the strength of the top frame 1100. Thus, the internal frame 1130 may be disposed in all areas of an upper portion of the cabinet. Also, the external frame 1110 may be disposed to cover all areas of the internal frame 1130 so that the internal frame 1130 may not be exposed to the outside. The internal frame 1130 may be formed of a steel material, for example, so as to reinforce strength. However, the material used for forming the internal frame 1130 is not limited to the steel material, and the internal frame 1130 may be formed of any material for reinforcing the strength of the top frame 1100.

The internal frame 1130 may be disposed to have the shape of embossing having a convex portion 1132*a* and a concave portion 1132*b* so that the strength of the top frame 1100 may be reinforced. The internal frame 1130 may be disposed by press-forming. The internal frame 1130 may have the convex portion 1132*a* and the concave portion 1132*b* that is adjacent to the convex portion 1132*a* and is more concave than the convex portion 1132*a*, which are formed in the internal frame 1130 during a press-forming process, so that the strength of the internal frame 1130 may be improved.

Figure 24:
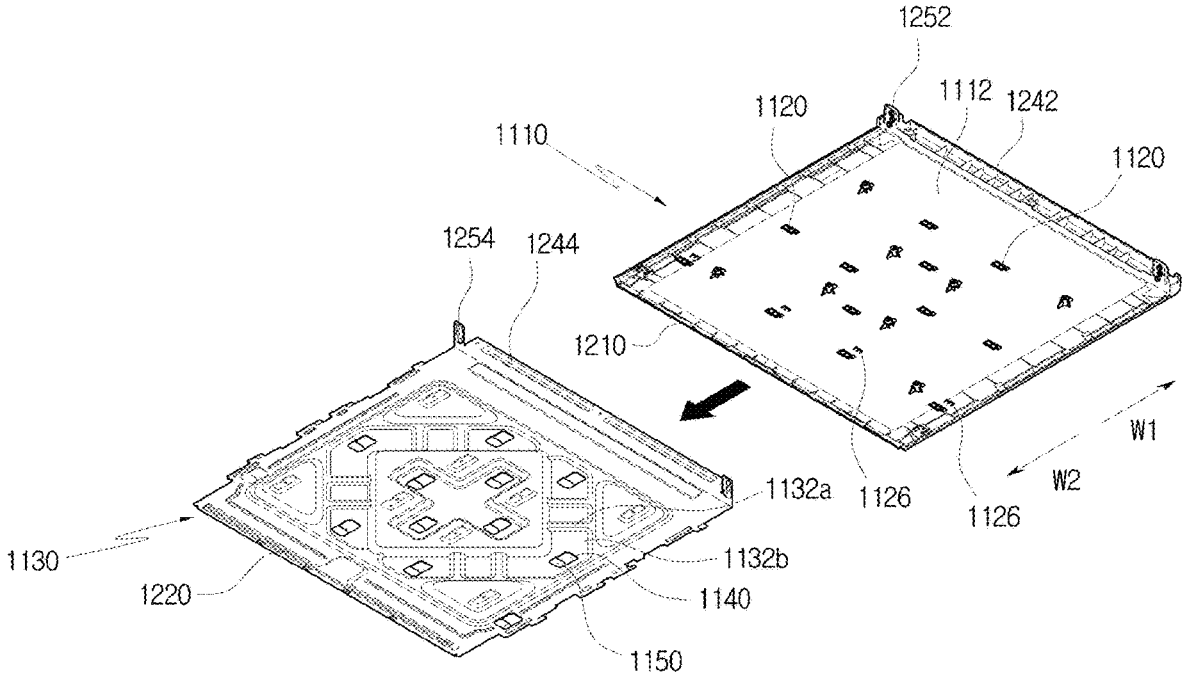
FIG. 24 is an exploded perspective view of the top frame of the washing machine according to the sixth embodiment of the present invention.
Figure 25:
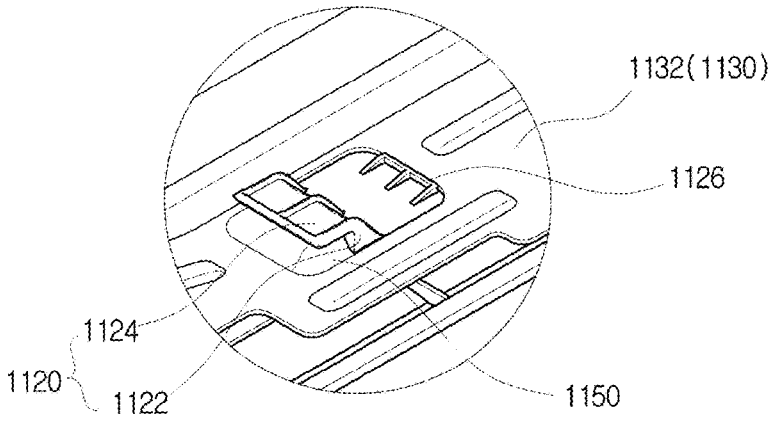
FIG. 25 is an enlarged view of a portion D of FIG. 22.

FIG. 24 is an exploded perspective view of the top frame of the washing machine according to the sixth embodiment of the present invention. FIG. 25 is an enlarged view of a portion D of FIG. 22. FIGS. 26 and 27 are views of coupling of a hook unit and hook insertion holes when an external frame and an internal frame of the washing machine according to the sixth embodiment of the present invention are coupled to each other.

The external frame 1110 may be disposed to be coupled to the internal frame 1130 through sliding movement. Reversely, the internal frame 1130 may also be coupled to the external frame 1110 through sliding movement. The external frame 1110 may be disposed to move in a coupling direction w1 with respect to the internal frame 1130 and a separation direction w2 opposite to the coupling direction w1 and to be separated from the internal frame 1130.

The external frame 1110 may include an external frame body 1112 and a hook unit 1120.

The external frame body 1112 may be disposed to have the shape of a panel and to form the exterior of the top frame 1100. At least one hook unit 1120 may be disposed to extend from the external frame body 1112 and to protrude toward the internal frame 1130. In the present embodiment, a plurality of hook units 1120 may be disposed on a bottom surface of the external frame body 1112 and to be stably coupled to the internal frame 1130.

The hook unit 1120 may include a hook body 1122 that extends to be separated from the external frame 1110, and a hook portion 1124 that is bent from the hook body 1122.

The hook body 1122 may extend to protrude from the external frame body 1112, and the hook portion 1124 may be bent from the hook body 1122 so as to be hung in a hook stopper portion 1150 that will be described later and may be disposed to be parallel to the external frame body 1112. A hook height H between the hook portion 1124 and the external frame body 1112 may be disposed to correspond to a vertical thickness of the hook stopper portion 1150. That is, the vertical thickness of the hook stopper portion 1150 may be formed to be equal to or less than the hook height H.

The internal frame 1130 may include an internal frame body 1132, hook insertion holes 1140, and the hook stopper portion 1150.

The internal frame body 1132 may have the shape of a panel, may be disposed at an inside of the external frame 1110 so as to reinforce the strength of the top frame 1100. The hook insertion holes 1140 may be disposed in the internal frame body 1132 so as to correspond to the hook unit 1120, and at least one hook insertion hole 1140 may be disposed in the internal frame body 1132. In the present embodiment, a plurality of hook insertion holes 1140 may be disposed in the internal frame body 1132 so that the external frame 1110 may be stably coupled to the internal frame 1130.

When the external frame 1110 and the internal frame 1130 are coupled to each other, the hook stopper portion 1150 may limit progression in the coupling direction w1 of the external frame 1110, and the hook unit 1120 may be inserted into and coupled to the hook stopper portion 1150 so that the external frame 1110 and the internal frame 1130 may be coupled to each other. At least one hook stopper portion 1150 may be disposed to correspond to the hook insertion holes 1140 and may be disposed to be the same as the arrangement of the hook insertion holes 1140.

The hook stopper portion 1150 may be disposed on an end of the hook insertion hole 1140 in the coupling direction w1 so as to protrude more than the adjacent internal frame 1130 so that the hook unit 1120 may be inserted into and coupled to the hook stopper portion 1150. That is, the hook stopper portion 1150 is disposed to have a shape in which the hook stopper portion 1150 protrudes more convexly than the adjacent internal frame body 1132. The thickness of the hook stopper portion 1150 may be formed to be equal to or less than the hook height H between the hook portion 1124 and the external frame body 1112, as described above, so that the hook unit 1120 may be inserted into the hook stopper portion 1150.

The external frame 1110 may include a separation prevention jaw 1126 so that the external frame 1110 and the internal frame 1130 may be coupled to each other and then may not be arbitrarily separated from each other.

When the external frame 1110 and the internal frame 1130 are coupled to each other, the separation prevention jaw 1126 limits movement in such a way that the external frame 1110 may not arbitrarily move in the separation direction w2. The separation prevention jaw 1126 may be formed to protrude from the external frame body 1112 and may be disposed to be adjacent to the hook unit 1120. The separation prevention jaw 1126 may be disposed to be separated from the hook unit 1120 in the separation direction w2 and may be disposed to be seated on an end of the hook insertion hole 1140 in the separation direction w2. That is, when the external frame 1110 and the internal frame 1130 are coupled to each other, the hook unit 1120 is disposed at one side of the hook insertion hole 1140 so that the separation prevention jaw 1126 may be seated on the other side of the hook insertion hole 1140.

The separation prevention jaw 1126 may include a separation prevention surface 1126*a* that comes into contact with an outer surface 1140*a* of the hook insertion hole 1140. The separation prevention jaw 1126 is disposed to correspond to the thickness of the internal frame body 1132. In detail, a thickness IF t of the internal frame body 1132 adjacent to the hook insertion hole 1140 may be formed to be equal to or similar to a height H S of the separation prevention surface 1126*a* so that, when the external frame 1110 and the internal frame 1130 are coupled to each other, the separation prevention jaw 1126 is disposed to be stably seated on the other side of the hook insertion hole 1140.

Hereinafter, when the external frame 1110 and the internal frame 1130 are coupled to each other or separated from each other, the relationship between the hook unit 1120 and the hook insertion hole 1140 will be described.

First, coupling of the external frame 1110 and the internal frame 1130 will be described. When the external frame 1110 slides toward the internal frame 1130 in the coupling direction w1, the hook unit 1120 penetrates into or is inserted into the hook insertion hole 1140 of the internal frame 1130.

When the hook unit 1120 is inserted into and coupled to the hook stopper portion of the internal frame 1130, progression of the external frame 1110 in the coupling direction w1 is limited, and the external frame 1110 and the internal frame 1130 are coupled to each other. At least one hook unit 1120, at least one hook insertion hole 1140, and at least one hook stopper portion 1150 may be disposed. In the present embodiment, a plurality of hook units 1120, a plurality of hook insertion holes 1140, and a plurality of hook stopper portions 1150 are provided, thereby stably coupling the external frame 1110 and the internal frame 1130.

If the external frame 1110 is coupled to the internal frame 1130, the separation prevention jaw 1126 is seated on the other side of the hook insertion hole 1140. The separation prevention surface 1126*a* of the separation prevention jaw 1126 comes into contact with the outer surface 1140*a* of the hook insertion hole 1140 and limits movement of the external frame 1110 in the separation direction w2.

That is, when the external frame 1110 is coupled to the internal frame 1130, movement of the external frame 1110 in the coupling direction w1 is limited by coupling of the hook unit 1120 and the hook stopper portion 1150, and movement of the external frame 1110 in the separation direction w2 is limited by contact of the separation prevention jaw 1126 and the outer surface 1140*a* of the hook insertion hole 1140.

Next, separation of the external frame 1110 and the internal frame 1130 will be described. A separation procedure thereof is the same as the inverse of a coupling procedure thereof.

In order to release contact of the separation prevention jaw 1126 and the outer surface 1140*a* of the hook insertion hole 1140, the external frame 1110 is pressed in such a way that the separation prevention jaw 1126 and the outer surface 1140*a* of the hook insertion hole 1140 may be separated from each other, such that the external frame 1110 may be slidable in the separation direction w2.

Subsequently, when the external frame 1110 slides in the separation direction w2, coupling of the hook unit 1120 and the hook stopper portion 1150 is released, and the external frame 1110 and the internal frame 1130 are separated from each other.

Hereinafter, coupling of the top frame 1100 and the cabinet will be described.

FIGS. 28 and 29 are perspective views of coupling of fixing protrusions and fixing insertion holes when the top frame and coupling assistant members of the washing machine according to the sixth embodiment of the present invention are coupled to each other, and FIGS. 30 and 31 are front views of the coupling of fixing protrusions and fixing insertion holes when the top frame and the coupling assistant members of the washing machine according to the sixth embodiment of the present invention are coupled to each other.

The top frame 1100 may be disposed to be coupled to the side frames 1020, the rear frame 1030, and the front frame.

Coupling assistant members 1090 may be disposed at upper portions of the side frames 1020 so that the top frame 1100 may be coupled to the side frames 1020. The coupling assistant members 1090 may be disposed to be formed integrally with the side frames 1020 and may also be coupled to the side frames 1020 using a separation configuration, as in the present embodiment. Screw holes 1091 may be formed in the coupling assistant members 1090 so that the coupling assistant members 1090 may be screw-coupled to the side frames 1020. An interference prevention portion 1134 may be disposed in the internal frame 1130 so as to be opened in the coupling direction w1 and to correspond to a screw shape not to be interfered with a screw when the interference prevention portion 1134 slides and is mounted on the coupling assistant members 1090.

The top frame 1100 may also be fixed to the coupling assistant members 1090 through coupling, such as screw coupling. However, in the present embodiment, the top frame 1100 may be inserted into and coupled to the coupling assistant members 1090.

The top frame 1100 includes fixing protrusions 1160 through which the top frame 1100 may be coupled to the coupling assistant members 1090. The fixing protrusions 1160 may be disposed on both ends of the top frame 1100 in the coupling direction w1 so that the top frame 1100 may be stably coupled to the coupling assistant members 1090. The fixing protrusions 1160 may be disposed on both lateral ends of the top frame 1100 with respect to a sliding movement direction of the top frame 1100. In detail, the fixing protrusions 1160 may be disposed on both lateral ends of the internal frame 1130. The fixing protrusions 1160 may extend to protrude downward from the internal frame body 1132.

The fixing protrusions 1160 include a lateral movement limitation portion 1161 that limits lateral movement of the top frame 1100 in a left/right direction, a forward movement limitation portion 1162 that is bent from the lateral movement limitation portion 1161 and limits forward movement of the top frame 1100, and an escape prevention portion 1163 that connects the lateral movement limitation portion 1161 and the forward movement limitation portion 1162 so that the top frame 1100 may not escape from the coupling assistant members 1090. A seating space 1164 is formed between the lateral movement limitation portion 1161, the forward movement limitation portion 1162, and the escape prevention portion 1163. Coupling protrusions 1094 of the coupling assistant members 1090 that will be described later are inserted into the seating space 1164 so that movement of the top frame 1100 in lateral, forward, and escape directions may be limited.

The coupling assistant members 1090 may include fixing insertion holes 1092.

The fixing insertion holes 1092 are disposed in the coupling assistant members 1090 so as to correspond to the fixing protrusions 1160 so that the fixing protrusions 1160 may be inserted into and fixed into the fixing insertion holes.

Each of the fixing insertion holes 1092 includes a fixing area 1092*a* in which the fixing protrusions 1160 are fixed to the coupling assistant members 1090, and a separation area 1092*b* in which the fixing protrusions 1160 are separated from the coupling assistant members 1090. After the fixing protrusions 1160 of the top frame 1100 are inserted into the separation area 1092*b* of the fixing insertion hole 1092, when the top frame 1100 slides in the coupling direction w1, the fixing protrusions 1160 may be disposed to move from the separation area 1092*b* to the fixing area 1092*a* and to be coupled to the coupling assistant members 1090.

Each of the coupling assistant members 1090 may include the coupling protrusions 1094 disposed so that, when the fixing protrusions 1160 move from the separation area 1092*b* to the fixing area 1092*a*, the fixing protrusions 1160 may be inserted into the seating space 1164. Since the fixing protrusions 1160 are coupled to the coupling protrusions 1094 and this coupling is performed at both sides of the top frame 1100, movement of the top frame 1100 in lateral, forward, and escape directions is limited.

Hereinafter, a water permeation prevention structure of the washing machine will be described.

FIG. 32 is an enlarged view of a portion E of FIG. 23. FIG. 33 is an enlarged view of a part of the internal frame of the washing machine according to the sixth embodiment of the present invention. FIG. 34 is a side cross-sectional view of a coupling structure of the front cover and the top frame of the washing machine according to the sixth embodiment of the present invention.

The top frame 1100 may include a water permeation prevention member 1200.

The water permeation prevention member 1200 extends from the top frame 1100, is disposed to be placed at a connection portion 1013 of the front frame and the top frame 1100 when the top frame 1100 is coupled to the cabinet, and is disposed to guide water flowing into the connection portion 1013. In the present embodiment, the water permeation prevention member 1200 extends from the top frame 1100 so as to be placed at the connection portion 1013 of the front frame and the top frame 1100. However, embodiments of the present invention are not limited thereto, and the water permeation prevention member 1200 may be formed at at least a part of the top frame 1100 along a circumference of the top frame 1100.

In order to prevent water from flowing into electronic components, such as a manipulation panel that is vulnerable to water, a display panel, and a controller (not shown), the water permeation prevention member 1200 is disposed in the cabinet and guides water flowing into the cabinet. Thus, movement of flowing water does not affect the electronic components, and water may be discharged while bypassing.

The water permeation prevention member 1200 may include an introduction guide portion 1210 and a discharge guide portion 1220.

The introduction guide portion 1210 is disposed to extend from the external frame 1110 and to guide water flowing into the connection portion 1013. The introduction guide portion 1210 may be disposed below the connection portion 1013 of the front frame and the top frame 1100 and may be disposed long along a left/right direction of the cabinet.

The introduction guide portion 1210 is disposed to guide water that is introduced from the connection portion 1013 and flows along a water guide surface 1201 and to discharge water toward the discharge guide portion 1220 that will be described later.

The introduction guide portion 1210 is disposed to disperse water introduced from the connection portion 1013 in a lengthwise direction of the water permeation prevention member 1200 and to discharge water toward the discharge guide portion 1220 that will be described later. In detail, the introduction guide portion 1210 includes a plurality of dispersion guide portions 1212 that guide water introduced from the connection portion 1013 to be dispersed, and a plurality of introduction holes 1218 that are disposed to be adjacent to the plurality of dispersion guide portions 1212 and to discharge water guided by the plurality of dispersion guide portions 1212.

The plurality of dispersion guide portions 1212 disperse water introduced from the connection portion 1013 and discharge water into the plurality of introduction holes 1218. The plurality of dispersion guide portions 1212 and the plurality of introduction holes 1218 are alternately disposed along the lengthwise direction of the introduction guide portion 1210. Through this configuration, even when surplus water is introduced from the connection portion 1013, introduced water is dispersed by the dispersion guide portions 1212 and is dispersed and discharged into the plurality of introduction holes 1218 so that water that is not guided by the dispersion guide portion 1212 can be prevented from overflowing from the introduction guide portion 1210.

Each of the plurality of dispersion guide portions 1212 includes a dispersion guide bottom surface 1214 and a dispersion guide flange 1215. The plurality of dispersion guide portions 1212 may form a dispersion flow path 1216 using the dispersion guide bottom surface 1214 and the dispersion guide flange 1215.

The plurality of introduction holes 1218 may be disposed in the dispersion guide bottom surface 1214. The plurality of introduction holes 1218 may be disposed to be spaced a predetermined distance apart from each other or to be symmetrical with respect to each other. The arrangement distance and arrangement shape of the plurality of introduction holes 1218 are not limited thereto.

The dispersion guide flange 1215 is disposed to be bent from one end of the dispersion guide bottom surface 1214 upward and guides water that flows on the dispersion guide bottom surface 1214 not to overflow.

The discharge guide portion 1220 extends from the internal frame 1130 and is disposed to discharge water introduced from the connection portion 1013 without affecting the electronic components. The discharge guide portion 1220 may be disposed below the introduction guide portion 1210 and may be disposed along the left/right direction of the cabinet. The introduction guide portion 1210 and the discharge guide portion 1220 may be disposed in the same direction so that the discharge guide portion 1220 may be disposed to correspond to the introduction guide portion 1210.

The discharge guide portion 1220 guides water discharged from the introduction guide portion 1210 in a lateral direction of the cabinet and is disposed to discharge water without affecting the electronic components.

In detail, the discharge guide portion 1220 includes a discharge flow path 1226 through which water discharged from the plurality of introduction holes 1218 is guided in the lateral direction of the cabinet, and a discharge hole 1227, which is disposed in the discharge flow path 1226 and through which water flowing on the discharge flow path 1226 is discharged. The arrangement of the discharge hole 1227 is not limited. However, in the present embodiment, the discharge hole 1227 is disposed to be adjacent to an end of the discharge flow path 1226.

The discharge flow path 1226 may be formed in a lengthwise direction of the water permeation prevention member 1200 so that water discharged from the introduction guide portion 1210 may flow on the discharge flow path 1226. The discharge flow path 1226 may be disposed so that the front frame may be sealed along the lengthwise direction of the water permeation prevention member 1200. That is, the front of the discharge flow path 1226 is sealed so that water may be prevented from being discharged toward the front frame. In detail, an end of the front frame of the introduction guide portion 1210 and an end of the front frame of the discharge guide portion 1220 come into close contact with each other so that the discharge flow path 1226 toward the front frame may be sealed.

One side of the discharge flow path 1226 toward a rear side of the cabinet that is the other side of the front frame, may be disposed to be sealed by close contact coupling of the external frame 1110 and the internal frame 1130. Thus, the discharge flow path 1226 may be disposed to communicate with the outside only through the introduction hole 1218 and the discharge hole 1227.

The discharge guide portion 1220 includes a discharge/storing space 228 that is disposed on the discharge flow path 1226 so that water that is excessively discharged through the plurality of introduction holes 1218 may be temporarily stored in the discharge/storing space 228. The discharge guide portion 1220 is disposed so that water may be prevented from being excessively discharged from the introduction hole 1218 and thus overflowing from the discharge guide portion 1220, and may be temporarily stored.

The discharge guide portion 1220 includes a discharge guide bottom surface 1224 and a discharge guide flange 1225. The discharge guide portion 1220 may form the discharge flow path 1226 by using the discharge guide bottom surface 1224 and the discharge guide flange 1225. The discharge guide portion 1220 may be disposed so that the discharge flow path 1226 may be spaced apart from a rear side of the front frame. The electronic components may be disposed at the rear side of the front frame, which is to prevent water from affecting the electronic components.

The discharge holes 1227 may be disposed in the discharge guide bottom surface 1224. At least one discharge hole 1227 is disposed so that water may be discharged toward edges of the discharge flow path 1226 not to affect the electronic components. The number, arrangement distance and arrangement shape of the discharge holes 1227 are not limited.

The discharge guide bottom surface 1224 may include a discharge guide inclination surface **1224*a*. The discharge guide inclination surface 1224*a* extends from the discharge guide bottom surface 1224 toward both sides of the discharge guide portion 1220 along a lengthwise direction of the discharge guide portion 1220 and is slantly disposed so that water may be collected onto the discharge guide bottom surface 1224. Through this configuration, water that flows through the discharge guide portion 1220** may be effectively collected.

The discharge guide flange 1225 is disposed to be bent from the discharge guide bottom surface 1224 upward and guides water flowing on the discharge guide bottom surface 1224 not to overflow.

The discharge guide portion 1220 is disposed to have a larger width than that of the introduction guide portion 1210 and is disposed to surround at least a part of a lower portion of the introduction guide portion 1210 so that water discharged from the introduction guide portion 1210 may be stably discharged toward the discharge guide portion 1220.

An inside of the discharge guide flange 1225 may be disposed to come into close contact with an outside of the dispersion guide flange 1215. Through this configuration, the discharge flow path 1226 toward the front frame can be sealed. Also, hanging protrusions 1211 disposed on ends of the introduction guide portion 1210 and hanging grooves disposed in ends of the discharge guide portion 1220 are coupled to each other so that the introduction guide portion 1210 and the discharge guide portion 1220 may not be spaced apart from each other and stable discharge may be performed.

Hereinafter, the flow of water using the water permeation prevention member 1200 when water is introduced between the top frame 1100 and the front frame will be described.

If water is introduced into the connection portion 1013 between the top frame 1100 and the front frame, water flows along the water guide surface 1201 and then drops to the introduction guide portion 1210.

Introduced water directly flows into the introduction hole 1218 of the introduction guide portion 1210 and is discharged toward the discharge guide portion

1220, or flows along the dispersion flow path 1216 of the dispersion guide portion 1212 of the introduction guide portion 1210, is dispersed toward the discharge guide portion 1220 through the adjacent introduction hole 1218 and is discharged.

Water that drops to the discharge guide portion 1220 flows along the discharge flow path 1226 and is discharged through the discharge hole 1227.

Since the discharge hole 1227 is disposed to be adjacent to left/right ends of the cabinet, water discharged through the discharge hole 1227 is disposed to be discharged toward a lower portion of the cabinet along an inside of the cabinet or to be discharged while bypassing the electronic components by placing a separate discharge pipe (not shown).

FIG. 35 is an enlarged view of a handle unit of the washing machine according to the sixth embodiment of the present invention. FIG. 36 is a cross-sectional view taken along line VII-VII of FIG. 35. FIG. 37 is a cross-sectional view taken along line VIII-VIII of FIG. 35.

The top frame 1100 may include a handle unit 1240 that is disposed at one end of the top frame 1100 and causes the washing machine to be smoothly moved. The handle unit 1240 is disposed to extend from the top frame 1100 and to protrude from the rear frame 1030. A separate configuration may not be added for movement of the washing machine, and the handle unit 1240 is disposed to extend from the top frame 1100 so that a configuration of the washing machine may be simplified.

The handle unit 1240 may include an external handle portion 1242 that extends from the external frame 1110 and an internal handle portion 1244 that extends from the internal frame 1130. Since the external handle portion 1242 is disposed to be injected using plastics, like in the external frame 1110 and has a design shape together with the external frame 1110 and the internal handle portion 1244 needs to withstand a load of the washing machine when the washing machine is moved, the handle unit 1240 may extend from the internal frame 1130 and be formed of a material having high strength, such as a steel material. A gripping portion 1245 may be disposed in the internal frame 1130 to be more concavely formed than a lower portion of the adjacent internal frame 1130 so that a user may easily grip a handle portion.

A fixing coupling portion 1250 through which the top frame 1100 is fixed to the cabinet, may be disposed in rear of the top frame 1100.

The fixing coupling portion 1250 includes an internal coupling portion 1254 disposed to be bent from the internal frame 1130 and an external coupling portion 1252 disposed to be bent from the external frame 1110. The internal coupling portion 1254 and the external coupling portion 1252 are disposed to be overlapped when the internal frame 1130 and the external frame 1110 are coupled to each other. That is, when the external frame 1110 and the internal frame 1130 are coupled to each other, an internal coupling hole 1254*a* of the internal coupling portion 1254 and an external coupling hole 1252*a* of the external coupling portion 1252 are disposed to have the same central line.

After the top frame 1100 is coupled to the cabinet, the fixing coupling portion 1250 is screw-coupled to the rear frame 1030 so that the top frame 1100 may not escape from the cabinet in the separation direction w2. That is, after the top frame 1100 is coupled to the cabinet, the rear frame 1030 and the fixing coupling portion 1250 are screw-coupled to each other by passing through the internal coupling hole 1254*a* and the external coupling hole 1252*a* of the fixing coupling portion 1250 so that the top frame 1100 may be fixed.

FIG. 38 is a perspective view of a washing machine according to a seventh embodiment of the present invention. FIG. 39 is a front view of a frame of the washing machine according to the seventh embodiment of the present invention. FIG. 40 is a cross-sectional view of a portion S-S of FIG. 39. FIG. 41 is a cutaway cross-sectional view based on a first central line M of FIG. 39. FIG. 42 is a cutaway cross-sectional view based on a second central line N of FIG. 39. FIG. 43 is a cutaway cross-sectional view based on a straight line A of FIG. 39.

The washing machine according to the seventh embodiment of the present invention will be described with reference to FIGS. 38 through 43. Illustration and description of the same configuration as those of the above-described embodiments may be omitted. Hereinafter, a frame may be used in the same meaning as side frames 2020.

A washing machine 2001 may include a main body that forms an exterior, a tub, which is disposed in the main body and in which washing water is stored, a rotating tub that is rotatably disposed in the tub and accommodates laundry, and a motor that drives the rotating tub.

The main body may include a cabinet 2010 including the side frames 2020 disposed at both sides of the cabinet 2010, a back frame 2050, a top frame 2060 and a bottom frame 2070, a front frame disposed in front of the cabinet 2010, and a front cover 2120 disposed in front of the front frame. Both side frames 2020 and the back frame 2050 may be integrally press-formed using a steel plate material and then may be bent.

The front cover 2120 that forms the exterior of the front of the washing machine 2001 may be integrally injection-molded using a resin material. In particular, the front cover 2120 according to the current embodiment of the present invention may be formed to extend from the upper, top frame 2060 to the lower, bottom frame 2070, thereby covering the entire area of the front frame. Thus, a line that partitions a front side of the washing machine 2001 into an upper portion and a lower portion, is not formed. Thus, the exterior of the washing machine 2001 can be simplified, and an esthetic appeal thereof can be enhanced. A door 2002 may be disposed in the front cover 2120. A display panel 2411, a manipulation panel 2420, and a pump filter cover 2430 may be installed in the front cover 2120.

The front cover 2120 may be detachably coupled to the front frame, the side frames 2020, the top frame 2060, and the bottom frame 2070.

Hereinafter, the shape of beads 2200 formed in each of the side frames 2020 so as to secure rigidity of the main body will be described in detail.

Each side frame 2020 may include the beads 2200 for reinforcing rigidity of the side frames 2020.

The side frame 2020 that forms both sides of the exterior need to be maintained at sufficient rigidity so as to support vibration and shock that may occur during an operation and transportation of the washing machine 2001.

The side frame 2020 needs to have a sufficient thickness so as to secure rigidity to support vibration and shock of the washing machine 2001. In order to secure rigidity to support vibration and shock of the washing machine 2001 and simultaneously to reduce the thickness of the side frame 2020, the beads 2200 having various shapes may be formed in the side frame 2020.

The beads 2200 may further protrude toward an outside of the side frame 2020 as they get closer to the center of the side frame 2020. This is to reinforce rigidity of the center of the side frame 2020 that is vulnerable to vibration and shock that occur during washing.

In detail, a first central line M that crosses upper and lower portions of the side frame 2020, and a second central line N that crosses the front and rear of the side frame 2020 and is perpendicular to the first central line M may form an intersection point Q. The beads 2200 formed in the side frame 2020 may further protrude toward the outside of the side frame 2020 as they get closer to the intersection point Q.

The side frame 2020 may have a surface in which unevenness is formed by the beads 2200.

The side frame 2020 may have an asymmetric cross-sectional structure.

As illustrated in FIG. 41, when the side frame 2020 is cut based on the first central line M (hereinafter, a cross-section to be formed in this case is referred to as a "cross-section H"), the beads 2200 may further protrude toward the outside of the side frame 2020 as they get closer to the center of the side frame 2020. Also, more unevenness may be formed at a lower side of the cross-section H than an upper side of the cross-section H. Also, at least one flat portion 2230 may be disposed at the upper side of the cross-section H.

As illustrated in FIG. 42, when the side frame 2020 is cut based on the second central line N (hereinafter, a cross-section to be formed in this case is referred to as a "cross-section J"), the beads 2200 may further protrude toward the outside of the side frame 2020 as they get closer to the center of the side frame 2020. Also, more unevenness may be formed at a left side of the cross-section J than a right side of the cross-section J. Also, at least one flat portion 2230 may be disposed at the right side of the cross-section J.

As illustrated in FIG. 43, when the side frame 2020 is cut based on the straight line A (hereinafter, a cross-section to be formed in this case is referred to as a "cross-section K"), the beads 2200 may further protrude toward the outside of the side frame 2020 as they get closer to the center of the side frame 2020. Also, more unevenness may be formed at a lower side of the cross-section K than an upper side of the cross-section K. Also, at least one flat portion 2230 may be disposed at the upper side of the cross-section K.

A distance between the unevenness formed at the cross-section H, the cross-section J and the cross-section K and a degree of protrusion of the unevenness may be modified in various ways.

The first central line M and the second central line N may partition the side frame 2020 into a plurality of areas 2021.

The beads 2200 may include first beads 2210 and second beads 2220.

The first beads 2210 may be disposed in at least one of the plurality of areas 2021.

The beads 2200 may include at least one second bead 2220. The at least one second bead 2220 may be spaced apart from the first beads 2210.

The at least one second bead 2220 may have regular patterns.

The first beads 2210 and the at least one second bead 2220 may include at least one of a curved surface and a flat surface.

The first beads 2210 may include at least one shape of a circular shape and an oval shape.

The at least one second bead 2220 may include a concave shape toward the first beads 2210.

The at least one second bead 2220 may have different curvature radii.

The at least one second bead 2220 may include a concave circular arc shape toward the first beads 2210.

The first beads 2210 may include a first area 2211 and a second area 2212.

The first area 2211 may be disposed at an edge of the side frame 2020, and the second area 2212 may be connected to the first area 2211 and may be disposed to be adjacent to the intersection point Q. The second area 2212 that is closer to the intersection point Q may further protrude toward the outside of the side frame 2020 compared to the first area 2211.

Based on one of the at least one second bead 2220, a degree of protrusion at which the beads 2220 protrude toward the outside of the side frame 2020, may be gradually decreased as they get closer to edges from the center of the side frame 2020.

When the at least one second bead 2220 has a concave circular arc shape toward the first beads 2210, a degree of protrusion at which the at least one second bead 2220 protrudes toward the outside of the side frame 2020, may be decreased as a separation degree at which the at least one second bead 2220 is spaced apart from the first beads 2210, increases.

Alternatively, when the at least one second bead 2220 has a concave circular arc shape toward the first beads 2210, a degree of protrusion at which the at least one second bead 2220 protrudes toward the outside of the side frame 2020, may be increased as they get closer to the center of the side frame 2020, i.e., as they get closer to the intersection point Q.

The beads 2200 may further protrude toward the outside of the side frame 2020 as they get closer to a straight line A that crosses the side frame 2020 in a diagonal direction. That is, the beads 2200 may further protrude toward the outside of the side frame 2020 as they get closer to the straight line A that corresponds to the center of the side frame 2020.

Also, the beads 2200 may have an asymmetric shape based on the straight line A.

However, the shape of the beads 2200 is not limited to the above example, and the beads 2200 may also have a symmetric shape based on the straight line A.

Also, the beads 2200 may form at least one intersection point with the straight line A.

The first beads 2210 may be formed at edges of the side frame 2020.

The center of the first beads 2210 may be placed at an upper portion or a lower portion of the straight line A and may have a shape including a curved surface. The second beads 2220 may form at least one intersection point with the straight line A.

Also, the second beads 2220 may have a concave shape toward a center C of the first beads 2210.

The first beads 2210 may include at least one shape of a circular shape and an oval shape.

The position of the center C of the first beads 2210 is not limited to the above example and may also be placed in the straight line A.

The beads 2200 may include at least one second bead 2220.

The at least one second bead 2220 may be a concentric circle of the first beads 2210.

Also, the at least one second bead 2220 may have a circular arc shape. In detail, the at least one second bead 2220 may have a circular arc shape placed in the concentric circle of the first beads 2210.

FIG. 44 is a view of the arrangement of a control button assembly according to the first embodiment of the present invention. FIG. 45 is a perspective view of the control button assembly according to the first embodiment of the present invention. FIGS. 46 and 47 are exploded perspective views of the control button assembly according to the first embodiment of the present invention. FIG. 48 is an enlarged view of an elastic support unit of the control button assembly according to the first embodiment of the present invention. FIGS. 49 and 50 are views of an operation of the control button assembly according to the first embodiment of the present invention.

The control button assembly according to the first embodiment of the present invention will be described with reference to FIGS. 44 through 50.

A control button assembly 3100 may be disposed in the cabinet. In detail, the control button assembly 3100 may be disposed at a rear side of a front frame 3010*a* of the cabinet.

The control button assembly 3100 may be disposed to input instructions regarding an operation of a washing unit of the washing machine. By operating the control button assembly 3100, electrical signals are generated in a printed circuit board (PCB) 3160 so that the washing unit may operate.

The control button assembly 3100 may include an exterior panel 3110, a control panel 3120, a support panel 3140, and the PCB 3160.

The PCB 3160 may generate the electrical signals so that the washing unit may operate according to the corresponding instructions. The PCB 3160 may include a switch 3162 that is turned on/off by movement of a control button 3124 that will be described later.

The control button 3124 is disposed in the control panel 3120, and the control button 3124 is pressed such that the instructions are input to the PCB 3160.

The control panel 3120 may include a control panel body 3122 and the control button 3124.

A coupling groove 3122*a* and a coupling protrusion 3122*b* are formed in the control panel body 3122 so that the control panel body 3122 may be coupled to the support panel 3140 that will be described later. A coupling protrusion 3141*a* and a coupling groove 3141*b* are formed in the support panel 3140 so as to correspond to the coupling groove 3122*a* and the coupling protrusion 3122*b*.

The control button 3124 may be disposed in the control panel body 3122 so as to make advance and retreat.

When an external force is applied from the outside, the control button 3124 makes advance and retreat so that the switch 3162 of the PCB 3160 disposed in the control button assembly 3100 may be turned on/off. The control button 3124 is disposed to move in a first position (see P1 of FIG. 49) in which no external force is applied to the control button 3124, and in a second position (see P2 of FIG. 50) in which an external force is applied to the control button 3124 and which is pressed from the first position P1.

The control button 3124 may include a button body 3126 and support ribs 3128 that elastically support the button body 3126.

The button body 3126 is disposed so that at least a part of the button body 3126 may be exposed to an outside of the cabinet, and the user presses the button body 3126 so that the switch 3162 may be activated. If the switch 3162 is activated, the electrical signals are generated in the PCB 3160 so that the washing unit may operate according to the corresponding instructions. The button body 3126 may be disposed to be exposed to the outside of the cabinet through a button hole 3011 disposed in the cabinet.

The button body 3126 may be disposed to protrude than the adjacent control panel body 3122. In the current embodiment of the present invention, the button body 3126 has an approximately rectangular shape, but the shape and arrangement of the button body 3126 are not limited.

The support ribs 3128 are disposed so that the button body 3126 may be elastically supported on the control panel body 3122. The support ribs 3128 are formed on the same plane as the control panel body 3122 and are disposed to be spaced a predetermined distance apart from each other at a circumference of the button body 3126 so that the button body 3126 may make advance and retreat with elasticity.

In detail, one end of each of the support ribs 3128 is connected to the button body 3126, and the other end of the support rib 3128 is connected to the control panel body 3122 so that, if an external force is applied to the button body 3126, the button body 3126 is disposed to elastically make advance and retreat from the control panel body 3122.

The control panel 3120 may include pressing protrusions 3130 through which the switch 3162 may be pressed by pressing the control button 3124. The PCB 3160 may be disposed on a rear side of the support panel 3140. The pressing protrusion 3130 presses the switch 3162 of the PCB 3160 by making advance and retreat together with advance and retreat of the control button 3124 so that the switch 3162 may be disposed to be turned on/off.

The pressing protrusions 3130 may be disposed on the rear side of the button body 3126 of the control button 3124 to have a rod shape and may be integrally formed so that the pressing protrusions 3130 may be moved together with advance and retreat of the control button 3124. That is, one end of each of the pressing protrusions 3130 extends from a rear side of the button body 3126, and the other end of each of the pressing protrusions 3130 is spaced a predetermined distance apart from the switch 3162 that generates electrical signals so that the switch 3162 may be pressed by movement of the control button 3124.

Guide protrusions 3143 may be disposed in the support panel 3140 so as to guide the pressing protrusions 3130 when the pressing protrusions 3130 are moved by advance and retreat of the control button 3124. Guide holes 3143*a* that penetrate into the support panel 3140 may be disposed in the guide protrusions 3143, and the pressing protrusions 3130 are disposed to penetrate into the support panel 3140 through the guide holes 3143*a*. The guide protrusions 3143 may be formed to surround a circumference of the pressing protrusions 3130 so that moisture may be prevented from being introduced between the guide protrusions 3143 and the pressing protrusions 3130.

The control button assembly 3100 may include guide ribs 3171 and 3172 that prevent moisture from permeating an inside of the control button assembly 3100 and prevent moisture from permeating the PCB 3160. A discharge structure in which moisture of the control button assembly 3100 may be discharged, will be described later in detail.

The exterior panel 3110 is disposed to cover at least a part of a front side of the control panel 3120.

The exterior panel 3110 may include an exterior panel body 3112, an exterior panel hole 3114 which is disposed in the exterior panel body 3112 and through which the control button 3124 passes, and a button guide portion 3116 disposed to cover sides of the control button 3124.

The exterior panel body 3112 is disposed to cover at least a part of the control panel 3120 at the front side of the control panel 3120, and a coupling groove 3112*a* is formed in the exterior panel body 3112 so that the exterior panel body 3112 may be coupled to the front side of the control panel 3120 through the coupling groove 3112*a*, and a coupling protrusion 3121*a* is formed in the control panel 3120 so as to correspond to the coupling groove 3112*a*.

The exterior panel hole 3114 may be disposed to communicate with the button hole 3011. Thus, the button body 3126 may pass through the exterior panel 3110.

The button guide portion 3116 may be disposed to have a rib shape to cover the circumference of the button body 3126 and may be disposed to come into close contact with the button body 3126. Thus, contaminants can be prevented from being introduced between the button guide portion 3116 and the button body 3126 from the outside.

The support panel 3140 is disposed to be coupled to the rear side of the control panel 3120.

The support panel 3140 may include an elastic support unit 3150 that is disposed on the rear side of the control button 3124 and elastically supports the control button 3124.

The elastic support unit 3150 is disposed on the rear side of the control button 3124 and is disposed to enhance leaning and a pressing force of the control button 3124. In detail, the elastic support unit 3150 is disposed to have an elastic force in an opposite direction to a direction in which the control button 3124 is pressed, and in a state in which the control button 3124 is not pressed, the elastic support unit 3150 prevents the control button 3124 from being shaken or being leant toward one side, and in a state in which the control button 3124 is pressed, the elastic support unit 3150 has an elastic force so that the control button 3124 may be restored to its original position. Also, while the control button 3124 is pressed, the effect of enhancing the pressing force of the control button 3124 is achieved.

At least one elastic support unit 3150 may be disposed to support the rear side of the control button 3124. In the current embodiment of the present invention, a pair of elastic support units 3150 are disposed to be symmetrical with respect to each other based on the guide protrusions 3143. However, the arrangement and number of elastic support units 3150 are not limited.

The elastic support unit 3150 may include a plurality of elastic ribs 3154 that support the rear side of the control button 3124 with elasticity, and a rib fixing portion 3152 that supports the plurality of elastic ribs 3154 on a support panel body 3141.

The rib fixing portion 3152 is disposed so that the plurality of elastic ribs 3154 may be supported on the support panel 3140. The rib fixing portion 3152 is formed long in the left/right direction, and a pair of rib fixing portions 3152 may be disposed in a vertical direction based on the guide protrusions 3143. A guide surface 3152*a* that guides movement of moisture inside the control button assembly 3100 is formed on one surface of the rib fixing portion 3152.

The rib fixing portion 3152 may be disposed to have a plate shape and may extend from the support panel body 3141 forward in a horizontal direction. However, the shape and arrangement of the rib fixing portion 3152 are not limited.

The rib fixing portion 3152 may include a seating surface 3153 on which a support portion 3158 that will be described later is seated when the control button 3124 is in the second position P2. The seating surface 3153 is disposed so that the support portion 3158 may be seated on the seating surface 3153 when the control button 3124 is in the second position P2, and is disposed to limit movement of the support portion 3158.

The elastic rib 3154 extends from the rib fixing portion 3152 and is disposed to support the control button 3124. The elastic rib 3154 may extend from the rib fixing portion 3152 and may also extend from the support panel 3140 regardless of the rib fixing portion 3152 at the front side of the support panel 3140. In the current embodiment of the present invention, the elastic rib 3154 extends from the rib fixing portion 3152 but is not limited thereto.

The plurality of elastic ribs 3154 may be disposed to support a pressed surface 3126*a* that is the rear side of the control button 3124. The plurality of elastic ribs 3154 may be disposed to be diverged from the support panel 3140 and to elastically support the rear side of the control button 3124.

The plurality of elastic ribs 3154 may include a pair of elastic ribs 3154 that are diverged from the rib fixing portion 3152. That is, the pair of elastic ribs 3154 are disposed to be diverged from the rib fixing portion 3152 in opposite directions and to be inclined toward the pressed surface 3126*a* that is the rear side of the control button 3124. That is, both diverged ends of the elastic ribs 3154 may elastically support the rear side of the control button 3124 in a lengthwise direction of the control button 3124.

The plurality of elastic ribs 3154 may be disposed along the lengthwise direction of the control button 3124. As the plurality of elastic ribs 3154 are diverged from the rib fixing portion 3152 along the lengthwise direction of the control button 3124, the elastic ribs 3154 are disposed to support at least two or more points of the pressed surface 3126*a* of the control button 3124. Also, as the elastic ribs 3154 are disposed along the lengthwise direction of the control button 3124 and support the pressed surface 3126*a* of the control button 3124, a problem that the control button 3124 is leant toward one side and is pressed, can be prevented from occurring.

In the present embodiment, since the pair of elastic support units 3150 are disposed to be perpendicular to the lengthwise direction of the control button 3124 and the pair of elastic ribs 3154 are disposed in the lengthwise direction of the control button 3124, four elastic ribs 3154 support the control button 3124. Through this configuration, the elastic ribs 3154 may support the pressed surface 3126*a* of the control button 3124 in a rectangular shape and thus may stably support the control button 3124. However, the number of elastic support units 3150 and the number of elastic ribs 3154 are not limited thereto.

The elastic ribs 3154 may be disposed to support an inside of the control button 3124 in a state in which the control button 3124 is not pressed by an external force. As the elastic ribs 3154 press the pressed surface 3126*a* of the control button 3124 even when no external force is applied to the control button 3124, the control button 3124 may be prevented from being shaken or being leant toward one side.

The elastic ribs 3154 may include an elastic portion 3156 disposed to be bent with elasticity, and the support portion 3158 that extends from the elastic portion 3156 and supports the rear side of the control panel 3120.

The support portion 3158 may include a support body 3158*a* that extends from the elastic portion 3156, and a support protrusion 3158*b* that is disposed at an end of the support body 3158*a* and to come into contact with the rear side of the control button 3124. Most of elastic force is generated in the elastic ribs 3154 using the elastic portion 3156, but the support portion 3158 may be formed of an elastic material so that the support portion 3158 may exert elasticity.

When the control button 3124 is in the first position P1, the support protrusion 3158*b* supports the rear side of the control button 3124, and when the control button 3124 is in the second position P2, the support protrusion 3158*b* and the support body 3158*a* support the rear side of the control button 3124. When the control button 3124 is in the second position P2, a support surface 3158*c* that is a top surface of the support portion 3158 and the pressed surface 3126*a* of the control button 3124 come into close contact with each other.

The elastic portion 3156 is disposed to have elasticity in the opposite direction to the direction in which the control button 3124 is pressed. The elastic portion 3156 may be disposed to be compressed and tensile between the rear side of the control button 3124 and a front side of the support panel 3140.

In detail, the elastic portion 3156 is disposed to have a C-shape in which a lateral portion of the elastic portion 3156 is opened, and is disposed to be tensile or compressed with elasticity in the direction in which the control button 3124 is pressed. That is, the elastic portion 3156 is disposed so that a diameter of the elastic portion 3156 may be reduced by an external force and may be restored by elasticity.

The elastic portion 3156 may include an elastic surface 3156*a* formed as a curved surface on an inside of the elastic portion 3156. As the elastic surface 3156*a* is formed as the curved surface, the elastic portion 3156 may be tensile or compressed with elasticity.

The elastic portion 3156 may include a seating groove 3126*b*, which is disposed in the rear side of the control button 3124 and in which a seating portion is seated, when the control button 3124 is in the second position P2. The seating groove 3126*b* may be disposed in the pressed surface 3126*a* that is the rear side of the control button 3124 so that, when the control button 3124 is in the second position P2, the elastic portion 3156 may be seated and the elastic portion 3156 may be prevented from directly interfering movement of the control button 3124.

A movement space 3144 is formed between the elastic rib 3154 and the rib fixing portion 3152 so that the elastic rib 3154 may make a reciprocal motion due to tension and compression of the elastic portion 3156. The movement space 3144 may be applied by taking account of a degree at which the control button 3124 is pressed.

The support panel 3140 may include a partitioning rib 3159.

A plurality of control buttons 3124 may be disposed on the control panel 3120. The partitioning rib 3159 extends from the support panel body 3141 and is disposed to partition the plurality of control buttons 3124.

Hereinafter, an operation of the control button assembly 3100 having the above configuration will be described with reference to FIGS. 48 and 49.

The control button 3124 is disposed to move in the first position P1 in which no external force is applied to the control button 3124, and in the second position P2 in which an external force is applied to the control button 3124 and which is pressed from the first position P1.

When the control button 3124 is in the first position P1, only the support protrusion 3158*b* that is a part of the support portion 3158 supports the pressed surface 3126*a* of the control button 3124. Even in this case, the control button 3124 may be prevented from being leant toward one side, because an elastic force is applied to the control button 3124 by the elastic support unit 3150.

When an external force is applied to the control button 3124 and the control button 3124 is pressed from the first position P1 to the second position P2, the elastic portion 3156 is contracted so that a diameter of the elastic portion 3156 is reduced, and an elastic force of the elastic portion 3156 is stored.

When the control button 3124 is in the second position P2, the support body 3158*a* and the support protrusion 3158*b* of the support portion 3158 come into contact with the pressed surface 3126*a* of the control button 3124, and an upper portion of the elastic portion 3156 is seated in the seating groove 3126*b* of the control button 3124. Also, the support portion 3158 is seated on the seating surface 3153 of the rib fixing portion 3152 and limits movement of the control button 3124. In this case, the elastic support unit 3150 has a maximum elastic force.

Subsequently, if the external force is removed from the control button 3124, the control button 3124 is moved from the second position P2 to the first position P1 due to the elastic force stored while the elastic portion 3156 is contracted.

In this way, the control button 3124 is moved between the first position P1 and the second position P2 so that the elastic support unit 3150 may operate.

This will be described from the viewpoint of a force for pressing the control button 3124.

A support force F1 is applied to the control button 3124 in the first position P1 due to the elastic ribs 3154, and a support force F2 that is larger than F1 is applied to the control button 3124 in the second position P2 due to the elastic ribs 3154.

The support force F1 is applied to the control button 3124 in the first position P1 due to the elastic ribs 3154. When an external force F2 is applied to the control button 3124 from the outside of the control button 3124, the elastic ribs 3154 have an elastic force F1' that is larger than F1 due to contraction of the elastic portion 3156 and movement of the support portion 3158. Subsequently, if the external force F2 is removed from the control button 3124, the control button 3124 is restored to the first position P1 due to the elastic force F1'.

This will be described again from the viewpoint of a height h between the plurality of elastic ribs 3154 and the support panel 3140.

A height h between a bottom surface of the support panel body 3141 and ends of the plurality of elastic ribs 3154 varies according to an operation of the control button 3124.

If it is assumed that a height in a state in which the control button 3124 and the plurality of elastic ribs 3154 are spaced apart from each other and separated from each other, is h0, when the control button 3124 is in the first position P1, the height is h1 that is smaller than h0, and when the control button 3124 is in the second position P2, the height is h2 that is smaller than h1.

That is, when the control button 3124 is in the first position P1, a height h of the plurality of elastic ribs 3154 is pressed from h0 to h1 so that, even when no external force is applied to the control button 3124, the control button 3124 may be prevented from being shaken or leant toward one side. Also, when the control button 3124 is in the second position P2, the height h of the plurality of elastic ribs 3154 is pressed from h1 to h2 so that the control button 3124 has an elastic force at which it may be restored to the first position P1.

Hereinafter, a moisture discharge structure of the control button assembly 3100 and the washing machine having the same will be described.

FIG. 51 is a cross-sectional view of the control button assembly according to the first embodiment of the present invention. FIG. 52 is a view of a flow of moisture from the cross-sectional view of the control button assembly according to the first embodiment of the present invention.

The control button 3124 may be disposed to be exposed to the outside of the cabinet so that moisture may be introduced into the control button 3124 from the outside. In this case, moisture is collected in the control button assembly 3100 or permeates into the PCB 3160 so that the life-span of the control button assembly 3100 or the PCB 3160 may be shortened.

In order to prevent this problem, the control button assembly 3100 may include a discharge unit 3170.

The discharge unit 3170 is disposed to guide moisture introduced into the control button assembly 3100 not to be collected in the control button assembly 3100 and to be discharged to the outside. Also, the discharge unit 3170 may guide moisture not to be introduced into the PCB 3160 of the control button assembly 3100.

The discharge unit 3170 may include guide ribs 3171 and 3172 and a discharge hole 3174.

The discharge hole 3174 is disposed in a lower portion of the control button assembly 3100 and is disposed to communicate with an inside of the cabinet. In detail, the discharge hole 3174 is disposed in the lower portion of the support panel 3140 so that moisture introduced into the control button assembly 3100 may be discharged through the discharge hole 3174.

The guide ribs 3171 and 3172 may be disposed between the control panel 3120 and the support panel 3140 so that moisture introduced from the outside of the cabinet may not be introduced into the PCB 3160 or may not be collected in the control button assembly 3100. The guide ribs 3171 and 3172 may be disposed to guide moisture introduced into the control button assembly 3100 toward the discharge hole 3174.

The guide ribs 3171 and 3172 may include a first guide rib 3171 and a second guide rib 3172.

The first guide rib 3171 may be disposed at the rear side of the control panel 3120.

In detail, the first guide rib 3171 may be formed along at least a part of the circumference of the button body 3126 at a rear side of the button body 3126 of the control button 3124.

Since the second guide rib 3172 has the same configuration as the rib fixing portion 3152, the rib fixing portion 3152 may be referred to as the second guide rib 3172. The second guide rib 3172 may be disposed to correspond to the first guide rib 3171. In the current embodiment of the present invention, a pair of second guide ribs 3172 are disposed in the vertical direction based on the guide protrusions 3143 and are disposed to be parallel to each other. However, embodiments of the present invention are not limited thereto, and the pair of second guide ribs 3172 may also be disposed only on upper portions of the guide protrusions 3143 and may be disposed to guide moisture to flow by bypassing the guide protrusions 3143.

Since the first guide rib 3171 is disposed at the rear side of the button body 3126, if the control button 3124 is pressed, the first guide rib 3171 makes advance and retreat together with the control button 3124. In this case, the first guide rib 3171 may be disposed to come into close contact with the second guide rib 3172 not to interfere with the second guide rib 3172 and to slide with respect to the second guide rib 3172. Through this configuration, moisture may not be introduced between the first guide rib 3171 and the second guide rib 3172 and may flow along the guide surface 3152*a* of the guide ribs 3171 and 3172 and may be discharged through the discharge hole 3174.

The guide ribs 3171 and 3172 may further include rib holes 3176 so that moisture flowing along the guide ribs 3171 and 3172 may be discharged through the discharge hole 3174.

Hereinafter, a control button assembly according to a second embodiment of the present invention and a washing machine having the same will be described. A description of a redundant configuration with the above-described embodiment will be omitted.

FIG. 53 is an exploded perspective view of a control button assembly according to the second embodiment of the present invention, and FIG. 54 is a cross-sectional view of the control button assembly according to the second embodiment of the present invention.

In the current embodiment, a control button assembly 3200 may further include an elastic member 3280 disposed at the rear side of the control button 3124 compared to the first embodiment.

The elastic member 3280 may be disposed on outer circumferential surfaces of the pressing protrusions 3130 and the guide protrusions 3143. The elastic member 3280 may be disposed so that one end of the elastic member 3280 may support the rear side of the button body 3126 and the other end of the elastic member 3280 may support the front side of the support panel body 3141.

Through this configuration, the control button 3124 may be supported on the support panel 3140 using the elastic member 3280 together with the elastic ribs 3154.

Hereinafter, a control button assembly according to a third embodiment of the present invention and a washing machine having the same will be described. A description of a redundant configuration with the above-described embodiments will be omitted.

FIG. 55 is an exploded perspective view of a control button assembly according to the third embodiment of the present invention. FIG. 56 is a cross-sectional view of the control button assembly according to the third embodiment of the present invention.

In the current embodiment of the present invention, a configuration of a control button is different from that of the first embodiment.

In the current embodiment, a control button assembly 3300 includes a control panel 3320.

The control panel 3320 may include a control panel body 3322 and a control button 3324.

A coupling groove 3322*a* and a coupling protrusion 3322*b* may be formed in the control panel body 3322 so that the control panel body 3322 may be coupled to a support panel 3140 that will be described later through the coupling groove 3322*a* and the coupling protrusion 3322*b*, and a coupling protrusion 3141*a* and a coupling groove 3141*b* are formed in the support panel 3140 to correspond to the coupling groove 3322*a* and the coupling protrusion 3322*b*.

The control panel body 3322 includes a control button hole 3324*a* through which the control button 3324 may be inserted into the control panel body 3322. The control button 3324 is disposed to penetrate into the control button hole 3324*a* and to make advance and retreat. The control button hole 3324*a* is disposed in the control panel body 3322 to correspond to the shape of the control button 3324.

The control button 3324 makes advance and retreat when an external force is applied to the control button 3324 from the outside, and is disposed to turn on/off the switch 3162 of the PCB 3160 disposed in the control button assembly 3300. The control button 3324 is disposed to be moved in a first position P1 in which no external force is applied to the control button 3324, and in a second position P2 in which an external force is applied to the control button 3324 and which is pressed from the first position P1.

The control button 3324 includes a button body 3326 and a support rib 3328 that is disposed along the circumference of the button body 3326 so that the button body 3326 may not escape from the control panel body 3322. In detail, the button body 3326 is disposed to penetrate into the control button hole 3324*a*, and the support rib 3328 is disposed to have a flange shape along the circumference of the button body 3326 at one side of the button body 3326 and to support the control button 3324 so that the control button 3324 may not escape from the control panel 3320.

The button body 3326 is disposed so that at least a part of the button body 3326 may be exposed to the outside of the cabinet, and the user presses the button body 3326 and operates the switch 3162. If the switch 3162 operates, electrical signals are generated in the PCB 3160 so that the washing unit may operate according to corresponding instructions. The button body 3326 may be disposed to be exposed to the outside of the cabinet through the button hole 3011 disposed in the cabinet.

The button body 3326 may be disposed to further protrude than the adjacent control panel body 3322. In the current embodiment of the present invention, the button body 3326 has an approximately rectangular shape, but the shape and arrangement of the button body 3326 are not limited thereto.

Hereinafter, a control button assembly according to a fourth embodiment of the present invention and a washing machine having the same will be described. A description of a redundant configuration with the above-described embodiments will be omitted.

FIG. 57 is an exploded perspective view of a control button assembly according to the fourth embodiment of the present invention. FIG. 58 is a cross-sectional view of the control button assembly according to the fourth embodiment of the present invention.

In the current embodiment, configurations of the current embodiment are different from those of the exterior panel and the control panel of the control button assembly 3100 according to the first embodiment of the present invention.

In the current embodiment, a control button assembly 3400 includes a support panel 3410 and a control panel 3420.

The control panel 3420 may include a control panel body 3422 and a control button 3424.

A coupling groove 3422*a* and a coupling protrusion 3422*b* are formed in the control panel body 3422 so that the control panel body 3422 may be coupled to the support panel 3410 that will be described later, and a coupling protrusion 3141*a* and a coupling groove 3141*b* are formed in the support panel 3140 to correspond to the coupling protrusion 3422*b* and the coupling groove 3422*a*.

A control button 3424 may be disposed in the control panel body 3422 to make advance and retreat.

The control button 3424 makes advance and retreat when an external force is applied to the control button 3424 from the outside, and is disposed to turn on/off the switch 3162 of the PCB 3160. The control button 3424 is disposed to be moved in a first position P1 in which no external force is applied to the control button 3424, and a second position P2 in which an external force is applied to the control button 3424 and which is pressed from the first position P1.

The control button 3424 may include a button body 3426 and a support rib 3428 that elastically supports the button body 3426.

The button body 3426 is disposed so that at least a part of the button body 3426 may be exposed to the outside of the cabinet, and the user presses the button body 3426 so that the switch 3162 may operate. If the switch 3162 operates, electrical signals are generated in the PCB 3160 so that the washing unit may operate according to corresponding instructions. The button body 3126 may be disposed to be exposed to the outside of the cabinet through the button hole 3011 disposed in the cabinet.

The button body 3426 may be disposed to further protrude than the adjacent control panel body 3422. In the current embodiment of the present invention, the button body 3426 has an approximately rectangular shape, but the shape and arrangement of the button body 3426 are not limited thereto.

An exterior panel 3410 is disposed to cover at least a part of a front side of the control panel 3420. The exterior panel 3410 may be disposed to have a film shape. The exterior panel 3410 may be formed to cover a part of the cabinet and may be disposed to cover the entire surface of the control button assembly 3400.

The exterior panel 3410 may include an exterior button portion 3412 that is disposed on the exterior panel 3410 and is formed to be more convex than the adjacent exterior panel 3410 so as to correspond to the control button 3424.

The exterior panel 3410 may be disposed to cover the entire surface of the control panel 3420, may enhance a design factor of the control button assembly 3400 and simultaneously may prevent moisture from being introduced into the control button assembly 3400.

Hereinafter, a control button assembly according to a fifth embodiment of the present invention and a washing machine having the same will be described. A description of a redundant configuration with the above-described embodiments will be omitted.

FIG. 59 is an exploded perspective view of a control button assembly according to the fifth embodiment of the present invention.

A control button assembly 3500 according to the current embodiment has a different configuration as that of the support panel according to the first embodiment.

A support panel 3540 is disposed to be combined with a rear side of a control panel 3120.

The support panel 3540 may include an elastic support unit 3550 that is disposed at a rear side of a control button 3124 and elastically supports the control button 3124.

The elastic support unit 3550 may be disposed at the rear side of the control button 3124 to enhance leaning and a pressing force of the control button 3124. In detail, the elastic support unit 3550 may be disposed to have an elastic force in an opposite direction to a direction in which the control button 3124 is pressed, and in a state in which the control button 3124 is not pressed, the control button 3124 may be prevented from being shaken or leant toward one side, and in a state in which the control button 3124 is pressed, the control button 3124 has an elastic force at which it may be restored to its original position. Also, the effect of enhancing the pressing force of the control button 3124 while the control button 3124 is pressed, is achieved.

One elastic support unit 3550 may be disposed to correspond to the control button 3124 so as to support the rear side of the control button 3124. In detail, the elastic support unit 3550 may be formed long along a lengthwise direction of the control button 3124 to correspond to the shape of the control button 3124.

The elastic support unit 3550 may include a plurality of elastic ribs 3554 that support the rear side of the control button 3124 with elasticity, and a rib fixing portion 3552 that supports the plurality of elastic ribs 3554 on a support panel body 3541. A guide surface 3552*a* is formed on one surface of the rib fixing portion 3552 so as to guide movement of moisture in the control button assembly 3500.

Unexplained reference numerals 3541*a*, 3541*b*, 3543*a*, and 3559 represent the same configurations as the coupling protrusion 3141*a*, the coupling groove 3141*b*, the guide hole 3143*a*, and the partitioning rib 3159, respectively.

Hereinafter, a control button assembly according to a sixth embodiment of the present invention and a washing machine having the same will be described. A description of a redundant description with the above-described embodiments will be omitted.

FIG. 60 is an exploded perspective view of a control button assembly according to the sixth embodiment of the present invention. FIG. 61 is a cross-sectional view of the control button assembly according to the sixth embodiment of the present invention.

A control button assembly 3600 according to the present embodiment has different configurations from those of the control panel and the support panel of the control button assembly according to the first embodiment.

A support panel 3640 is disposed to be coupled to a rear side of a control panel 3620.

The control panel 3620 may include an elastic support unit 3650 that is disposed at the rear side of the control panel 3620 and elastically supports a control button 3624 with respect to the support panel 3640. In detail, the elastic support unit 3650 is disposed in the support panel 3640 in the first embodiment. However, in the present embodiment, the elastic support unit 3650 may extend from the control button 3624 and may protrude from the control panel 3620.

The elastic support unit 3650 is disposed at a rear side of the control button 3624 and to enhance leaning and a pressing force of the control button 3624. In detail, the elastic support unit 3650 is disposed to have an elastic force in an opposite direction of a direction in which the control button 3624 is pressed, and in a state in which the control button 3624 is not pressed, the control button 3624 may be prevented from being shaken or leant toward one side, and in a state in which the control button 3624 is pressed, the control button 3624 may have an elastic force at which it may be restored to its original position. Also, the effect of enhancing the pressing force of the control button 3624 while the control button 3624 is pressed, is achieved.

At least one elastic support unit 3650 may be disposed to support the rear side of the control button 3624. In the current embodiment of the present invention, a pair of elastic support units 3650 are disposed to be symmetrical with respect to each other based on pressing protrusions 3630. However, the arrangement and the number of elastic support units 3650 are not limited.

Each of the elastic support units 3650 may include a plurality of elastic ribs 3654 that support the control button 3624 with respect of a front side of a support panel body 3641 of the support panel 3640 with elasticity, and a rib fixing portion 3652 that supports the plurality of elastic ribs 3654 on a button body 3626.

Unexplained reference numerals 3621*a*, 3622, 3622*a*, 3641*a*, 3641*b*, 3643, 3659, and 3671 represent the same configurations as the coupling protrusion 3121*a*, the control panel body 3122, the coupling groove 3622*a*, the coupling protrusion 3141*a*, the guide protrusion 3143, the partitioning rib 3159, and the guide rib 3171.

Hereinafter, a control button assembly according to a seventh embodiment of the present invention and a washing machine having the same will be described. A description of a redundant configuration with the above-described embodiments will be omitted.

FIG. 62 is an exploded perspective view of a control button assembly according to the seventh embodiment of the present invention.

A control button assembly 3700 according to the current embodiment has a different configuration from the control panel of the control button assembly according to the sixth embodiment.

A support panel 3640 is disposed to be coupled to a rear side of a control panel 3620.

The support panel 3640 may include an elastic support unit 3750 that is disposed at a rear side of a control button 3624 and elastically supports the control button 3624.

One elastic support unit 3750 may be disposed at the rear side of the control button 3624 to correspond to the control button 3624.

The elastic support unit 3750 may include a plurality of elastic ribs 3754 that support the rear side of the control button 3624 with elasticity, and a rib fixing portion 3752 that supports the plurality of elastic ribs 3754 on a support panel body 3641. A guide surface 3752*a* that guides movement of moisture in the control button assembly 3700 is formed on one surface of the rib fixing portion 3752.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A washing machine comprising:

a cabinet comprising a plurality of side frames, a back frame, a top frame, and a bottom frame;

a tub disposed in the cabinet;

a rotating tub that is rotatably disposed in the tub and accommodates laundry;

a front frame coupled to a front of the cabinet and having an internal laundry port;

a front cover that is disposed in front of the front frame and formed in a single piece, and comprises:

an external laundry port corresponding to the internal laundry port and through which the laundry is put into the rotating tub, and an attached panel installation port in which an attached panel for displaying or receiving operation information is installed, wherein the attached panel installation port comprises:

a display panel installation port in which a display panel for displaying the operation information of the washing machine is installed; and a manipulation panel installation port in which a manipulation panel for operating the washing machine is installed, wherein the manipulation panel installation port is disposed separately from the display panel installation port on the front cover, a guide door that is disposed between the front cover and the front frame and has a shape of a ring that connects the external laundry port and the internal laundry port, and a detergent box disposed between the front cover and the front frame.

2. The washing machine of claim 1, wherein:

the display panel installation port includes an upper mold ejection surface and a lower mold ejection surface, and at least one of the upper mold ejection surface and the lower mold ejection surface are parallel to a horizontal plane.

3. The washing machine of claim 1, wherein the manipulation panel installation port is installed on an inclined portion of the front cover.

4. The washing machine of claim 1, wherein the front frame is formed of a steel plate and the front cover is formed of resin material.

5. The washing machine of claim 1, wherein the front cover covers an entire front area of the front frame.

6. The washing machine of claim 1, wherein the front cover comprises a panel portion having the external laundry port and the attached panel installation port, and at least one elastic hook that protrudes from the panel portion rearward so that the front cover is detachably coupled to the side frames through the at least one elastic hook.

7. The washing machine of claim 6, wherein the front cover comprises at least one support leg that protrudes from a portion of the panel portion adjacent to the external laundry port rearward so as to be supported on the front frame.

8. The washing machine of claim 7, wherein the at least one elastic hook and the at least one support leg are formed integrally with the panel portion.

9. The washing machine of claim 1, further comprising a door that opens or closes the external laundry port and the internal laundry port, and is mounted on the guide door.

* * * * *